US005179240A

United States Patent [19]

Mizuno et al.

[11] Patent Number: 5,179,240

[45] Date of Patent: Jan. 12, 1993

[54] ELECTRONIC MUSICAL INSTRUMENT WITH A MELODY AND RHYTHM GENERATOR

[75] Inventors: Kotaro Mizuno, Hamamatsu; Fumio Iwase, Aichi, both of Japan

[73] Assignee: Yamaha Corporation, Hamamatsu, Japan

[21] Appl. No.: 456,152

[22] Filed: Dec. 22, 1989

[30] Foreign Application Priority Data

Dec. 26, 1988 [JP] Japan ..... 63-328624

[51] Int. Cl.[5] ..... G10H 1/38; G10H 1/42; G10H 1/46

[52] U.S. Cl. ..... 84/613; 84/651; 84/665; 84/DIG. 12; 84/DIG. 22

[58] Field of Search ..... 84/609-614, 84/616, 617, 622-638, DIG. 12, DIG. 22, 649-652, 665-669

[56] References Cited

U.S. PATENT DOCUMENTS 4,429,606 2/1984 Aoki .
4,433,601 2/1984 Hall et al. .
4,450,742 5/1984 Sugiura .
4,508,002 4/1985 Hall et al. .

FOREIGN PATENT DOCUMENTS 55-73097 1/1980 Japan .
56-39595 2/1981 Japan .
56-123599 9/1981 Japan .
58-98791 6/1983 Japan .
59-13656 1/1984 Japan .
59-68788 3/1984 Japan .
59-116696 4/1984 Japan .
63-22316 2/1988 Japan .
63-20351 3/1988 Japan .

*Primary Examiner*—Stanley J. Witkowski
*Attorney, Agent, or Firm*—Graham & James

[57] ABSTRACT

An electronic musical instrument provides a keyboard providing plural keys, memories for storing necessary programs and data, a musical tone signal generating circuit providing plural channels and a control unit such as a micro computer. A melody tone is designated by depressing a melody key within the keyboard. Then, an additional tone is automatically generated in relation to the melody tone by executing the programs, wherein its pitch, volume and tone color are controlled by the control unit. The melody tone and additional tone are assigned to desirable channels, from which the melody tone and additional tone are generated at different phonic positions. By varying the number of forming pattern of additional tones, it is possible to carry out the performance full of variety. Preferably, the additional tone is selected identical to a chord constituent note within a chord designated by performing the keyboard.

13 Claims, 38 Drawing Sheets

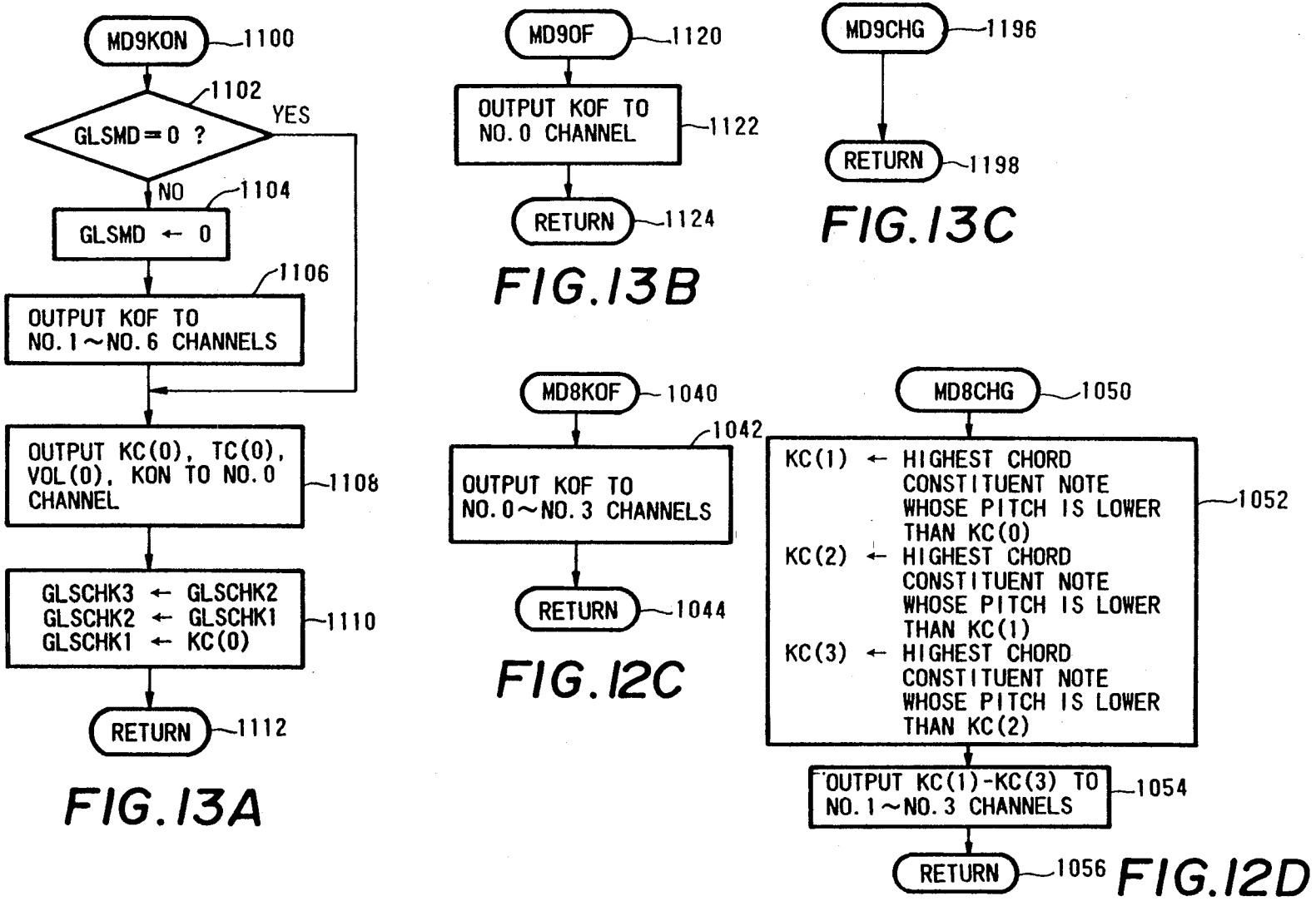
MD9KON
1100
GLSMD=0 ?
1102
YES
NO
GLSMD ← 0
1104
OUTPUT KOF TO NO.1~NO.6 CHANNELS
1106
OUTPUT KC(0), TC(0), VOL(0), KON TO NO.0 CHANNEL
1108
GLSCHK3 ← GLSCHK2
GLSCHK2 ← GLSCHK1
GLSCHK1 ← KC(0)
1110
RETURN
1112
FIG.13A
MD9OF
1120
OUTPUT KOF TO NO.0 CHANNEL
1122
RETURN
1124
FIG.13B
MD9CHG
1196
RETURN
1198
FIG.13C
MD8KOF
1040
OUTPUT KOF TO NO.0~NO.3 CHANNELS
1042
RETURN
1044
FIG.12C
MD8CHG
1050
KC(1) ← HIGHEST CHORD CONSTITUENT NOTE WHOSE PITCH IS LOWER THAN KC(0)
KC(2) ← HIGHEST CHORD CONSTITUENT NOTE WHOSE PITCH IS LOWER THAN KC(1)
KC(3) ← HIGHEST CHORD CONSTITUENT NOTE WHOSE PITCH IS LOWER THAN KC(2)
1052
OUTPUT KC(1)-KC(3) TO NO.1~NO.3 CHANNELS
1054
RETURN
1056
FIG.12D MD11KON
1300
CCNT ← 0
1302
OUTPUT KOF TO NO.0~NO.3 CHANNELS
1304
KC(1)←KC(0)−5
KC(2)←KC(0)−5
KC(3)←KC(0)−12
VOL(1)~VOL(3)←VOL(0)
1306
OUTPUT KC(0)~KC(3), TC(0)~TC(3), VOL(0)~VOL(3), KON TO NO.0~NO.3 CHANNELS
1308
RETURN
1310

MD11KOF
1360
OUTPUT KOF TO NO.0~NO.3 CHANNELS
1362
RETURN
1364

MD11CHG
1370
RETURN
1372

KON
CCNT
2 4 6 8 10 12 14 16 18 20 22 24 26 28
KC(3) IS LOWERED BY 2 OCTAVES
MAX (0dB)
MIN (−60dB)
TONE VOLUME
VOL(0) ~ VOL(3)

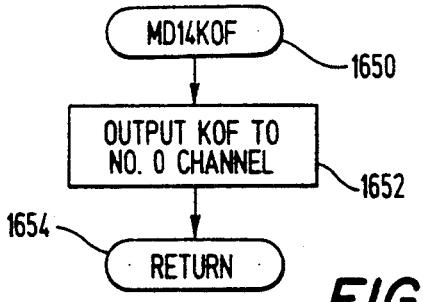
FIG. 18C
FIG. 18D
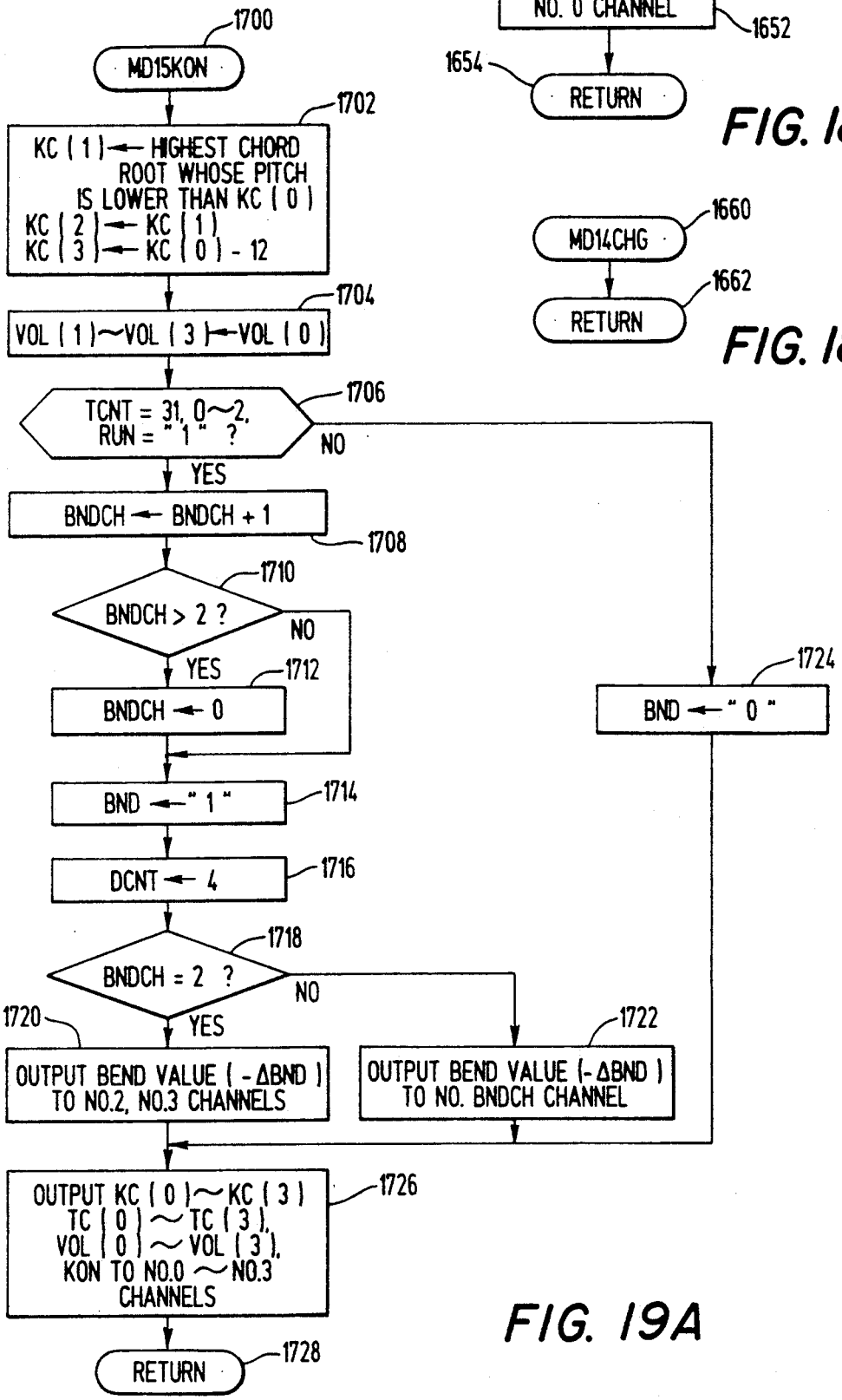
FIG. 19A

ELECTRONIC MUSICAL INSTRUMENT WITH A MELODY AND RHYTHM GENERATOR

BACKGROUND OF THE INVENTION

1. Field of the Invention

The present invention relates to an electronic musical instrument which generates a melody tone and a rhythm tone based on a performance of a keyboard.

2. Prior Art

Conventionally, several kinds of electronic musical instruments has been developed. For example, Japanese Patent Laid-Open Publication Nos. 56-39595 and 59-68788 disclose the electronic musical instrument which adds musical tones having the same notes of chord to melody tones as additional tones to thereby shift tone-generation timings or tone colors of these additional tones. Japanese Patent Publication No. 63-22316 and Japanese Patent Laid-Open Publication No. 59-116696 disclose the electronic musical instrument which generate the additional tone having the predetermined interval to the melody tone as a duet tone. Japanese Patent Laid-Open Publication No. 55-73097 discloses the electronic musical instrument which generates the chord by the predetermined pattern in addition to the melody tone as the backing. Japanese Patent Laid-Open Publication No. 56-123599 discloses the electronic musical instrument which stores melody performance data in accordance with the melody performance and then generates the musical tone based on the stored melody performance data with the melody tone to thereby obtain the canon performance. Japanese Patent Laid-Open Publication No. 58-98791 and Japanese Patent Publication No. 63-20351 disclose the electronic musical instrument which adds arpeggio tones and glissando tones to the melody tones. Further, Japanese Utility Model Publication No. 59-13656 discloses the electronic musical instrument which gives a pitch bend effect on the melody tone.

In the above-mentioned conventional electronic musical instruments, generation of the additional tones are selectively controlled depending on the performer. For this reason, if the performer is a beginner, such selective control becomes extremely difficult. In general, desirable desirable additional tones should be selected in accordance with the sound, impression or feelings of the music to be performed, such as the rock music, lullaby, chanson etc. However, it is likely that the above-mentioned beginner may make some errors to select such additional tones. In such case, the performed music will be heard unnatural due to the trouble of selecting the additional tones.

SUMMARY OF THE INVENTION

It is accordingly a primary object of the present invention to provide an electronic musical instrument capable of automatically generating desirable additional tones with the melody tones.

It is another object of the present invention to provide an electronic musical instrument which generates the additional tones suitable for the sound, impression or feelings of the music to be performed so that music full of variety can be obtained.

In a first aspect of the present invention, there is provided an electronic musical instrument comprising:

(a) melody designating means for designating a melody tone;

(b) adding means for adding an additional tone to said melody tone; and (c) varying means for varying a generating condition of said additional tone in a lapse of time passed after said melody tone is generated.

In a second aspect of the present invention, there is provided an electronic musical instrument comprising:

(a) melody designating means for designating a melody tone;

(b) chord designating means for designating a chord;

(c) rhythm designating means for designating a rhythm which includes a predetermined tone-generation pattern of an additional tone to be added to said melody tone;

(d) detecting means for detecting whether or not a pitch of said melody tone is higher than a predetermined pitch; and (e) varying means for varying a forming pattern of said additional tone based on a detection result of said detecting means.

In a third aspect of the present invention, there is provided an electronic musical instrument comprising:

(a) melody designating means for designating a melody tone;

(b) detecting means for detecting whether or not said melody designating means designates said melody tone; and (c) adding means for adding an additional tone to said melody tone, wherein a forming pattern of said additional tone is varied based on a detection result of said detecting means.

In a fourth aspect of the present invention, there is provided an electronic musical instrument comprising:

(a) melody designating means for designating a pitch of a melody tone;

(b) chord designating means for designating a chord;

(c) musical tone signal generating means for generating a musical tone signal corresponding to said melody tone and said chord;

(d) rhythm selecting means for selecting a rhythm kind;

(e) rhythm tone control means for controlling a rhythm tone signal to be generated by a predetermined timing in response to the rhythm kind and its rhythm progression selected by said rhythm selecting means;

(f) rhythm tone generating means for generating a rhythm tone corresponding to said rhythm tone signal;

(g) additional tone control means for controlling an additional tone to be added to said melody tone in response to the pitch of said melody tone, the chord and the rhythm progression, said musical tone signal also corresponding to said additional tone;

(h) pattern control means for controlling a forming pattern of said additional tone in response to a selected rhythm kind; and (i) tone color control means for controlling a tone color of said additional tone in response to the selected rhythm kind.

In a fifth aspect of the present invention, there is provided an electronic musical instrument comprising:

(a) a keyboard providing plural keys which are to be used for a melody and accompaniment performance;

(b) memory means for storing programs and data which are necessary to carry out the melody and accompaniment performance;

(c) additional tone generating means for automatically generating additional tone in relation to a melody tone designated by performing said keyboard;

(d) musical tone signal generating means providing a plurality of channels each capable of generating a musical tone signal corresponding to said melody tone and/or said additional tone; and (e) control means for controlling said musical tone signal to thereby control musical parameters of said melody tone and said additional tone based on the programs and data stored in said memory means.

In a sixth aspect of the present invention, there is provided an electronic musical instrument comprising:

(a) melody designating means for designating a melody tone;

(b) detecting means for detecting whether or not the melody tone is maintained during a predetermined time; and (c) musical tone pattern generating means for generating a musical tone pattern in accordance with detecting result of said detecting means.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings:

FIGS. 12A–12D are flowcharts showing sub-programs used in 8th solo style play mode;

FIGS. 13A–13E are flowcharts showing sub-programs used in 9th solo style play mode;

FIGS. 18A–18D are flowcharts showing sub-programs used in 14th solo style play mode;

FIGS. 19A–19D are flowcharts showing sub-programs used in 15th solo style play mode.

DESCRIPTION OF A PREFERRED EMBODIMENT

[A] Configuration

Figure 1:
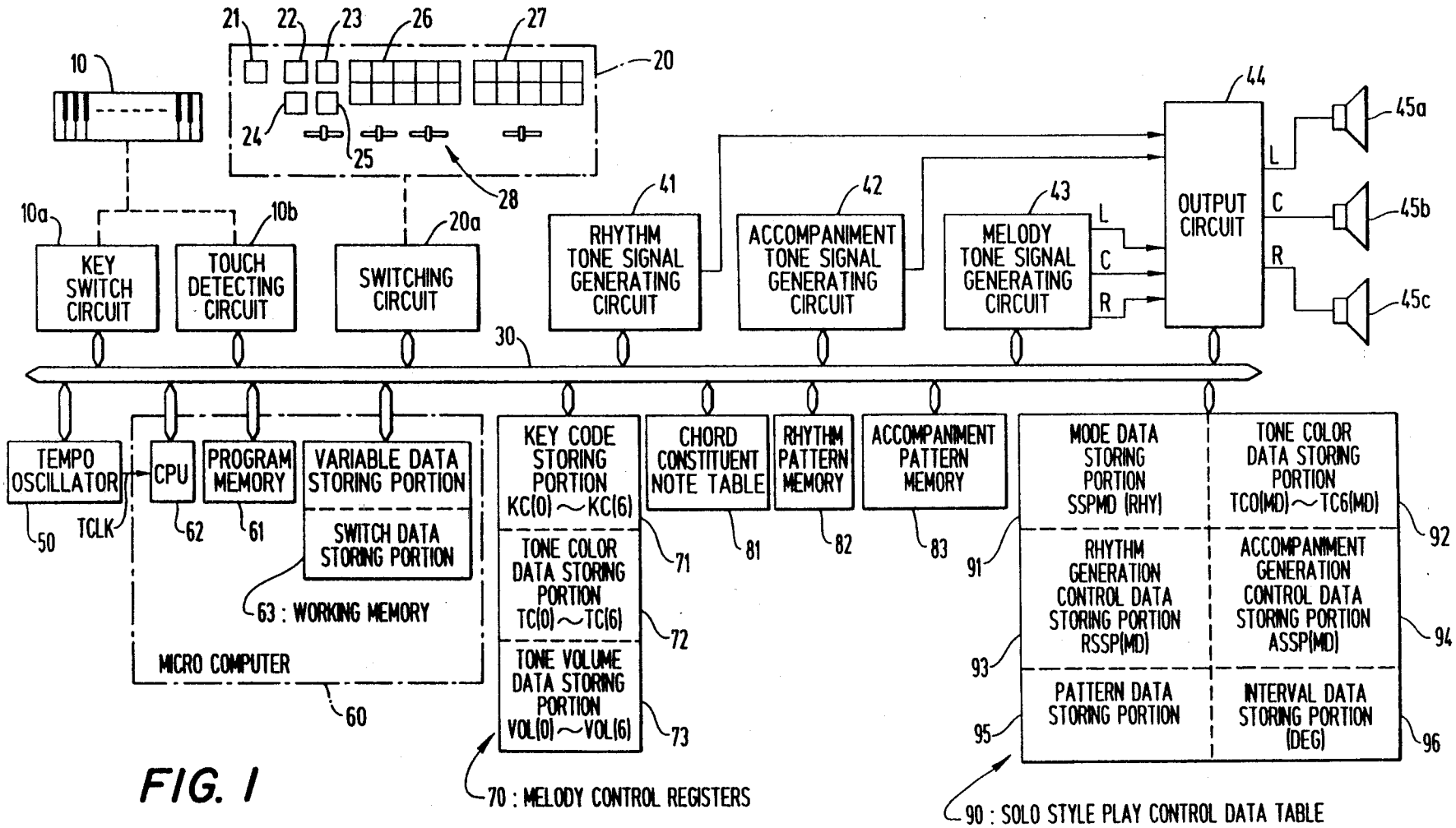
FIG. 1 is a block diagram showing a whole configuration of an electronic musical instrument according to an embodiment of the present invention.

Next, description will be given with respect to the preferred embodiment of the present invention by referring to the drawings. FIG. 1 is a block diagram showing the whole configuration of the electronic musical instrument according to the present invention.

This electronic musical instrument provides a keyboard 10 and an operation panel 20, wherein keyboard 10 provides plural keys whose tone pitches range from C2 to C7. As key codes KC, numbers "36" to "96" are assigned to respective keys in pitch ascending order. All keys can be used in two cases selectively: (i) first case where they are all used for the melody performance; (ii) second case where keys of pitches C2 to G3 are used for the chord performance and other keys of pitches G3# to C7 are used for the melody performance. A key switch circuit 10*a* contains plural key switches each corresponding to each of the keys of the keyboard 10. The key-depression and key-release of each key is detected based on the open/close state of each key switch. In addition, a key touch detecting circuit 10*b* contains plural key touch sensors each corresponding to each of the keys. Therefore, the key touch of each key is detected by its corresponding key touch sensor.

The operation panel 20 provides a solo style play switch 21, an automatic accompaniment switch 22, a rhythm start switch 23, a rhythm stop switch 24, a synchro-start switch 25, rhythm select switches 26, tone color select switches 27 and other switches or controls 28. The solo style play switch 21 is provided to perform "solo style play" in which the additional tones are generated in response to the melody performance, chord performance and the like. The automatic accompaniment switch 22 is provided to perform the automatic accompaniment. The rhythm start switch 23 is provided to designate the start timing of the automatic rhythm performance. The rhythm stop switch 24 is provided to designate the stop timing of the automatic rhythm performance. The synchro-start switch 25 is provided to control the synchro-start operation of the automatic rhythm performance. In this synchro-start operation, the automatic rhythm performance is set in standby state before the key of the keyboard 10 is depressed, while it is started in synchronism with the key-depression of any one of the keys. By operating the rhythm select switches 26, several rhythm kinds can be selected in the automatic rhythm performance and automatic accompaniment. Herein, each rhythm kind determines each mode of the solo style play, which will be described later. The tone color select switches 27 are provided to select the tone colors of the melody tone (i.e., musical tone) and automatic accompaniment tone, such as the tone colors of guitar, piano etc. Other controls 28 control the tone volumes of the accompaniment tone, melody tone, rhythm tone and the tempo of the automatic rhythm. A switching circuit 20*a* contains plural internal switches and volumes each corresponding to each of the above-mentioned switches and controls provided at the operation panel 20. Hence, based on the states of these internal switches and volumes in the switching circuit 20*a*, operations of the above-mentioned switches and controls of the operation panel 20 are detected.

The key switch circuit 10*a*, key touch detecting circuit 10*b* and switching circuit 20*a* are connected to a bus 30 to which a rhythm tone signal generating circuit 41, an accompaniment tone signal generating circuit 42, a melody tone signal generating circuit 43, a tempo oscillator 50 and a micro computer 60 are further connected.

The rhythm tone signal generating circuit 41 provides plural percussive tone signal generating channels each of which can generate a percussive tone signal corresponding to a percussion instrument such as a cymbal or, a bass drum in response to a rhythm tone control signal supplied from the micro computer 60 via the bus 30. In addition, the accompaniment tone signal generating circuit 42 provides plural accompaniment tone signal generating channels each of which can generate the accompaniment tone signal corresponding to the musical instrument such as the guitar or, piano in response to an accompaniment tone control signal supplied from the micro computer 60 via the bus 30.

The melody tone signal generating circuit 43 provides No.0 to No.6 melody tone signal generating channels (i.e., musical tone signal generating channels) and a pan control circuit. The micro computer 60 supplies a key-on signal KON or, a key-off signal KOF, No.0 to No.6 key codes KC(0)-KC(6), No.0 to No.6 tone color data TC(0)-TC(6) and No.0 to No.6 tone volume data VOL(0)-VOL(6) to the melody tone signal generating circuit 43 via the bus 30. Thus, the melody tone signals are generated from the above-mentioned No.0 to No.6 melody tone signal generating channels, wherein their tone pitches, tone colors and tone volumes are respectively controlled by the above-mentioned data KC(0)-KC(6), TC(0)-TC(6) and VOL(0)-VOL(6). In addition, generation of each melody tone signal is started by the key-on signal KON, while it is terminated by the key-off signal KOF. Each of the melody tone signal generating channels provides a pitch control circuit and a tone volume control circuit including an interpolation circuit (not shown). When the key code KC(0)-KC(6) and tone volume data VOL(0)-VOL(6) are supplied to these two control circuits in each melody tone signal generating channel, the tone pitch and tone volume of the melody tone signal are immediately varied in response to KC(0)-KC(6), VOL(0)-VOL(6). On the other hand, when an interpolation control signal is supplied to the interpolation circuit just after each channel receives the key code KC(0)-KC(6) and tone volume data VOL(0)-VOL(6), the preceding melody tone signal corresponding to the preceding key code and tone volume data is smoothly changed to the current melody tone signal corresponding to the current key code and tone volume data in an interpolated manner. When a de-tune signal is supplied, the pitch control circuit slightly shifts up or down the tone pitch of the melody tone signal to be generated by some cents or some tens of cents.

The pan control circuit selects one or more of speakers 45*a* to 45*c* so that the selected speaker will generate the musical tone whose tone volume is controlled by the pan control circuit. In response to the pan control signal supplied from the micro computer 60 via the bus 30, the pan control circuit outputs the melody tone signal to output lines L, C, R by each melody tone signal generating channel. Incidentally, in the case where the micro computer 60 does not output the pan control signal to the melody tone signal generating circuit 43, the melody tone signal is equally supplied to all output lines L, C, R.

The rhythm tone signal generating circuit 41, accompaniment tone signal generating circuit 42 and melody tone signal generating circuit 43 are all connected to an output circuit 44, which mixes the outputs of these circuits 41, 42, 43 together. Then, the mixed signal is outputted to the output lines L, C, R. In this case, the outputs of the rhythm tone signal generating circuit 41 and accompaniment tone signal generating circuit 42 are respectively outputted to the output lines L, C, R of the output circuit 44 at the same rate, while the outputs from the lines L, C, R of the melody tone signal generating circuit 43 are directly outputted to the output line L, C, R of the output circuit 44 respectively. These output lines L, C, R of the output circuit 44 are respectively coupled to the speakers 45*a*, 45*b*, 45*c* which are spatially arranged at left, center and right positions respectively.

The tempo oscillator 50 outputs a tempo clock signal TCLK having the period corresponding to a thirty-second note to the micro computer 60 as the interrupt signal. The period of this tempo clock signal TCLK is set by a tempo control within the foregoing other controls 28, and it is also determined by tempo control data to be supplied from the micro computer 60 via the bus 30.

The micro computer 60 includes a program memory 61, a central processing unit (CPU) 62 and a working memory 63 all of which are connected to the bus 30. The program memory 61 is constructed by a read-only memory (ROM), which stores a main program and its sub programs corresponding to the flowchart shown in FIGS. 2A, 2B, and a clock interrupt program corresponding to the flowchart shown in FIG. 4. When a power switch (not shown) is closed, the CPU 62 starts the execution of the main program. Until the power switch is opened, such execution of the main program is repeated. Every time the CPU 62 receives the tempo clock signal TCLK from the tempo oscillator 50, it breaks the execution of the main program and then executes the interrupt process based on the clock interrupt program. The working memory 63 is constructed by a random-access memory (RAM), which includes a variable data storing portion and a switch data storing portion. Both of these two portions store several kinds of data which are necessary to execute the above-mentioned programs. In the present embodiment, the variable data storing portion mainly stores flag data, operational data and the like, while the switch data storing portion stores data indicative of the states of the internal switches provided in the key switch circuit 10*a* and switching circuit 20*a*.

In addition, melody control registers 70, a chord constituent note table 81, a rhythm pattern memory 82, an accompaniment pattern memory 83 and a solo style play control data table 90 are connected to the bus 30. Herein, the melody control registers 70 are constructed by a RAM, while each of the other tables and memories 81, 82, 83, 90 is constructed by a ROM.

The melody control registers 70 are divided into three portions, i.e., a key code storing portion 71, a tone color data storing portion 72 and a tone volume data storing portion 73. The key code storing portion 71 stores No.0 to No.6 key codes KC(0)-KC(6) indicating respective tone pitches of the melody tone signals generated from No.0 to No.6 melody tone signal generating channels in the melody tone signal generating circuit 43. The tone color data storing portion 72 stores No.0 to No.6 tone color data TC(0)-TC(6) indicating respective tone colors of the above-mentioned melody tone signals. The tone volume data storing portion 73 stores No.0 to No.6 tone volume data VOL(0)-VOL(6) indicating respective tone volumes of the above-mentioned melody tone signals.

The chord constituent note table 81 is used to detect the chord and search the chord constituent notes. This table 81 stores note codes NC indicative of all chord constituent notes (e.g., C, E, G notes) of chords (e.g., chords of the major, minor, augmented chord etc.) each including C note as its root (i.e., fundamental note of chord). Herein, the note code NC is the code indicative of the note name which is obtained by removing the octave from the key code KC. The rhythm pattern memory 82 stores the predetermined rhythm pattern data of one bar. This rhythm pattern memory 82 is divided into plural pattern memories corresponding to plural rhythm kinds, wherein each pattern memory has 32 addresses which are designated by the tempo count data TCNT (0-31). At each address, the predetermined number of percussive tone data indicative of the percussion instruments such as the cymbal, bass drum etc. whose tones are to be generated are stored. The accompaniment pattern memory 83 stores accompaniment pattern data of one bar indicating the predetermined chord performance, arpeggios etc. This accompaniment pattern memory 83 is divided into plural pattern memories corresponding to plural rhythm kinds and chord types. Each pattern memory has 32 addresses designated by the tempo count data TCNT (0-31). At each address, the predetermined number of interval data each indicating the number of semitones between the accompaniment tone to be generated and its root are stored. Incidentally, each of the rhythm pattern memory 82 and accompaniment pattern memory 83 stores data indicative of the non-processing at the address corresponding to non-tone-generation timing.

The solo style play control table 90 is divided into a mode data storing portion 91, a tone color data storing portion 92, a rhythm generation control data storing portion 93, an accompaniment generation control data storing portion 94, a pattern data storing portion 95 and an interval data storing portion 96.

The mode data storing portion 91 stores solo style play mode data SSPMD(RHY) (whose value can be varied from "1" to "15") indicative of the predetermined solo style play mode name in response to the rhythm kind, wherein SSPMD(RHY) corresponds to rhythm kind data RHY indicative of the rhythm kind. The tone color data storing portion 92 stores No.0 to No.6 tone color data TCO(MD)-TC6(MD) indicative of the tone colors of the melody tone signals generated from the foregoing channels of the melody tone signal generating circuit 43, wherein data TC0(MD)-TC6(MD) are determined by each solo style play mode, and they correspond to mode data MD indicative of the selected solo style play mode. In certain solo style play modes which partially utilize some of No.0 to No.6 melody tone signal generating channels, the tone color data storing portion 92 does not of course store tone color data TCi(MD) concerning No.i channel which is not used.

The rhythm generation control data storing portion 93 stores rhythm solo style play data RSSP(MD) in relation to the mode data indicative of the selected solo style play mode. The rhythm solo style play data RSSP(MD) indicates a rhythm dependence mode wherein the generation of the additional tone according to the solo style play is controlled during the operation of the automatic rhythm when RSSP(MD) is at "1". In other words, when the data RSSP(MD) is equal to "1", the designated mode must be performed with the automatic rhythm performance. On the other hand, the data RSSP(MD) indicates a rhytm independence mode wherein regardless of the operation and non-operation of the automatic rhythm, the generation of the additional tone is controlled when RSSP(MD) is at "0". The accompaniment generation control data storing portion 94 stores accompaniment solo style play data ASSP(MD) in relation to the mode data MD indicative of the selected solo style play mode. The accompaniment solo style play data ASSP(MD) indicates an accompaniment dependence mode wherein the generation of the additional tone according to the solo style play is controlled during the operation of the automatic accompaniment when ASSP(MD) is at "1". In other words, when the data ASSP(MD) is equal to "1", the designated mode needs the automatic accompaniment performance. On the other hand, the data ASSP(MD) indicates an accompaniment independence mode wherein regardless of the operation and non-operation of the automatic accompaniment, the generation of the additional tone is controlled when ASSP(MD) is at "0". The pattern data storing portion 95 stores pattern data indicative of the tone-generation of the additional tone which is used in the solo style play, wherein this pattern data is stored in relation to the mode data MD indicative of the selected solo style play mode. The interval data storing portion 96 stores interval data DEG which is used to form the additional tone used in the solo style play, wherein this interval data DEG is stored in relation to the above-mentioned mode data MD. The data stored in these portions 95, 96 are provided only for the necessary solo style play modes, which will be described later.

[B] Operation

Next, description will be given with respect to the operation of the present embodiment by referring to the flowcharts for each of the solo style play modes.

(1) Main Program

Figure 2A:
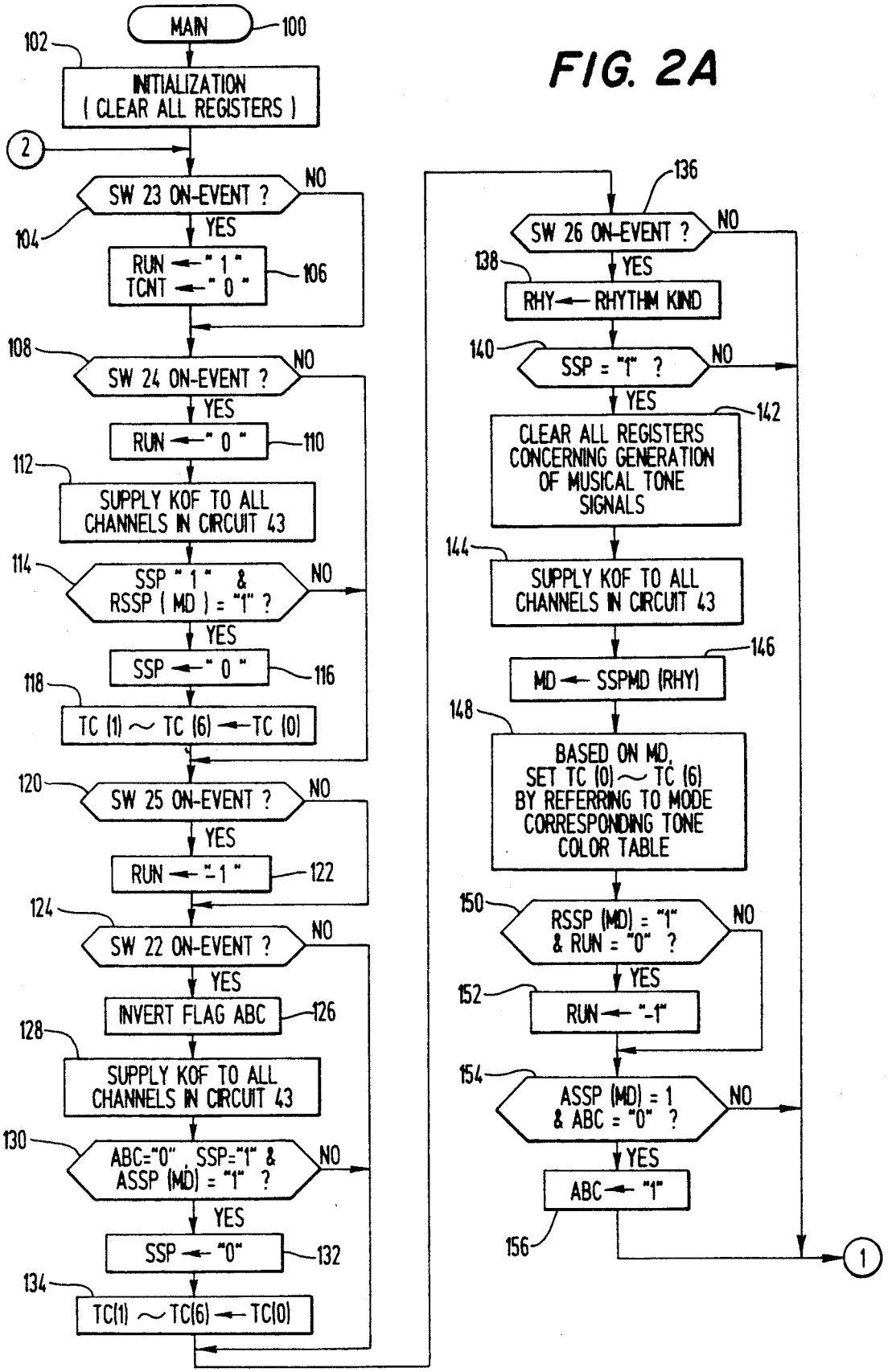
FIGS. 2A, 2B are flowcharts of a main program.

When the power switch is on, the CPU 62 starts to execute the main program from step 100 shown in FIG. 2A. In step 102, the initialization is carried out by clearing several registers. Thereafter, until the power switch is off, the CPU 62 continues to execute circulating processes of steps 104 to 190.

During the execution of such circulating processes, when the rhythm start switch 23 is operated, the CPU 62 judges that an on-event has happened to the rhythm start switch 23, which turns the judgement of step 104 to "YES". Thus, a rhythm run flag RUN is set at "1"; the automatic rhythm is suspended when RUN is at "0"; and the automatic rhythm is subject to the standby tempo clock signal TCLK is supplied to the CPU 62, the tempo count data TCNT is incremented from "0" to "31". Therefore, the initial value of TCNT is "0". For this reason, due to the processes of steps 104, 106, the automatic rhythm is started from bar head timing in synchronism with the operation of the rhythm start switch 23.

When the rhythm stop switch 24 is operated, the CPU 62 judges that the on-event is has happened to the rhythm stop switch 24, which turns the judgement of step 108 to "YES". Then, the rhythm run flag RUN is set at "0" in step 110. Thus, operation of the automatic rhythm is stopped. In next step 112, the key-off signal KOF is supplied to all channels of the melody tone signal generating circuit 43 via the bus 30, so that all channels stop outputting the musical tone signals. Therefore, when the automatic rhythm is stopped, the generation of the melody tone signals indicative of the melody tones including the additional tones is terminated so that the melody tone signal generating circuit 43 is set into the initial state.

After executing the above-mentioned process of step 112, it is judged whether or not a solo style play flag SSP is at "1" and the rhythm solo style play data RSSP(MD) is at "1" in the rhythm solo style play data RSSP(MD) is at "1" in step 114. Only when these two conditions are satisfied, the solo style play flag SSP is set at "0" in step 116 based on the condition where the judgement of step 116 is "YES". In the above-mentioned judgement process of step 114, the rhythm solo style play data RSSP(MD) is read from the rhythm generation control data storing portion 93 within the solo style play control data table 90 in response to the mode data MD indicative of the currently selected solo style play mode. In this case, the solo style play is selected when the solo style play flag SSP is at "1", and the rhythm dependence mode is selected when the rhythm solo style play data RSSP(MD) is at "1". Therefore, when the automatic rhythm is terminated in the state where the rhythm dependence mode is selected as the solo style play mode, the solo style play flag SSP is set at "0" which indicates that the solo style play is not selected. Because, the solo style play must be accompanied with the rhythm performance in some modes. In this case, all channels of the melody tone signal generating circuit 43 are used for the melody performance of the keyboard 10. Therefore, in step 118, No.0 to No.6 tone color data TC(1) to TC(6) stored in the tone color data storing portion 72 within the melody control registers 70 are set equal to No.0 tone color data TC(0).

Meanwhile, in the case where the solo style play flag SSP is set at "0" indicating that the solo style play is not selected, or in the case where the rhythm solo style play data RSSP(MD) is at "0" indicating the rhythm independence mode, even if the solo style play flag SSP is set at "1" indicating that the solo style play is selected, the judgement of step 114 turns to "NO" so that the processes of steps 116, 118 are omitted. In this case, the solo style play flag SSP and No.1to No.6 tone color data TC(1)-TC(6) are respectively maintained at their preceding values.

When the synchro-start switch 25 is operated, the CPU 62 detects the on-event happened to the synchro-start switch 25 so that the judgement of step 120 turns to "YES". In next step 122, the rhythm run flag RUN is set at "−1" indicating the standby state of the automatic rhythm.

When the automatic accompaniment switch 22 is operated, the CPU 62 detects its on-event so that the judgement of step 124 turns to "YES". In next step 126, an accompaniment flag ABC is inverted. In other words, the current accompaniment flag ABC is at "0" when the preceding ABC is at "1", while the current ABC is at "1" when the preceding ABC is at "0". Herein, the accompaniment flag ABC at "1" level indicates the operating state of the automatic accompaniment, while ABC at "0" level indicates the non-operating state of the automatic accompaniment. Thus, under the processes of steps 124, 126, the automatic accompaniment is terminated in synchronism with the operation of the automatic accompaniment switch 22 in the case where the automatic accompaniment has been operated; while the automatic accompaniment is started in synchronism with the operation of the switch 22 in the case where the automatic accompaniment has not been operated. After executing the process of step 126, as similar to the foregoing step 112, the key-off signal KOF is outputted to all channels of the melody tone signal generating circuit 43, so that the generation of the musical tone signal is terminated and this circuit 43 is returned into its initial state.

After executing the above-mentioned process of step 128, the processing proceeds to step 130 wherein it is judged whether or not the accompaniment flag ABC is at "0", the solo style play flag SSP is at "1" and the accompaniment solo style data ASSP(MD) is at "1". Only when these three conditions are satisfied, the judgement of step 130 turns to "YES" so that the processing proceeds to step 132 wherein the solo style play flag SSP is set at "0". In the above-mentioned step 130, the accompaniment solo style play data ASSP(MD) is read from the accompaniment generation control data storing portion 94 in the solo style play control data table 90 in response to the mode data MD. Due to the process of step 126, the accompaniment flag ABC is inverted to "0" level indicating the stop state of the automatic accompaniment. As a result, as similar to the foregoing processes of steps 114, 116, when the automatic accompaniment is stopped in the state where the accompaniment dependence mode is selected as the solo style play mode, the solo style play flag SSP is set at "0" indicating that the solo style play is not selected. Even in this case, in order to utilize all channels of the melody tone signal generating circuit 43 for the melody performance of the keyboard 10, No.1 to No.6 tone color data TC(1)-TC(6) stored in the tone color data storing portion 72 within the melody control registers 70 are all set equal to No.0 tone color data TC(0).

Meanwhile, in the case where the accompaniment flag ABC is set at "1" indicating the operating state of the automatic accompaniment due to the inverting process of step 126, the solo style play flag SSP is set at "0" indicating that the solo style play is not selected or the accompaniment solo style play data ASSP(MD) is set at "0" indicating the accompaniment independence mode, the judgement of step 130 turns to "NO" so that the processes of steps 132, 134 are omitted. Thus, the solo style play flag SSP, No.1 to No.6 tone color data TC(1)-TC(6) are respectively maintained at their initial values.

If any one of the rhythm select switches 26 is operated, the CPU 62 detects its on-event so that the judgement of step 136 turns to "YES". Then, the processing proceeds to step 138 wherein the rhythm kind data RHY is set identical to the data indicative of the rhythm kind corresponding to the operated rhythm select switch. In next step 140, it is judged whether or not the solo style play flag SSP is at "1". When the flag SSP is at "0" so that the solo style play is not selected, the judgement of step 140 turns to "NO" so that the processing proceeds to step 158 shown in FIG. 2B. On the other hand, when the flag SSP is at "1" so that the solo style play is selected, the judgement of step 140 turns to "YES" so that next processes of steps 142 etc. are to be executed.

In step 142, the CPU 62 clears several registers concerning the generation of the musical tone. In step 144, as similar to the foregoing processes of steps 112, and 128, the key-off signal KOF is outputted to all musical tone signal generation channels. Thus, initialization is made to the generation of melody tones and additional tones according to the solo style play. In next step 146, based on the rhythm kind data RHY which is newly set under the foregoing process of step 138, the CPU 62 refers to the mode data storing portion 91 within the solo style play control data table 90 to thereby set the solo style play mode data SSPMD(RHY) according to the rhythm kind as the mode data MD indicative of the currently selected solo style play mode. Then, in step 148, based on the set mode data MD, the CPU 62 refers to the tone color data storing portion 92, from which No.0 to No.6 tone color data TC0(MD)-TC6(MD) indicative of the optimum tone colors suitable to the solo style play mode indicated by the mode data MD are to be read out. Then, the read tone color data TC0(MD)-TC6(MD) are stored in the tone color data storing portion 72 as No.0 to No.6 tone color data TC(0)-TC(6). Incidentally, in the solo style play mode wherein one or more of No.0 to No.6 musical tone signal generating channels are not used, the tone color data TCi(MD) concerning the un-used musical tone signal generating channel is not stored in the tone color data storing portion 92. Therefore, this tone color data TCi(MD) is not stored in the tone color data storing portion 72 either.

After executing the above-mentioned process of step 148, the processing proceeds to step 150 wherein it is judged whether or not the rhythm solo style play data RSSP(MD) is at "1" and the rhythm run flag RUN is at "0" indicating the stop state of the automatic rhythm. Only when these two conditions are satisfied, the judgement of step 150 turns to "YES" so that the rhythm run flag RUN is set at "−1" indicating the standby state of the automatic rhythm. Herein, the rhythm solo style play data RSSP(MD) at "1" level indicates the rhythm dependence mode in the solo style play. Therefore, in the case where the rhythm kind designated by operating the rhythm select switches 26 indicates the rhythm dependence mode of the solo style play, the automatic rhythm is set in the standby state without operating the synchro-start switch 25. On the other hand, in the case where the rhythm kind does not indicate the rhythm dependence mode of the solo style play, or in the case where the automatic rhythm has been already set at the operating state or standby state, the judgement of step 150 turns to "NO" so that the process of step 152 is omitted. Then, the processing proceeds to step 154 while the rhythm run flag RUN is maintained at its preceding value.

In step 154, it is judged whether or not the accompaniment solo style play data ASSP(MD) is at "1" and the accompaniment flag ABC is at "0" indicating the stop state of the automatic accompaniment. Only when these two conditions are satisfied, the judgement of step 154 turns to "YES", the processing then proceeds to step 156 wherein the accompaniment flag ABC is set at "1" indicating the operating state of the automatic accompaniment. Herein, the accompaniment solo style play data ASSP(MD) at "1" level indicates the accompaniment dependence mode of the solo style play. Therefore, in the case where the rhythm kind selected by operating the rhythm select switch 26 designates the accompaniment dependence mode of the solo style play, the automatic accompaniment is at the operating state even if the automatic accompaniment has been stopped. On the other hand, in the case where the selected rhythm kind does not designate the accompaniment dependence mode of the solo style play, or in the case where the automatic accompaniment has been already set at the operating state, the judgement of step 154 turns to "NO" so that the process of step 156 is omitted. Therefore, the processing proceeds to step 158 shown in FIG. 2B, while the accompaniment flag ABC is maintained at its preceding value.

When the solo style play switch 21 is operated, the CPU 62 detects its on-event so that the judgement of step 158 turns to "YES". Then, the processing proceeds to step 160 wherein as similar to the foregoing steps, 112, 128, and 144, the key-off signal KOF is supplied to all channels of the melody tone signal generating circuit 43, so that this circuit 43 is set at its initial state. In next step 162, the solo style play flag SSP is inverted (from "0" to "1" to "0"). In step 164, it is judged whether or not the solo style play flag SSP is at "1". In this case, when due to the inverting process of step 162, the solo style play flag SSP is at "1" indicating that the solo style play is selected, the judgement of step 164 turns to "YES" so that processes of steps 166 to 176, similar to the foregoing processes of step 146 to 156 are executed. Under these processes of steps 166 to 176, the mode data MD, No.0 to No.6 tone color data TC(0)-TC(6), rhythm run flag RUN and accompaniment flag ABC are renewed. Thus, when the solo style play is selected, several data necessary to the solo style play are set in response to the selected rhythm kind.

On the other hand, when the solo style play flag SSP is inverted to "0" under the process of step 162, the judgement of step 164 turns to "NO". Then, the processing proceeds to step 178 when No.1 to No.6 tone color data TC(1)-TC(6) are set equal to No.0 tone color data TC(0). Thus, a common tone color is used for all musical tones generated from No.0 to No.6 channels of the melody tone signal generating circuit 43.

In addition, when any one of the tone color select switches 27 is operated, the CPU 62 detects its on-event so that the judgement of step 180 turns to "YES". Then, the processing proceeds to step 182 wherein it is judged whether or not the solo style play flag SSP is at "0". In this case, when the solo style play is not selected so that the solo style play flag SSP is set at "0", the judgement of step 182 turns to "YES". In next step 184, No.0 to No.6 tone color data TC(0)-TC(6) are set as the tone color data indicative of the tone color corresponding to the operated tone color select switch. On the other hand, when the solo style play is selected so that the flag SSP is at "1", the judgement of step 182 turns to "NO". In this case, the process of step 184 is omitted, so that No.0 to No.6 tone color data TC(0)-TC(6) are are maintained at their preceding values.

Further, in the case where any key of the keyboard 10 is depressed or released, it is judged that the key-depression or key-release event (hereinafter, simply refered to key-operation event) has occured on the corresponding key switch in the key switch circuit 10*a* in step 186. In this case, the processing proceeds to step 188 wherein a key-operation event routine is to be executed, which will be described later in detail. Incidentally, the detection of the key-operation happened to the key board 10 is made by comparing key state data of each key obtained from the key switch circuit 10*a* with previous key state data stored in the switch data storing portion within the working memory 63. Then, it is possible to obtain a new key code NKC indicative of the newly detected key to be operated and its key-operation flag which indicates whether the newly detected key is depressed or released, both of which will be used in the following programs described later.

Furthermore, other processes are to be executed in step 190, wherein several kinds of data are set and processed in relation to the other switches and controls 28 including the tone volume control, tempo control etc.

(2) Key-Operation Event Routine

Figure 3:
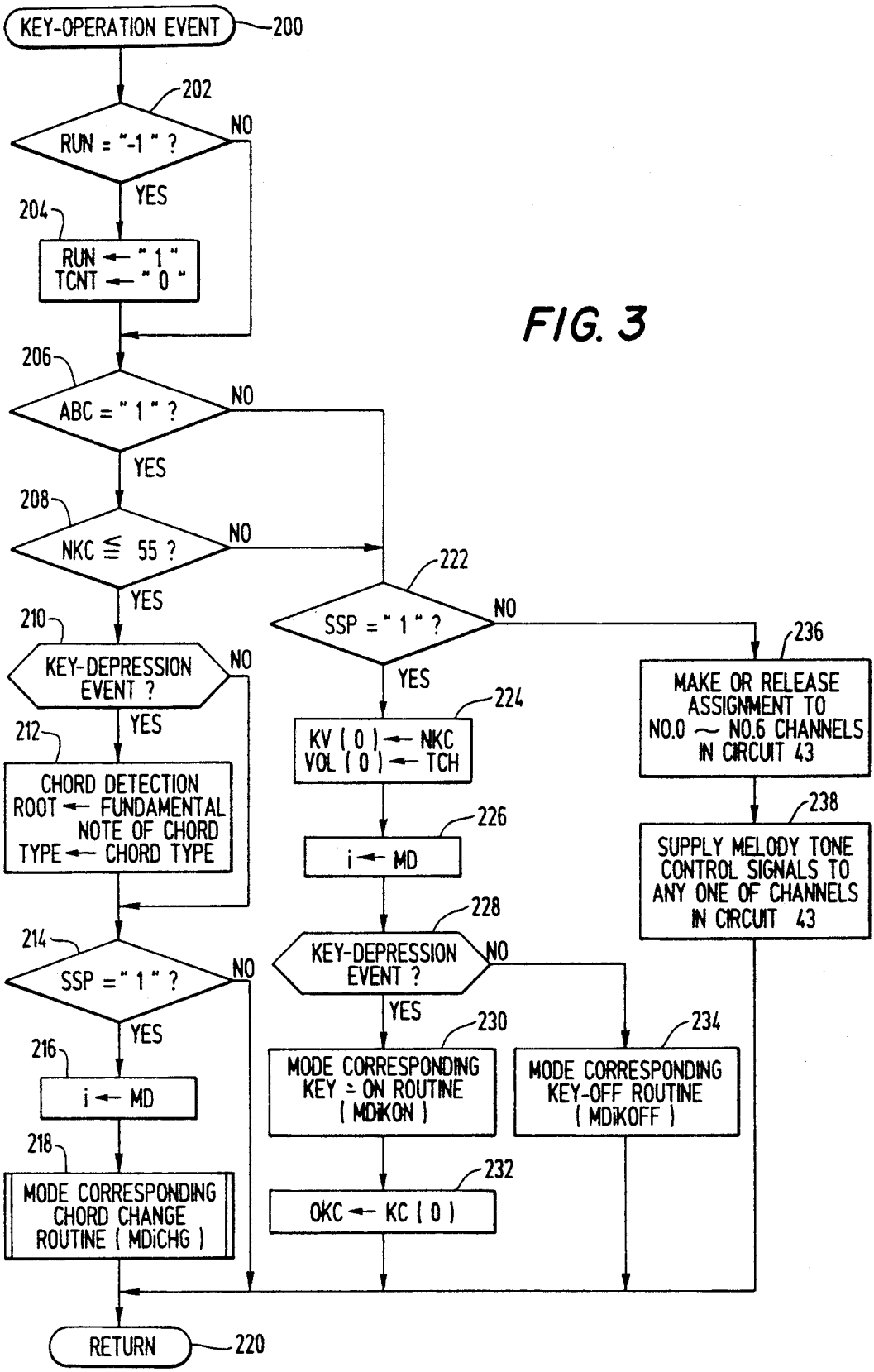
FIG. 3 is a flowchart of a key-operation event routine.

As described before, the key-operation event routine is to be executed in response to the key-operation which occurred in the keyboard 10 in step 188 of the main program. As shown in FIG. 3, the execution of this routine is started in step 200. In next step 202, it is judged whether or not the rhythm run flag RUN is at "1". When the automatic rhythm is in the standby state and the rhythm run flag RUN is at "−1", the judgement of step 202 turns to "YES". Then, the processing proceeds to step 204 wherein the rhythm run flag RUN is set at "1" indicating the operating state of the automatic rhythm and the tempo count data TCNT is initialized to "0". Thus, the automatic rhythm which has been in the standby state is started from its initial state (i.e., the automatic rhythm is performed from bar head). On the other hand, when the automatic rhythm is not in the standby state so that the rhythm run flag RUN is not set at "−1", the judgement of step 202 turns to "NO". Thereafter, the processing proceeds to step 206.

In step 206, it is judged whether or not the accompaniment flag ABC is at "1", in other words, it is judged whether or not the automatic accompaniment is in the operating state.

First, description will be given with respect to the operating state of the automatic accompaniment. In this case, the accompaniment flag ABC is set at "1", so that the judgement of step 206 turns to "YES". Then, the processing proceeds to step 208 wherein it is judged whether or not the new key code NKC indicating the newly operated key is equal to or less than "55". Herein, the whole key area of the keyboard 10 is divided into an accompaniment key area and a melody key area when operating the automatic accompaniment. The above-mentioned value "55" corresponds to the pitch G3, which is the highest pitch among the keys belonging to the accompaniment key area. If the new key code NKC belongs to the accompaniment key area, it is judged that NCK<55 is established, which turns the judgement of step 208 to "YES". Then, the processing proceeds to step 210 wherein based on the key-operation flag concerning the new key code NKC, it is judged whether or not the current key-operation event is the key-depression event.

When it is judged that the key-depression event has occurred, the judgement of step 210 turns to "YES". Then, the processing proceeds to step 212 wherein the chord is detected based on all of the currently depressed keys in the accompaniment key area of the keyboard 10. This chord detection is made by the known method which compares the combination of all depressed keys with the combination of all chord constituent notes stored in the chord constituent note table 81. Then, the root of the detected chord is stored as the root data ROOT, while the detected chord type is stored as the type data TYPE. If the key-operation event is not the key-depression event, the judegment of step 210 turns to "NO" so that the process of step 212 is omitted. Thus, the chord is detected and its data are stored every time the key-depression event occurs in the accompaniment key area of the keyboard 10.

After detecting the chord, it is judged whether or not the solo style play flag SSP is at "1" in step 214. When the solo style play is selected so that the flag SSP is set at "1", the judgement of step 214 turns to "YES" so that the processing proceeds to step 216. In step 216, a variable i is set as the mode data MD indicative of several modes for the solo style play. In the next step 218, the CPU 62 reads out and then executes processes of a mode corresponding chord change routine MDiCHG. Thereafter, the processing of this key-operation event routine is terminated in step 220. Incidentally, detailed description will given later with respect to the mode corresponding chord change routine MDiCHG. Meanwhile, when the solo style play flag SSP is at "0" indicating that the solo style play is not selected, the judgement of step 214 turns to "NO" so that the processing of the key-operation event routine is terminated in step 220.

In the case where the new key code NKC is larger than "55" indicating that the newly depressed key belongs to the melody key area, the judgement of the foregoing step 208 turns to "N3" (i.e., NKC>55 is detected). In this case, the processing proceeds to step 222 wherein it is judged whether or not the solo style play flag SSP is at "1". When this flag SSP is set at "1" indicating that the solo style play is selected, the judgement of step 222 turns to "YES". Then, the processing proceeds to step 224 wherein No.0 key code KC(0) is set equal to the new key code NKC, the key-touch data TCH concerning the new key code NKC is fetched from the touch detecting circuit 10*b* and then the fetched TCH is set as No.0 tone volume data VOL(0).

After the variable i is set equal to the mode data MD in step 224, it is judged whether or not the key-operation event is the key-depression event of the keyboard 10 in step 228. If so, the judgement of step 228 turns to "YES" and the processing proceeds to step 230 wherein processes of a mode corresponding key-on routine MDiKON are fetched and then executed. In step 232, No.0 key code KC(0) is set and stored as an old key code OKC. Then, the execution of the key-operation event routine is terminated in step 220.

On the other hand, if the key-operation event is the key-release event, the judgement of step 228 turns to "NO" so that the processing proceeds to step 234 wherein processes of a mode corresponding key-off routine MDiKOF designated by the variable i are fetched and then executed. Thereafter the execution of the key-operation event routine is terminated. Incidentally, detailed description will be given later with respect to the above-mentioned mode corresponding key-on routine MDiKON and mode corresponding key-off routine MDiKOF.

Meanwhile, when the solo style play flag SSP is set at "0" indicating that the solo style play is not selected, the judgement of the foregoing step 222 turns to "NO" so that processes of steps 236, 238 are to be executed. These processes of steps 236, 238 are known. In step 236, the tone-generation assignment concerning the newly depressed key of the keyboard 10 (indicated by new key code NKC) is made to No.0 to No.6 channels of the melody tone signal generating circuit 43, or tone-generation assignment concerning the newly released key (indicated by the new key code NKC) is released. In step 238, several melody tone control signals such as No.0 to No.6 key codes KC(0)-KC(6), No.0 to No.6 tone color data TC(0)-TC(6), No.0 to No.6 tone volume data VOL(0)-VOL(6) (which are formed by the touch data TCH), key-on signal KON and key-off signal KOF are supplied to any one of No.0 to No.6 channels of the melody tone signal generating circuit 43. In response to such melody tone control signals, the musical tone signal is generated from each channel of the melody tone signal generating circuit 43. This musical tone signal is supplied to the speakers 45*a*–45*c* via the output circuit 44, so that these speakers will generate the musical tone corresponding to the performance carried out on the melody key area of the keyboard 10.

Next, description will be given with respect to the case where the accompaniment flag ABC is set at "0" indicating that the automatic accompaniment is not operated. In this case, the judgement of step 206 turns to "NO", so that the processes of step 222 etc. will be executed. These processes in the non-operating state of the automatic accompaniment are identical to those in the operating state of the automatic accompaniment described before, hence, description thereof will be omitted. However, one difference in this case is that all keys are used for the melody performance and consequently the chord is not detected.

(3) Clock Interrupt Program

Figure 4:
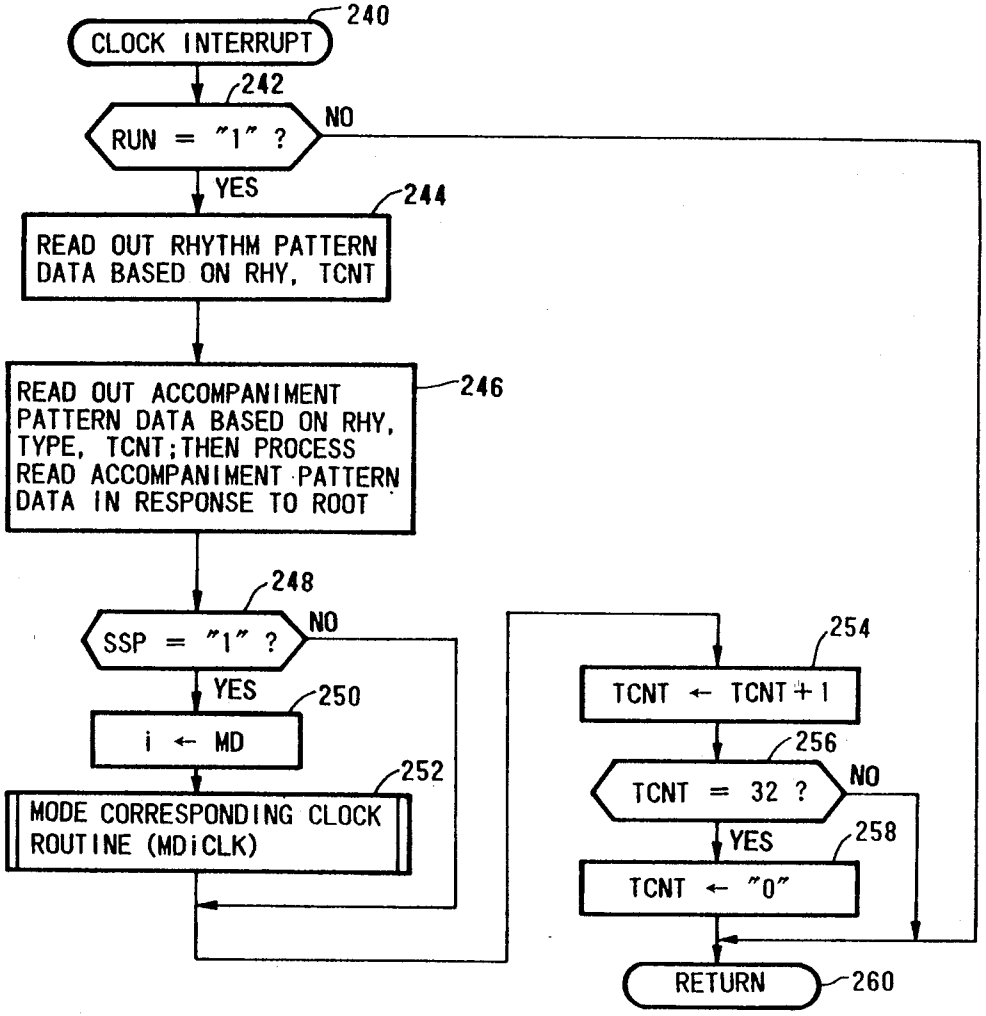
FIG. 4 is a flowchart of a clock interrupt routine.

The clock interrupt program is executed in synchronism with the timing when the CPU 62 receives the tempo clock signal TCLK (corresponding to a thirty-second note) from the tempo oscillator 50. As shown in FIG. 4, the execution of this clock interrupt program is started in step 240. In step 242, it is judged whether or not the rhythm run flag RUN is at "1".

When the rhythm run flag RUN is at "0" indicating the non-operating state of the automatic rhythm, the judgement of step 242 turns to "NO" so that the execution of the clock interrupt program is terminated in step 260.

On the other hand, when the rhythm run flag RUN is at "1" indicating the operating state of the automatic rhythm, the judgement of step 242 turns to "YES" so that the processing proceeds to step 244 wherein the rhythm pattern data designated by the rhythm kind data RHY and tempo count data TCNT is read from the rhythm pattern memory 82 and then the read rhythm pattern data is supplied to the rhythm tone signal generating circuit 41. In response to the rhythm pattern data, the rhythm tone signal generating circuit 41 forms and then outputs the percussive tone signal to the speakers 45*a*–45*c* via the output circuit 44. Thus, the speakers 45*a*–45*c* generate the musical tone corresponding to the percussive tone signal. As a result, the automatic rhythm performance will be carried out in response to the rhythm kind designated by the rhythm kind data RHY.

In step 246, the accompaniment pattern data designated by the rhythm kind data RHY, tempo count data TCNT and type data TYPE is read from the accompaniment pattern memory 83. The read accompaniment pattern data is processed in response to the root data ROOT, and then the processed data is supplied to the accompaniment tone signal generating circuit 42, from which the corresponding accompaniment tone signal is generated. This accompaniment tone signal is supplied to the speakers 45*a*–45*c* via the output circuit 44, so that the speakers will generate the musical tone corresponding to the accompaniment tone signal. As a result, the automatic accompaniment performance is carried out in response to the rhythm kind designated by the rhythm kind data RHY and the chords designated by playing the keyboard 10.

After executing the above-mentioned process of step 246, the processing proceeds to step 248 wherein it is judged whether or not the solo style play flag SSP is at "1". If this flag SSP is at "1" indicating that the solo style play is selected, the judgement of step 248 turns to "YES" so that the variable i is set equal to the mode data MD in step 250. In step 252, under designation of the variable i, a mode corresponding clock routine MDiCLK is read out and then its processes are executed. Thereafter, the processing proceeds to step 254. Incidentally, the processes of the mode corresponding clock routine MDiCLK will be described later in detail. On the other hand, if the solo style play flag SSP is set at "0" indicating that the solo style play is not selected, the judgement of step 248 turns to "NO" so that the processing directly proceeds to step 254 without executing the above-mentioned processes of steps 250, 252.

In step 254, the tempo count data TCNT is incremented by adding "1" thereto. Then, it is judged whether or not the incremented tempo count data TCNT reaches "32" in step 256. When the data TCNT does not reach "32", the judgement of step 256 turns to "NO", so that the processing proceeds to step 260 wherein the execution of the clock interrupt program is terminated. When the data TCNT reaches "32", the judgement of step 256 turns to "YES" so that the processing proceeds to step 258 wherein the data TCNT is initialized to "0". Then, the execution of the clock interrupt program is terminated in step 260. Due to the above-mentioned processes of steps 254 to 258, the tempo count data TCNT is incremented from "0" to "31" every time the tempo clock signal TCLK is generated.

(4) Solo Style Play

Hereinafter, detailed description will be given with respect to generation of the additional tones in each mode of the solo style play. Before that, we want to make sure the matters closely relating to the operation of this solo style play mode as below.

The mode corresponding key-on routine MDiKON and mode corresponding key-off routine MDiKOF described before are executed in the foregoing steps 230, 234 in the key-operation event routine shown in FIG. 3. Under the condition where the solo style play flag SSP is at "1" and any one of the keys of the keyboard 10 is operated in order to play the melody performance, the programs of these routines are to be read out in response to the mode data MD(=i). Under process of step 224, No.0 key code KC(O) and No.0 tone volume data VOL(0) for No.0 musical tone signal generating channel are set by every key-depression event. In each solo style play mode, the melody performance of the keyboard 10 is carried out based on a specific latter-tone-first-generation-priority in which the single tone designated latter is generated first.

The mode corresponding chord change routine MDiCHG is to be executed in step 218 of the key-operation event routine. In the case where the automatic performance is in the operating state, solo style play flag SSP is at "1" and any one of keys of the keyboard 10 is operated in order to play the chord performance, this routine is executed in response to the mode data MD(=i). Under the process of step 212, the root data ROOT and type data TYPE indicating the designated chord are set in response to the key-depression for designating the chord.

The mode corresponding clock routine MDiCLK is executed in step 252 of the clock interrupt program shown in FIG. 4. More specifically, in the case where the automatic rhythm is operating and the solo style play flag SSP is at "1", this routine is executed every time the tempo clock signal TCLK (corresponding to thirty-second note) is generated.

Figure 2B:
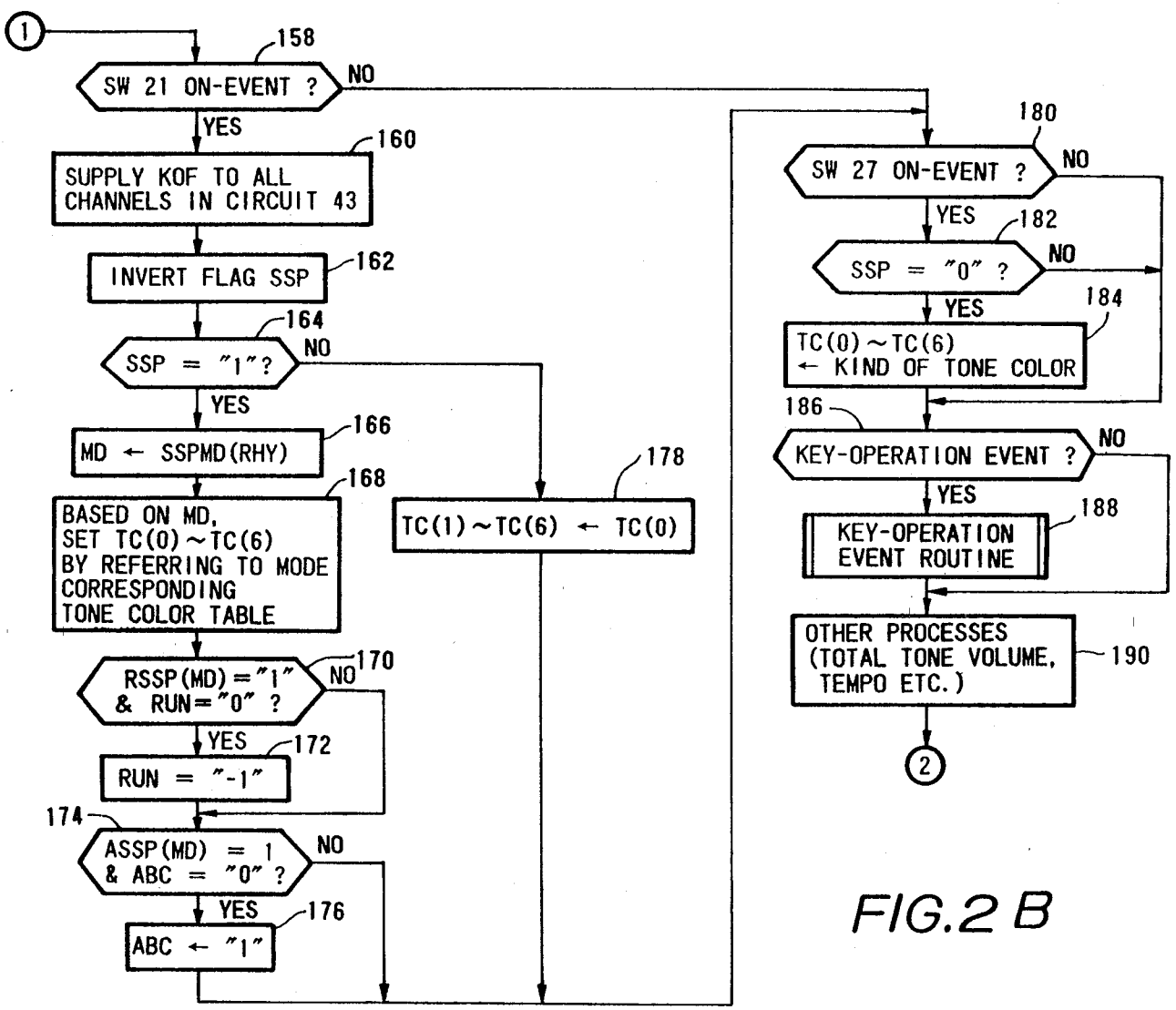

In the case where the solo style play flag SSP is set at "1", under the foregoing processes of steps 146, 148, 166, 168 in the main program shown in FIGS. 2A, 2B, No.0 to No.6 tone color data TC(0)–TC(6) are set by each of the solo style play modes (which is determined in response to the rhythm kind). In addition, due to the processes of steps 150–156, 170–176, this mode is set as the rhythm dependence mode. In case of the accompaniment dependence mode, the automatic rhythm and automatic accompaniment are compulsorily set in the operating state. Consequently, due to the processes of steps 150–156, 170–176, the rhythm run flag RUN is set at "−1" and accompaniment flag ABC is set at "1". Herein, detailed description will be given later with respect to the manner of setting data such as the rhythm kind, No.0 to No.6 tone color data TC(0)–TC(6), rhythm run flag RUN and accompaniment flag ABC by each solo style play mode.

(a) First Solo Style Play Mode

The first solo style play mode (i.e., MD=1) is the mode wherein depending on the pitch of the melody tone, the manner of generating the additional tone is changed. This mode is designated when "Hard Rock" is designated as the rhythm kind, so that the accompaniment flag ABC is set at "1". In this mode, No.0 to No.2 musical tone signal generating channels are used to generate the key-depression tone and additional tone to be designated by performing the keyboard 10. The tone color data TC(0)–TC(2) are set equal to the values indicating the specific tone colors used for the rock guitar.

Figure 5A:
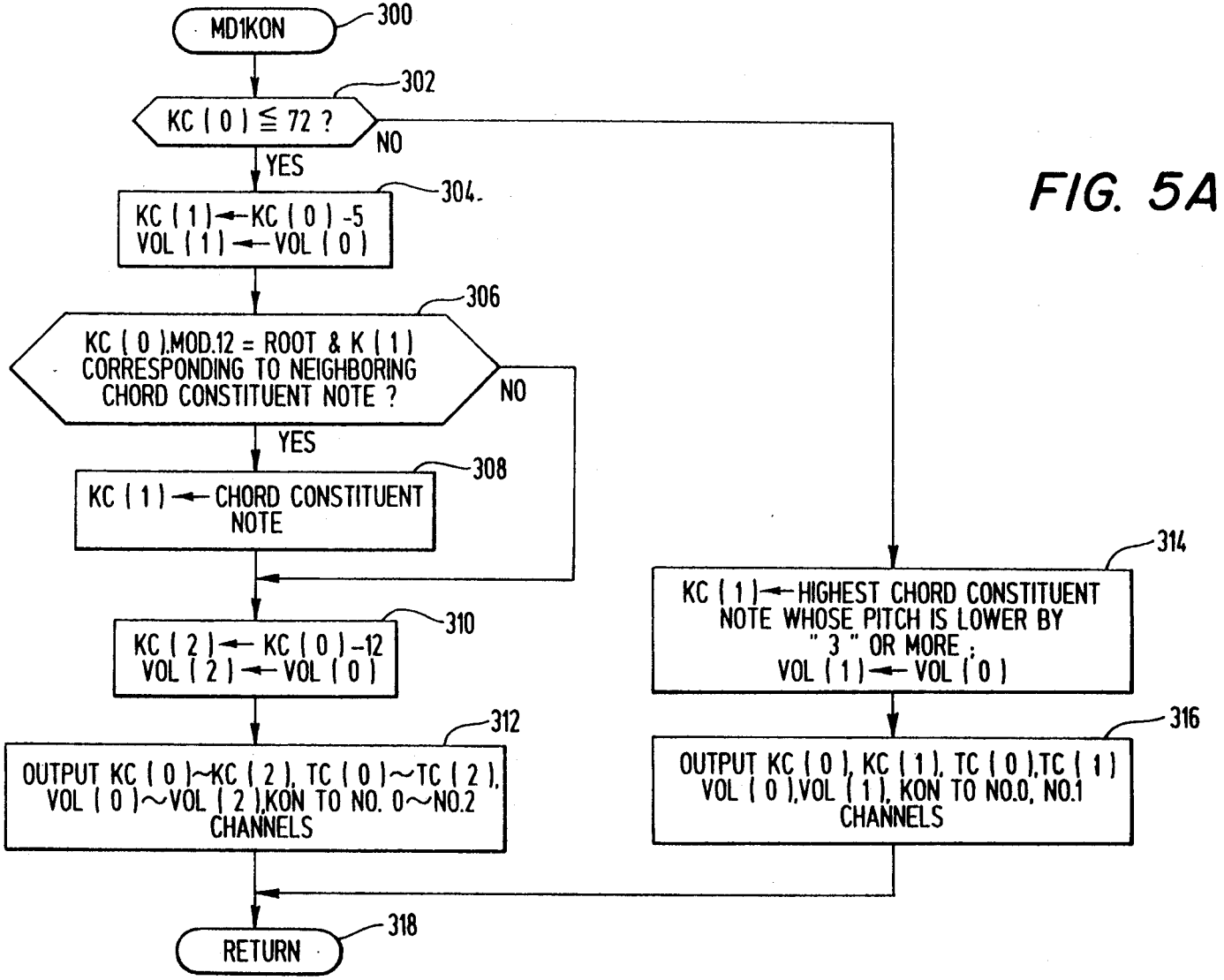
FIGS. 5A–5D are flowcharts showing sub-programs used in 1st solo style play mode.

When the mode corresponding key-on routine MD1KON is read out in response to the melody performance of the keyboard 10 in step 230 of the key-operation event routine shown in FIG. 3, execution thereof is started from step 300 shown in FIG. 5A. In step 302, it is judged whether or not No.0 key code KC(0) is equal to or lower less than the value "72" indicative of the pitch C5.

In the case where the key whose pitch is lower than C5 is depressed for the melody performance so that No.0 key code KC(0) is equal to or less than "72", the judgement of step 302 turns to "YES" so that the processing proceeds to step 304. In step 304, No.1 key code KC(1) indicative of the pitch of first additional tone is set equal to "KC(0)−5" indicating the pitch which is 4 degrees lower than the pitch of the depressed melody key. In addition, No.1 tone volume data VOL(1) indicative of the tone volume of the first additional tone is set equal to No.0 tone volume data VOL(0).

Next, in step 306, it is judged whether or not the note name of No.0 key code KC(0) is identical to the root of the performed chord by comparing the result of logical operation "KC(0) .MOD.12" with the root data ROOT. In this case, based on the root data ROOT, the result obtained by referring to the chord constituent note table 81 based on the type data is converted into chord constituent notes. Then, each of the chord constituent notes is compared to No.1 key code KC(1), by which it is further judged in step 306 whether or not No.1 key code KC(1) indicates the note neighboring each chord constituent note (hereinafter, simply referred to neighboring chord constituent note). If the above-mentioned judgement is affirmative, the judgement of step 306 turns to "YES" so that the processing proceeds to step 308. In step 308, No.1 key code KC(1) is converted into another key code value KC indicating the above-mentioned neighboring chord constituent note. If not, the judgement of step 306 turns to "NO" so that the process of step 308 is omitted, by which No.1 key code KC(1) is maintained as it was.

Due to the above-mentioned processes of steps 306, 308, the characteristic of the performed chord is not broken, and consequently the first additional tone harmonizes with the performed chord. For example, if the performed melody tone is C note and the processes of steps 306, 308 are omitted, the additional tone should be G note. However, in the case where the performed chord is diminished C or augmented C, the characteristic of such diminished C or augmented C should be broken due to G note. In this case, the characteristic note of diminished C or augmented C is F# note or G# note, which does not harmonize with the above-mentioned G note. Herein, G note as the first additional tone is converted into F# note or G# note due to the processes of steps 306, 308, which avoids occurrence of the above-mentioned disharmony.

After executing the processes of steps 306, 308 described above, the processing proceeds to step 310 wherein No.2 key code KC(2) indicative of the pitch of the second additional tone is set identical to key code "KC(0)−12" indicating the pitch which is one octave lower than that of the depressed melody key. In addition, No.2 tone volume data VOL(2) indicative of the tone volume of the second additional tone is set identical to No.0 tone volume data VOL(0). Then, in step 312, No.0–No.2 key codes KC(0)–KC(2), No.0–No.2 tone color data TC(0)–TC(2), No.0–No.2 tone volume data VOL(0)–VOL(2) and key-on signals KON are respectively supplied to No.0–No.2 channels of the melody tone signal generating circuit 43. Thereafter, execution of this mode corresponding key-on routine MD1KON is terminated in step 318.

In response to the receipt of the key-on signals, No.0–No.2 channels of the melody tone signal generating circuit 43 start to generate three musical tone signals, which are respectively supplied to the output lines L, C, R at the same rate. In this case, the pitches of the musical tone signals are controlled by No.0–No.2 key codes KC(0)–KC(2), so that they are respectively set to the pitch of the performed melody key, pitches of the first and second additional tones. The tone colors are controlled by No.0–No.2 tone color data TC(0)–TC(2), so that they are set as the specific tone color of rock guitar. Further, the tone volumes are controlled by No.0–No.2 tone volume data VOL(0)–VOL(2), so that they are set corresponding to the key touch (indicated by the touch data TCH) of the performed melody key.

The musical tone signals transmitted on the output lines L, C, R of the melody tone signal generating circuit 43 are respectively supplied to the speakers 45*a*–45*c*, which simultaneously generate the performed melody tone, first and second additional tones having the same tone color of rock guitar and the same tone volume.

Meanwhile, in the case where the performer depresses the key whose pitch is higher than pitch C5 in the keyboard 10 and No.0 key code KC(0) indicative the depressed key is greater than "72", the judgement of step 302 turns to "No" so that the processing proceeds to step 314. In step 314, a desirable one of the chord constituent notes is selected, wherein it is the highest note whose pitch is lower than that of the performed melody key by three semitones or more among the chord constituent notes. Then, the key code of the selected note is set identical to No.1 key code KC(1) indicative of the pitch of the first additional tone. Herein, based on the root data ROOT, the result obtained by referring to the chord constituent note table 81 based on the type data TYPE is converted into each of the chord constituent notes. Thus, among these chord constituent notes, a desirable one of them is selected, wherein the pitch thereof is lower than No.0 key code KC(0) by three semitones or more but it is the closest to KC(0). Then, the key code of the selected note is set as No.1 key code KC(1). In addition, in step 314, No.1 tone volume data VOL(1) is set equal to No.0 tone volume data VOL(0).

Next, a process similar to that of the foregoing step 312 is executed in step 316. More specifically, No.0–No.1 key codes KC(0)–KC(1), No.0–No.1 tone color data TC(0)–TC(1), No.0–No.1 tone volume data VOL(0)–VOL(1) and key-on signals KON are respectively supplied to No.0–No.1 channels of the melody tone signal generating circuit 43. Thereafter, the processing proceeds to step 318 wherein execution of the mode corresponding key-on routine MD1KON is terminated.

As described before, according to the receipt of the key-on signals KON, No.0–No.1 channels of the melody tone signal generating circuit 43 start to generate respective two musical tone signals, which are to be mixed together. Then, the mixed musical tone signal is outputted to the output lines L, C, R at the same rate. In this case, the pitches of these two musical tone signals are controlled by No.0–No.1 key codes KC(0)–KC(1), so that they are set at respective pitches of the performed melody key and first additional tone. The tone colors are controlled by No.0–No.1 tone color data TC(0)–TC(1), so that they are set as the tone color of rock guitar. Further, the tone volumes are controlled by No.0–No.1 tone volume data VOL(0)–VOL(1), so that they are set to correspond to the key touch (indicated by the touch data TCH) of the performed melody key. Thereafter, the musical tone signals are supplied to the speakers 45*a*–45*c* via the output circuit 44, so that the speakers 45*a*–45*c* simultaneously generate the performed melody tone and first additional tone both of which have the same tone color of rock guitar and same tone volume.

Figure 5B:
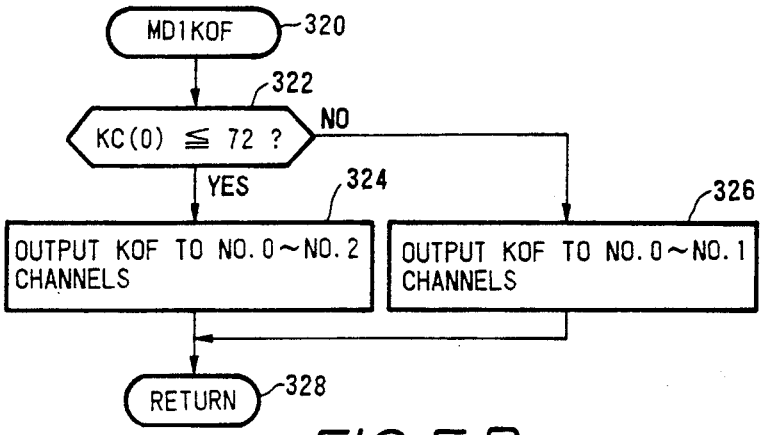

Next, when the depressed melody key is released, the mode corresponding key-off routine MD1KOF is read out in response to the key-release event in step 234 of the key-operation event routine. This routine MD1KOF is started from step 320 shown in FIG. 5B. In step 322, it is judged whether or not No.0 key code KC(0) indicative of the released key is equal to or less than "72" indicating the pitch C5. When the pitch of the released key is lower than the pitch C5 so that No.0 key code KC(0) is less than "72", the judgement of step 322 turns to "YES" so that the processing proceeds to step 324 wherein the key-off signal KOF is outputted to No.0–No.2 channels of the melody tone signal generating circuit 43. Then, execution of the mode corresponding key-off routine MD1KOF is terminated in step 328. As a result, generation of the performed melody tone signal, first and second additional tone signals is terminated. Thus, the speakers 45*a*–45*c* stop generating the musical tones corresponding to the above-mentioned signals supplied thereto.

On the other hand, when the pitch of the released key is higher than the pitch C5 so that No.0 key code KC(0) is greater than "72", the judgement of step 322 turns to "NO" and consequently the processing proceeds to step 326. In step 326, the key-off signal KOF is supplied to No.0–No.1 channels of the melody tone signal generating circuit 43. In this case, the musical tone signals formed in the melody tone signal generating circuit 43 include the performed melody tone and first additional tone. Thus, as described before, generation of the melody tone (including the first additional tone) is terminated.

Figure 5D:
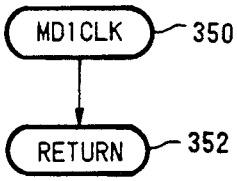
Figure 5C:
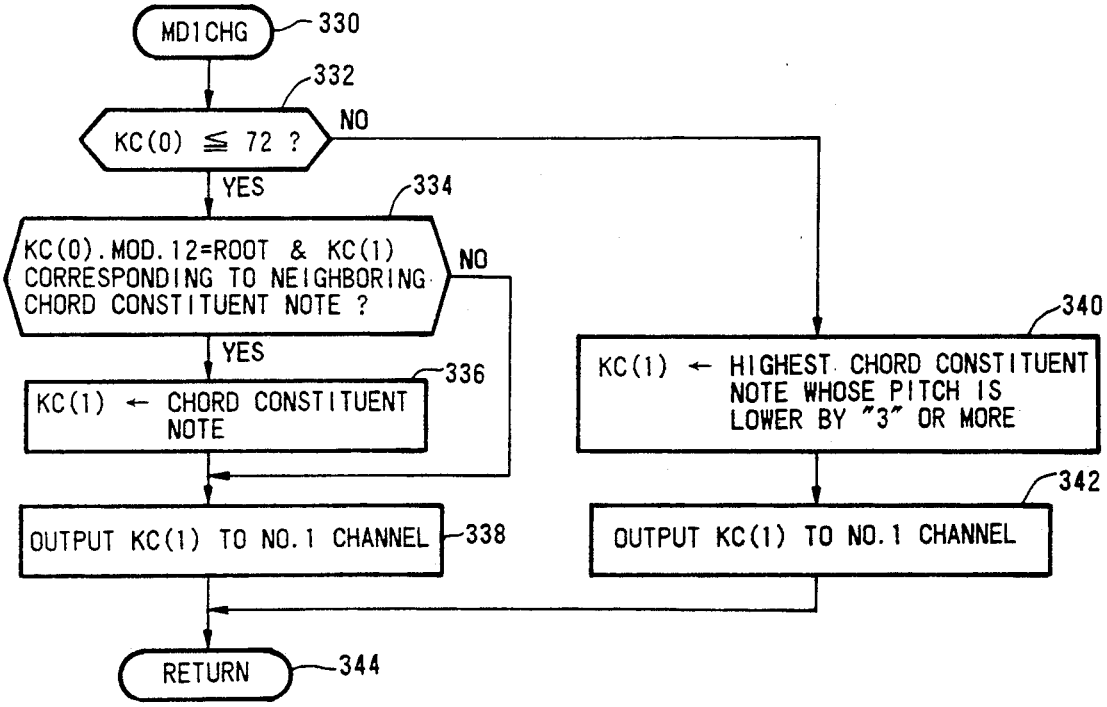

When the mode corresponding chord change routine MD1CHG is read out in response to the key-depressions for chord in the keyboard 10 in step 218 of the foregoing key-operation event routine shown in FIG. 3, execution of the read routine MD1CHG is started in step 330 shown in FIG. 5C. In step 332, it is judged whether or not No.0 key code KC(0) is equal to or lower than "72" indicative of the pitch C5.

If so, the judgement of step 332 turns to "YES" so that processes of steps 334, 336 similar to those of foregoing steps 306, 308 are to be executed. More specifically, in the case where the note name of No.0 key code KC(0) indicative of the performed melody tone is identical to that of the root of the performed chord and No.1 key code KC(1) indicative of the first additional tone designates the neighboring note of the chord constituent notes within the performed chord, No.1 key code KC(1) is changed to the key code indicative of such neighboring chord constituent note. Then, in step 338, changed No.1 key code KC(1) is supplied to No.1 channel of the melody tone signal generating circuit 43. As a result, in this No.1 channel, only the pitch of the generating musical tone signal is changed to the pitch corresponding to No.1 key code KC(1), so that the first additional tone is continuously generated but its pitch is changed.

If No.0 key code KC(0) indicative of the performed melody key is larger than "72", the judgement of step 332 turns to "NO" so that the processing proceeds to step 340 wherein the process similar to that of the foregoing step 314 is executed. More specifically, in step 340, No.1 key code KC(1) indicative of the first additional tone is changed to the key code indicating the highest chord constituent note whose pitch is lower than No.1 key code KC(1) of the performed melody key by 3 semitones or more. In next step 342, the process similar to that of the foregoing step 338 is executed, so that the pitch of the generating first additional tone is changed. As a result, in the case where the chord is changed while depressing the melody key, the first additional tone which is set in relation to the chord designated by performing the keyboard 10 in the foregoing steps 306, 314 is changed in accordance with the chord change.

After executing the above-mentioned processes of steps 338, 342, execution of the mode corresponding chord change routine MD1CHG is completed in step 344. Meanwhile, when the mode corresponding clock routine MD1CLK is read out in step 252 of the clock interrupt program shown in FIG. 4, execution of this routine MD1CLK is started in step 350 shown in FIG. 5D. However, in next step 352, execution of this routine MD1CLK is completed. Thus, no substantial process is executed in this routine MD1CLK.

As is apparent from the above description, if the pitch of the performed melody key (i.e., melody pitch) is lower than the pitch C5 in the first solo style play mode, two additional tones are added to the melody tone, by which the varied musical performance can be obtained. On the other hand, if the pitch of the performed melody key is higher than the pitch C5, only one additional tone is added to the melody tone. In this case, the varied musical performance can be obtained, and noisiness due to the generation of many high-pitch-tones can be eliminated because the number of additional tones is controlled to only one.

As described above, in the first solo style play mode, the additional tones to be generated are changed between upper key area and lower key area which are obtained by dividing the whole key area at the pitch C5 (which is set as the boundary key between these two key areas). However, it is possible to change such boundary key for dividing the whole key area into upper and lower key areas such that the generating manner of the additional tones is changed between these two key areas. In addition, it is also possible to set two or more boundary keys. In such case, the whole key area can be divided into lower, middle and upper key areas, for example. Then, the number of additional tones to be added to the melody tone can be set at "3" in lower key area, "2" in middle key area and "1" in upper key area.

Instead of changing the number of additional tones, it is possible to change the tone volume of the additional tone. For example, as the key area becomes upper, the tone volume of the additional tone is controlled to be lower. Such tone volume control can eliminate the hearing problem due to the generation of many high-pitch-tones. Further, it is also possible to change the tone color by each key area.

(b) Second Solo Style Play Mode

Figure 6A:
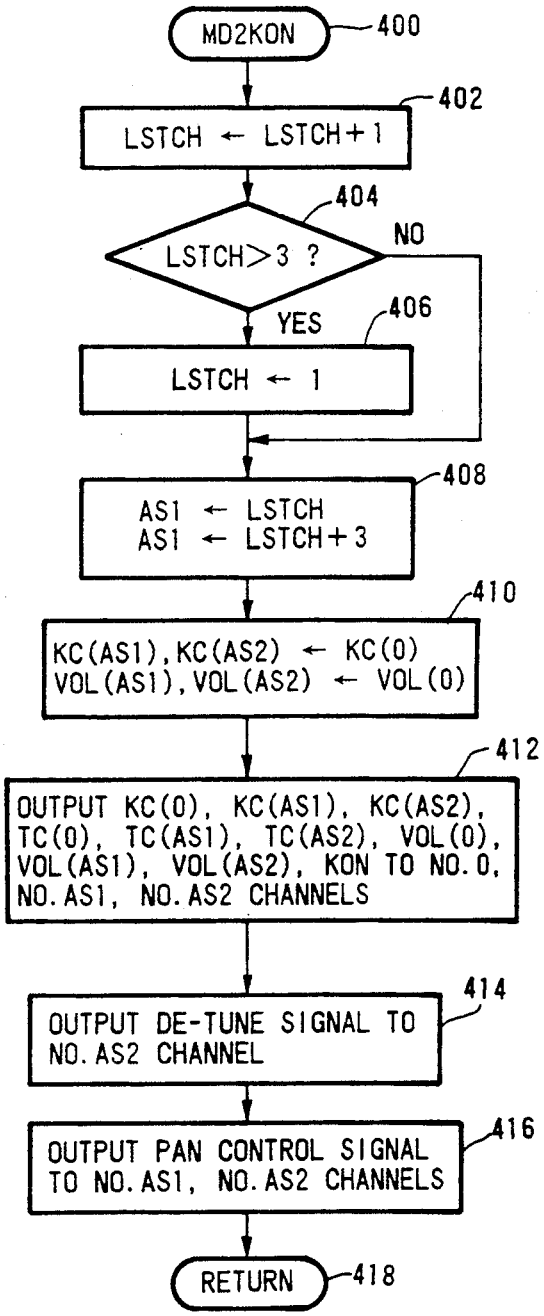
FIGS. 6A–6D are flowcharts showing sub-programs used in 2nd solo style play mode.

In the second solo style play mode (MD=2), the same tone is repeatedly generated as the additional tone every time the melody key is depressed. Even if the melody key is released, this mode continues to generate the additional tone which is identical to the chord constituent note of the performed chord. For example, the rhythm kind is designated when performing the "lullaby", but the accompaniment flag ABC is set at "1" at the same time. In this mode, No.0–No.6 musical tone signal generating channels are used to generate the musical tone of the depressed key and the additional tone. In addition, No.0 tone color data TC(0) concerning No.0 channel is set for a toy piano, while No.1–No.6 tone color data TC(1)–TC(6) concerning No.1–No.6 channels are set as the tone color of human voice chorus. In response to the key-depression of the melody key in the keyboard 10, the mode corresponding key-on routine MD2KON is read out in step 230 of the foregoing key-operation event routine. The execution of this routine MD2KON is started in step 400 shown in FIG. 6A. Then, under processes of steps 402 to 406, last channel data LSTCH indicative of the channel (No.1–No.3) from which the preceding additional tone is generated is changed from "1" to "3" by every execution period of the routine MD2KON, i.e., by every key-on timing of the melody key.

Next, in step 408, last channel data LSTCH, LSTCH+3 are respectively set as first and second assignment channel data AS1, AS2. Herein, key codes KC(AS1), KC(AS2) indicate respective pitches of the additional tones designated by the data AS1, AS2, while tone volume data VOL(AS1), VOL(AS2) indicate respective tone volumes of the additional tones designated by the data AS1, AS2 (hereinafter, these additional tones will be simply referred to as No.AS1, No.AS2 additional tones). In step 410, the key codes KC(AS1), KC(AS2) are set identical to No.0 key code KC(0), and the tone volume data VOL(AS1), VOL(AS2) are set identical to No.0 tone volume data VOL(0). In step 412, the key codes KC(0), KC(AS1), KC(AS2), tone color data TC(0), TC(AS1), TC(AS2), tone volume data VOL(0), VOL(AS1), VOL(AS2) and key-on signals KON respectively corresponding to the performed melody tone, No.AS1 additional tone and No.AS2 additional tone are respectively supplied to No.0, No.AS1, No.AS2 channels of the melody tone signal generating circuit 43. Then, the de-tune signal is supplied to No.AS2 channel in step 414, and the pan control signal is supplied to No.AS1, No.AS2 channels in step 416. Thereafter, execution of this mode corresponding key-on routine MD2KON is completed in step 418. Herein, the pan control signal is used to select one or some of the speakers 45*a*–45*c* from which the musical tone is generated in each of No.1–No.6 channels as shown in Table described below. In this Table, letters L, C, R correspond to respective speakers 45*a*–45*c*.

TABLE

| LSTCH | 1 | 2 | 3 | 4 | 5 | 6 |
|---|---|---|---|---|---|---|
| Speaker | R | R + C | C | C | C + L | L |

In response to the key-on signal KON, each of No.0, No.AS1, No.AS2 channels of the melody tone signal generating circuit 43 starts to generate the musical tone signal, so that total three musical tone signals are respectively outputted to the output lines L, C, R. In this case, the pitch of the musical tone signal generated in No.0 channel is controlled by No.0 key code KC(0) so that it is set identical to the pitch of the performed melody key, while the tone color thereof is controlled by No.0 tone color data TC(0) so that it is set corresponding to the tone color of the toy piano. Then, generated three musical tone signals are equally outputted to the output lines L, C, R. In addition, the pitch of the musical tone signal generated in No.AS1 channel is controlled by No.AS1 key code KC(AS1) (=KC(0)) so that it is set identical to the pitch of the performed melody key, while the tone color thereof is controlled by No.AS1 tone color data TC(AS1) so that it is set corresponding to the tone color of the human voice chorus. Then, the generated musical tone is outputted to one or some of the output lines L, C, R corresponding to the data AS1 (see Table). Further, the pitch of the musical tone signal generated in No.AS2 channel is controlled by No.AS2 key code KC(AS2) (=KC(0)) and de-tune signal so that it is shifted up or down from the pitch of the performed melody key by some cents or some tens of cents, while the tone color thereof is controlled by No.AS2 tone color data TC(AS2) so that it is set corresponding to the tone color of the human voice chorus. Then, the generated musical tone signal is outputted to one or some of the output lines L, C, R corresponding to the data AS2 (see Table). Furthermore, the tone volumes of the generated musical tone signals are respectively controlled by No.0, No.AS1, No.AS2 tone volume data VOL(0), VOL(AS1), VOL(AS2) so that they are all set corresponding to the key touch (indicated by the touch data TCH) of the performed melody key.

Thereafter, the musical tones fed to the output lines L, C, R of the melody tone signal generating circuit 43 are supplied to the speakers 45*a*–45*c* via the output circuit 44. Thus, the speakers 45*a*–45*c* simultaneously generate the melody tone and No.AS1, No.AS2 additional tones, wherein the melody tone has the tone color of toy piano and the additional tones have the tone color corresponding to the human voice chorus. In this case, all of the generated tones have the same tone volume.

When a new melody-key-depression is occurred in the keyboard 10, under the foregoing processes of steps 400–418, the speakers 45*a*–45*c* respectively generate the melody tone, first and second additional tones. Due to the processes of steps 402–408, every time the new melody-key-depression is occurred, the first assignment channel data AS1 is incremented from "1" to "3", while the second assignment channel data AS2 is also incremented from "4" to "6". In response to such increment, the speaker for generating No.AS1 additional tone is changed from 45*c*(R) to 45*b*(C), while another speaker for generating No.AS2 additional tone is changed from 45*b*(C) to 45*a*(L). As a result, at every melody-key-depression, the phonic image based on No.AS1, No.AS2 additional tones is varied.

Figure 6B:
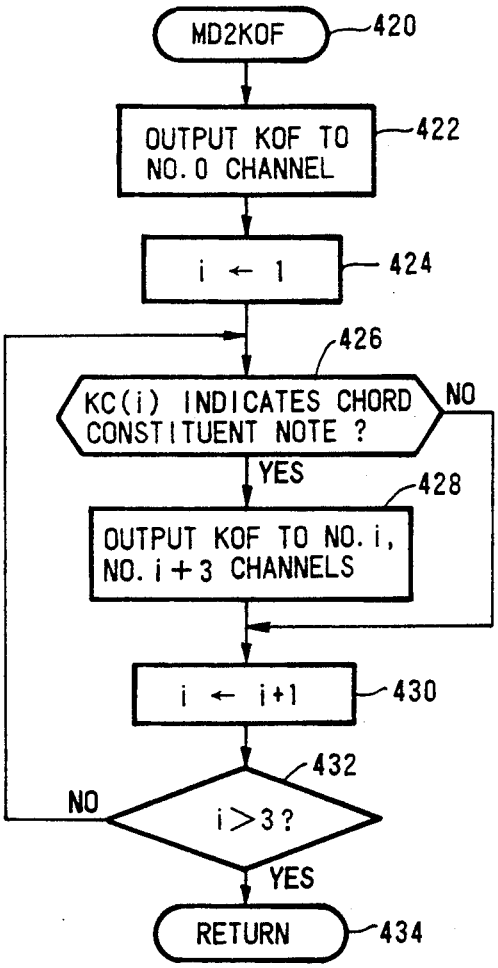

Next, when the depressed melody key is released, the mode corresponding key-off routine MD2KOF is read out in step 234 of the key-operation event routine shown in FIG. 3. The execution of this routine MD2KOF is started in step 420 shown in FIG. 6B. In step 422, the key-off signal KOF is supplied to No.0 channel of the melody tone signal generating channel 43. Thus, generation of the melody tone signal is stopped, which terminates the generation of the corresponding musical tones from the speakers 45*a*–45*c*.

After executing the above-mentioned process of step 422, while incrementing the variable i due to processes of steps 424, 430, 432, processes of steps 426, 428 are executed in response to the variable i. In step 426, the chord constituent notes read from the chord constituent note table 81 based on the type data TYPE are converted based on the root data ROOT, by which the desirable chord constituent notes are sequentially computed. Then, by comparing No.i key code KC(i) with the computed chord constituent note, it is judged whether or not the first additional tone corresponding to the key code KC(i) is the chord constituent note.

If not, the judgement of step 426 turns to "NO". Then, the processing proceeds to step 428 wherein the key-off signal KOF is supplied to both of No.i, No.(i+3) channels of the melody tone signal generating circuit 43. Thus, generation of No.i, No.(i+3) additional tone signals is stopped, which terminates the generation of the corresponding musical tones from the speakers 45*a*–45*c*. On the other hand, if No.i additional tone is the chord constituent note, the judgement of step 426 turns to "YES" so that the key-off process of step 428 is omitted. Then, the processing proceeds from step 426 to step 430 wherein the variable i is incremented. Thereafter, when the variable reaches "4", the judgement of step 432 turns to "YES" so that execution of the mode corresponding key-off routine MD2KOF is terminated. As a result, some of No.1–No.6 additional tones which are included in the chord constituent notes of the performed chord are only continuously generated, while generation of other additional tones is stopped by the melody-key-release event.

Figure 6C:
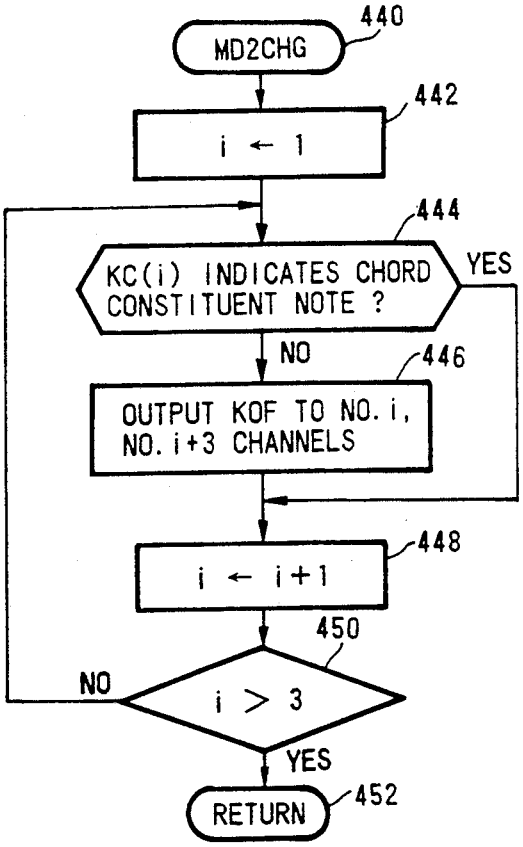

Meanwhile, when the mode corresponding chord change routine MD2CHG is read out in step 218 of the key-operation event routine shown in FIG. 3 in response to the chord-key-depression event occurred in the keyboard 10, this routine is started to be executed in step 440 shown in FIG. 6C. After executing its succeeding processes of steps 442–450, the execution of this routine MD2CHG is completed in step 452. These processes of steps 442–450 are similar to the foregoing processes of steps 424–432, hence, detailed description thereof will be omitted. In short, due to these processes, when the performed chord is changed even if the melody performance is maintained as it were, generation of only some of No.1–No.6 additional tones which are included in the chord constituent notes of the performed chord is continued, but generation of other additional tones is stopped.

Figure 6D:
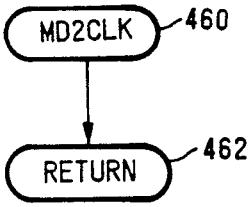

When the mode corresponding clock routine MD2CLK is read out in step 252 of the foregoing clock interrupt program shown in FIG. 4, execution thereof is started in step 460 shown in FIG. 6D. However, this routine is ended in next step 462, thus, no substantial processing is executed in this routine MD2CLK.

As is apparent from the above description, in the second solo style play mode, No.1–No.6 additional tones having the tone color of human voice chorus are continuously generated in addition to the melody tone generated in the tone color of toy piano. Thus, it is possible to apply the reverberation effect and back-chorus effect on the performed music, by which the varied music can be performed. In addition, under the detuning and pan control, the pitches and positions of the additional tones to be generated are controlled such that the back-chorus effect is emphasized. Herein, No.1–No.3 additional tones are generated at the positions which range from center position C to right position R, while No.4–No.6 additional tones are generated at the positions which range from center position C to left position L. At the same time, the phonic image of No.1–No.6 additional tones is varied so that the music can be performed with broader phonic image. Further, among No.1–No.6 additional tones, generation of the additional tones which are included in the chord constituent notes of the performed chord are only continued, so that the continuously generated additional tones can harmonize with the performed chord.

In the present embodiment, the melody tone is equally generated from all of the speakers 45*a*–45*c*. Instead, it is possible to generate the melody tone only from the center speaker 45*b*. In this case, it is possible to enlarge the tone volume of the melody tone as comparing to that of the additional tone.

Under the above-mentioned pan control, first phonic image of No.1–No.3 additional tones is moved from right R to center C, while second phonic image of No.-4–No.6 additional tones is moved from center C to left L. Instead, it is possible to employ another pan control, under which first phonic image is moved from center C to right R, while second phonic image is moved from left L to center C. Or, first phonic image can be moved from center C to right R, while second phonic image can be moved from center C to left L. Further, first phonic image can be moved from right R to center C, while second phonic image can be moved from left L to center C.

(c) Third Solo Style Play Mode

In the third solo style play mode (MD=3), as long as the melody key is depressed, generation of No.1–No.3 additional tones having the same pitch of the melody key is started or stopped by every predetermined period. In addition, their tone volumes are alternatively varied. This mode is designated when the rhythm kind designates "mandolin band", for example. At this time, the automatic rhythm is set in the standby state (where RUN="−1"). In this mode, No.0–No.3 channels are used for the melody performance and additional tones. The tone color data TC(0)-TC(3) concerning No.-0–No.3 channels are set at the value corresponding to the tone color of mandolin.

Figure 7A:
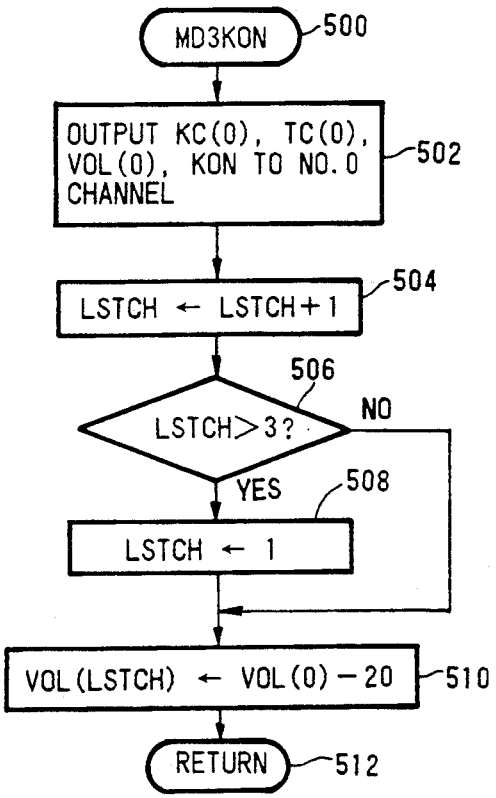
FIGS. 7A–7D are flowcharts showing sub-programs used in 3rd solo style play mode.

In response to the melody-key-on event occurred in the keyboard 10, the mode corresponding key-on routine MD3KON is read out in step 230 of the key-operation event routine shown in FIG. 3. The execution of this routine MD3KON is started in step 500 shown in FIG. 7A. In step 502, No.0 key code KC(0), No.0 tone color data TC(0), No.0 tone volume data VOL(0) and key-on signal KON are supplied to No.0 channel of the melody tone signal generating circuit 43.

When receiving the key-on signal KON, No.0 channel starts to form its musical tone signal, which is then equally outputted to the output lines L, C, R. In this case, the pitch of this musical tone signal is controlled by No.0 key code KC(0) so that it is set identical to the pitch of the performed melody key; the tone color thereof is controlled by No.0 tone color data TC(0) so that it is set identical to the tone color of mandolin; and the tone volume thereof is controlled by No.0 tone volume data VOL(0) so that it is set corresponding to the key touch (indicated by the touch data TCH) of the performed melody key. The musical tone signals fed to the output lines L, C, R of the melody tone signal generating circuit 43 are supplied to the speakers 45*a*–45*c* via the output circuit 44. Thus, the speakers 45*a*–45*c* generate the performed melody tone having the tone color of mandolin.

After executing the above-mentioned process of step 502, its succeeding processes of steps 504–508 are to be executed. More specifically, the last channel data LSTCH indicating the channel (number 1–3) from which the preceding additional tone is generated is varied from "1" to "3" every time the routine MD3KON is executed, i.e., every time the melody key is depressed. After the last channel data LSTCH is renewed as described above, the processing proceeds to step 510 wherein No.LSTCH tone volume data VOL(0) is set equal to "VOL(0)−20" which is 20 dB lower than No.0 tone volume data VOL(0) concerning the performed melody tone. In next step 512, execution of the mode corresponding key-on routine MD3KON is completed.

Figure 7C:
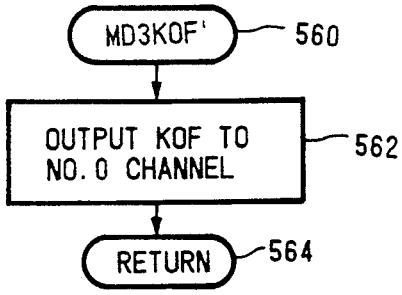
Figure 7D:
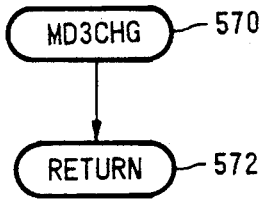
Figure 7E:
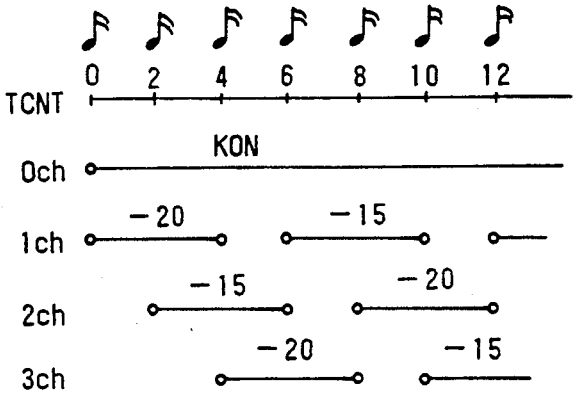
FIG. 7E shows a tone-generation pattern of additional tones in 3rd solo style play mode.
Figure 7B:
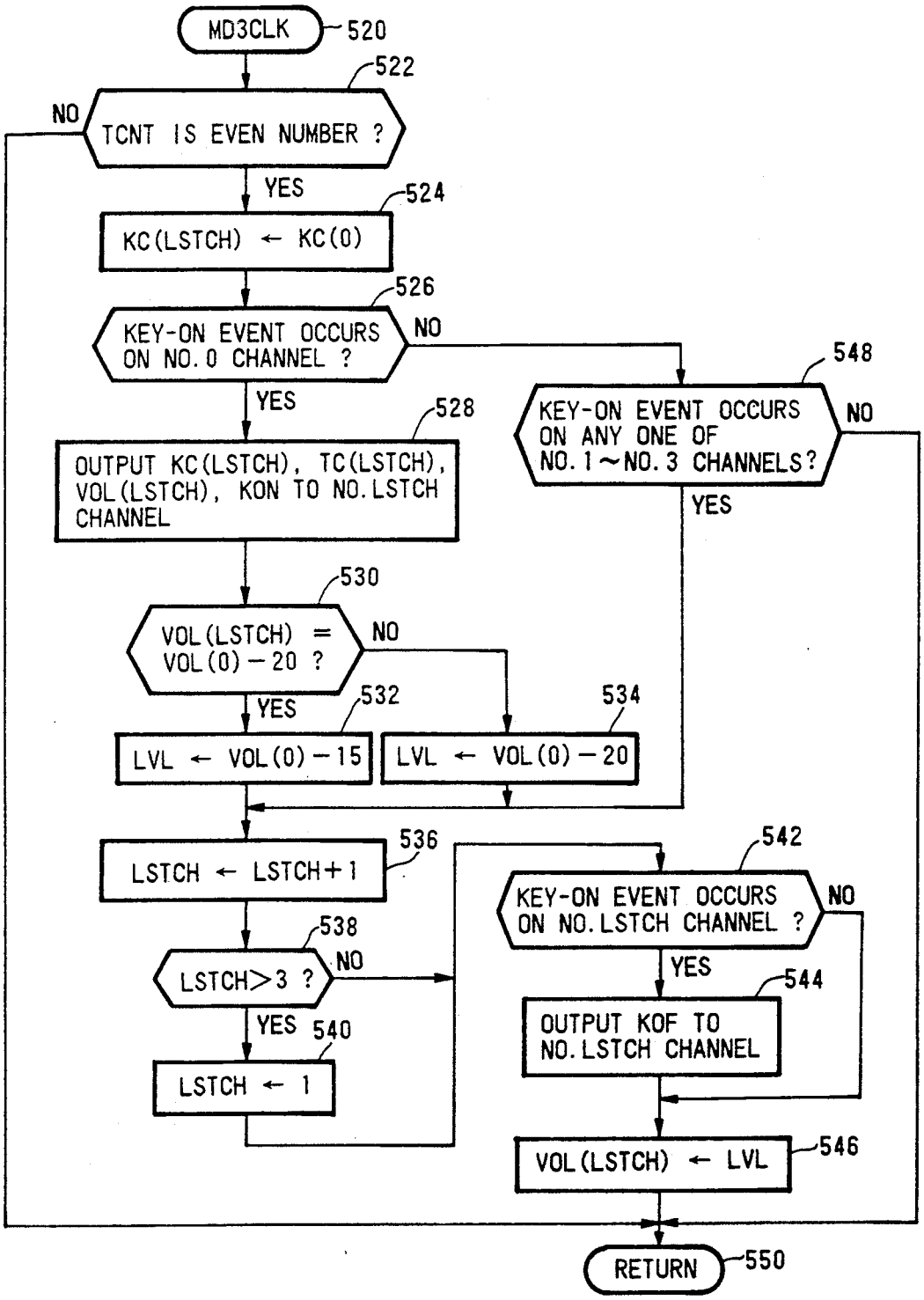

Next, when the mode corresponding clock routine MD3CLK is read out in step 252 of the clock interrupt program shown in FIG. 4, execution thereof is started in step 520 shown in FIG. 7B. In step 522, it is judged whether or not the tempo count data TCNT has an even value. If so, the judgement of step 522 turns to "YES" so that its succeeding processes of steps 524 etc. are to be executed. In contrast, if the tempo count data TCNT has an odd value, the judgement of step 522 turns to "NO" so that the processing directly proceeds to step 550 wherein execution of this routine MD3CLK is terminated. In this case, no substantial processing is carried out in this routine MD3CLK. In short, the substantial processing of the mode corresponding clock routine MD3CLK is carried out by every sixteenth note timing.

When the judgement of step 522 is "YES", the processing proceeds to step 524 wherein No.LSTCH key code KC(LSTCH) designated by the last channel data LSTCH is set identical to No.0 key code KC(0) indicative of the performed melody tone. In step 256, it is judged whether or not No.0 channel generate the musical tone signal corresponding to the key-on event. In other words, it is judged whether or not the melody key is depressed. This judgement of step 526 is carried out based on the key switch state stored in the switch data storing portion within the working memory 63. If the melody key is depressed, the judgement of step 526 turns to "YES" so that the processing proceeds to step 528 wherein No.LSTCH key code KC(LSTCH), tone color data TC(LSTCH), tone volume data VOL(LSTCH) and its key-on signal KON are supplied to NO.LSTCH channel of the melody tone signal generating circuit 43.

In this case, No.LSTCH key code KC(LSTCH), tone color data TC(LSTCH) are respectively set identical to No.0 key code KC(0), tone color data TC(0) concerning the performed melody tone. At this time, NO.LSTCH tone volume data VOL(LSTCH) is set at the value which is 20 dB lower than No.0 tone volume data VOL(0) concerning the performed melody tone. Herein, in the case where VOL(LSTCH) is set at VOL(0)−15 under processes of steps 532, 546 which will be described later, VOL(LSTCH) is set at value which is 15 dB lower than VOL(0). Therefore, the first additional tone is started to be generated in the same pitch and same tone color of the performed melody tone, but its tone volume is 20 dB (or 15 dB) lower than that of the performed melody tone, for example.

Then, the processing proceeds to step 530 wherein it is judged whether not No.LSTCH tone volume data VOL(LSTCH) is 20 dB lower than No.0 tone volume data VOL(0). When the relation "VOL(LSTCH)=VOL(0)−20" is established, the judgement of step 530 is "YES" so that the processing proceeds to step 532. In step 532, level data LVL is set at the value "VOL(0)−15" corresponding to the tone volume which is 15 dB lower than the tone volume of the performed melody tone. If the above-mentioned relation is not established, the judgement of step 530 turns to "NO" so that the processing branches to step 534 wherein the level data LVL is set at the value "VOL(0)−20" corresponding to the tone volume which is 20 dB lower than the tone volume of the performed melody tone.

Next, under processes of steps 536–540, the last channel data LSTCH is incremented from "1" to "3". Herein, after LSTCH reaches "3", it is changed to "1" again. After renewing the last channel data LSTCH in the above processes, the processing proceeds to step 542 wherein it is judged whether or not No.LSTCH channel generate the musical tone signal of the depressing key. Incidentally, this judgement can be carried out based on the tone-generation control signal used in the melody tone signal generating circuit 43. Or, it is possible to carry out this judgement by use of certain data which is stored in the variable data storing portion within the working memory 63. If the judgement of step 542 turns to "YES", the processing proceeds to step 544 wherein the key-off signal KOF is supplied to No.LSTCH channel. Then, No.LSTCH tone volume data VOL(LSTCH) is set identical to the level data LVL which is varied under the foregoing processes of steps 530–534 in step 546. Thereafter, execution of the mode corresponding clock routine MD3CLK is completed in next step 550. On the other hand, if the judgement of step 542 is "NO" indicating that No.LSTCH musical tone signal does not correspond to the key-on event, the processing branches to step 546 wherein No.LSTCH tone volume data VOL(LSTCH) is set identical to the level data LVL. In next step 550, execution of the mode corresponding clock routine MD3CLK is completed.

When the time corresponding to sixteenth note has passed after the preceding execution of the mode corresponding clock routine MD3CLK, the judgement of step 522 in the current execution of this routine MD3CLK turns to "YES". Then, after the process of step 524 is executed, it is judged whether or not the preceding melody key is depressed in step 526. If so, the CPU 62 controls the melody tone signal generating circuit 43 to start generating the additional tone from No.LSTCH channel in step 528. At this time when the current additional tone is generated as described above, the last channel data LSTCH has been incremented under the preceding execution of steps 536–540. In addition, under the preceding execution of steps 530–534, 546, the tone volume data VOL(LSTCH) has been changed over. Thus, the current additional tone is generated from the incremented channel number in the tone volume which is changed over. As a result, as shown in FIG. 7E, the additional tones are alternatively generated by every sixteenth note timings in different tone volumes, one of which is 15 dB lower, the other is 20 dB lower than the tone volume of the preformed melody tone. Incidentally, such additional tones have the same pitch of the preformed melody tone and same tone color of mandolin.

In the mode corresponding clock routine MD3CLK which is executed by every sixteenth note timing, due to the processes of steps 536–544, generation of the additional tone is stopped in the channel whose number is 1-channel larger than the channel from which the musical tone is started to be generated. However, it is noted that when the musical tone is started to be generated in No.3 channel, generation of the additional tone is stopped in No.1 channel. As a result, as shown in FIG. 7E, the tone-generation period of each additional tone correspond to eighth note, but termination timing of the tone-generation of each additional tone is shifted by sixteenth note period.

Next, in response to the key-release event of the depressed melody key in the keyboard 10, the mode corresponding key-off routine MD3KOF is read out in step 234 of the key-operation event routine shown in FIG. 3. This routine MD3KOF is started in step 560 shown in FIG. 7C. In next step 562, the key-off signal KOF is supplied to No.0 channel of the melody tone signal generating circuit 43. Then, execution of this routine MD3KOF is completed in step 564. As a result, generation of the melody tone signal is stopped, so that the speakers **45*a*–45*c*** stop generating the corresponding melody tone.

In the above-mentioned key-release event of the melody key, the judgement of step 526 in the mode corresponding clock routine MD3CLK which is substantially executed by every sixteenth note timing turns to "NO". In other words, it is judged that the musical tone signal generated from No.0 channel does not concern with the key-off event. Then, the processing branches to step 548 wherein it is judged whether or not any one of No.1–No.3 channels generate the musical tone signal concerning the key-on event. Herein, the flags concerning the key-on and key-off states of each channel can be stored during the execution of the foregoing steps 528, 544. Thus, these flags can be used for the judgement of step 548.

Now, when any one of No.1–No.3 channels generate the musical tone signal concerning the key-on event, the judgement of step 548 turns to "YES" so that the last channel data LSTCH is incremented by every sixteenth note timing in the processes of steps 536–540. Under the processes of step 542, 544, No.LSTCH channel stops generating the additional tone signal. Thus, generations of the additional tones are sequentially stopped by every sixteenth note timing as shown in FIG. 7E. Meanwhile, if none of No.1–No.3 channels generates the musical tone signal corresponding to the key-on event, the judgement of step 548 turns to "NO" so that the processes of steps 536–546 are omitted. Then, execution of the mode corresponding clock routine MD3CLK is terminated in step 550. Therefore, after generations of all melody tone and additional tones are stopped, the mode corresponding clock routine MD3CLK would not be substantially executed any more.

When the mode corresponding chord change routine MD3CHG is read out in step 218 of the key-operation event routine shown in FIG. 3, execution thereof is started in step 570 shown in FIG. 7D. However, in next step 572, execution of this routine MD3CHG is terminated, so that no substantial processing is executed in this routine MD3CHG.

In the third solo style play mode as described heretofore, while the melody key whose melody tone will be generated in the tone color of mandolin is depressed, first to third additional tones having the tone color of mandolin are sequentially generated by sixteenth note timings, but their note lengths (i.e., tone-generation periods) are set corresponding to eighth note. Thus, by merely carrying out the monophonic performance on the melody keys, it is possible to obtain the simulated performance effect which is similar to that of the mandolin band play. In addition, the above-mentioned first to third additional tones are generated in different tone volumes which are alternatively changed over. Thus, picking directions of these additional tones can be adjusted with those of the mandolin play.

As described above, in the present embodiment, first to third additional tones each having eighth note length are sequentially generated by sixteenth note timings. However, it is possible to change such tone-generation period and tone-generation timing. In addition, it is also possible to change such tone-generation period and tone-generation timing in response to the tempo of the automatic rhythm performance.

Further, in the present embodiment, start and stop timings of the tone-generation of each additional tone are controlled by every sixteenth note timing at which the mode corresponding clock routine MD3CLK is substantially executed. Such timing control can be varied in response to the manual operation, kind and tempo of the automatic rhythm etc. In order to vary such timing control in response to the tempo of the automatic rhythm, it is controlled that as the tempo becomes faster, the period of substantially executing the mode corresponding clock routine MD3CLK becomes longer than sixteen note period.

(d) Fourth Solo Style Play Mode

In the fourth solo style play mode (MD=4), when the melody tone is not included in the chord constituent note, the pitch thereof is raised up to that of the chord constituent note which is higher than the melody tone after the predetermined time is passed from the key-depression event of the melody tone. Then, after another predetermined time is passed, the raised pitch of the melody tone is lowered to its original pitch. This mode is designated when "safari" music (i.e., African folk music) is selected as the rhythm kind, for example. Selecting this mode, the automatic rhythm is simultaneously set in the standby state (i.e., RUN=−1), and the accompaniment flag ABC is set at "1". This mode utilizes only No.0 channel for generating the musical tone of key-depression event. Then, the tone color data TC(0) concerning this No. 0 channel is set at the value indicative of the tone color of jagd (i.e., hunting horn).

In response to the key-depression event occurred on the melody key, the mode corresponding key-on routine MD4KON is read out in step 230 of the key-operation event routine shown in FIG. 3. The execution of this routine MD4KON is started in step 600 shown in FIG. 8A. In step 602, No.0 key code KC(0), No.0 tone color data TC(0), No.0 tone volume data VOL(0) and key-on signal KON are supplied to No.0 channel of the melody tone signal generating circuit 43.

Thus, when receiving the key-on signal KON, No.0 channel starts to generate the musical tone signal, which is then equally outputted to the output lines L, C, R. In this case, the pitch of the musical tone signal is controlled by No.0 key code KC(0) so that it is set identical to the pitch of the performed melody key; the tone color thereof is controlled by No.0 tone color data TC(0) so that it is set corresponding to the tone color of jagd; and the tone volume thereof is controlled by No.0 tone volume data VOL(0) so that it is set corresponding to the key touch (indicated by the touch data TCH) of the performed melody key. Then, the musical tone signal outputted to the output lines L, C, R of the melody tone signal generating circuit 43 is supplied to the speakers 45*a*–45*c* via the output circuit 44, so that the speakers will generate the performed melody tone in the tone color of jagd.

After executing the above-mentioned process of step 602, the processing proceeds to step 604. At this time, the CPU 62 refers to the chord constituent note table 81 based on the type data TYPE of the performed chord and then its reference result is converted based on the root data ROOT, so that the desirable chord constituent notes are sequentially computed. In step 604, it is judged whether or not the performed melody tone corresponding to No.0 key code KC(0) is identical to the chord constituent note.

If so, the judgement of step 604 is "YES" so that the processing proceeds to step 606 wherein delay count data DLYCNT is set at "5". Then, execution of this routine MD4KON is completed in step 610.

Figure 8B:
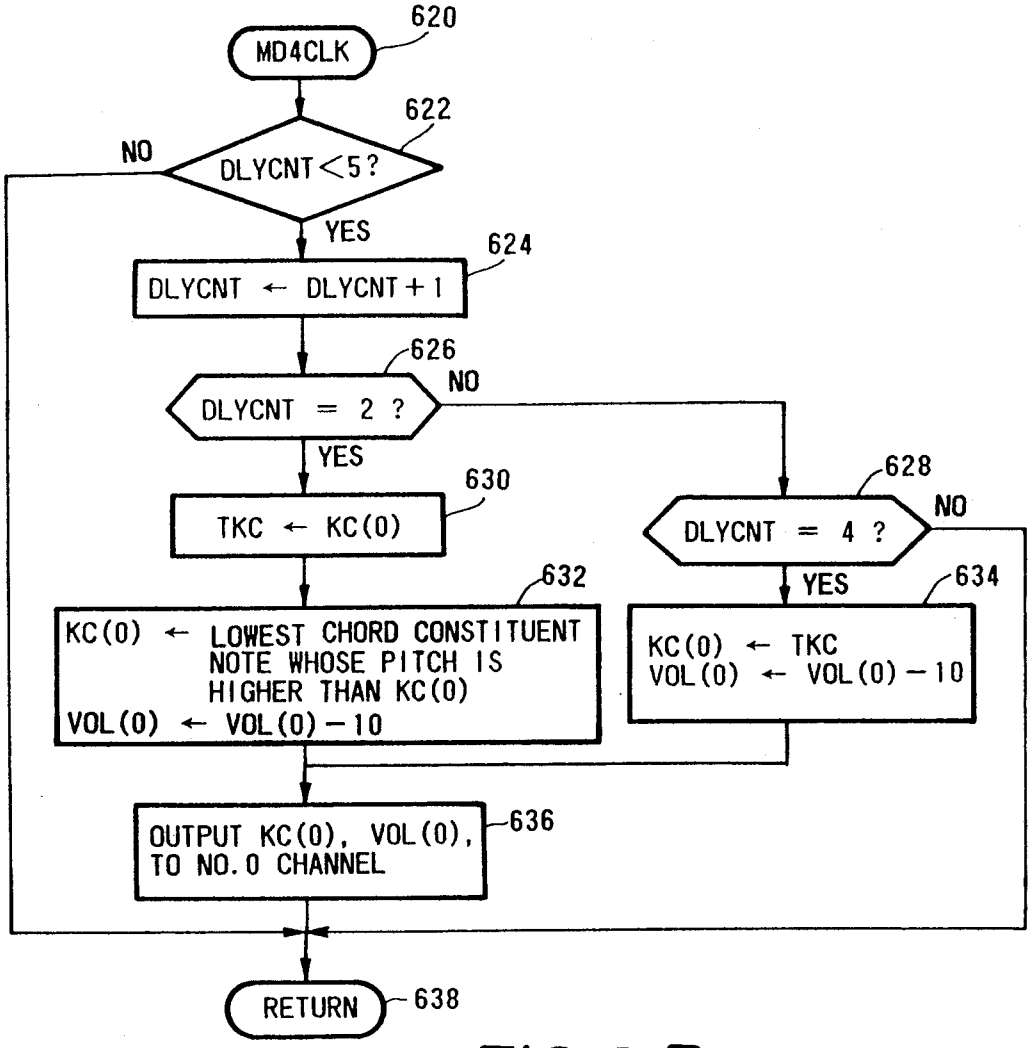
FIGS. 8A–8D are flowcharts showing sub-programs used in 4th solo style play mode.
Figure 8A:
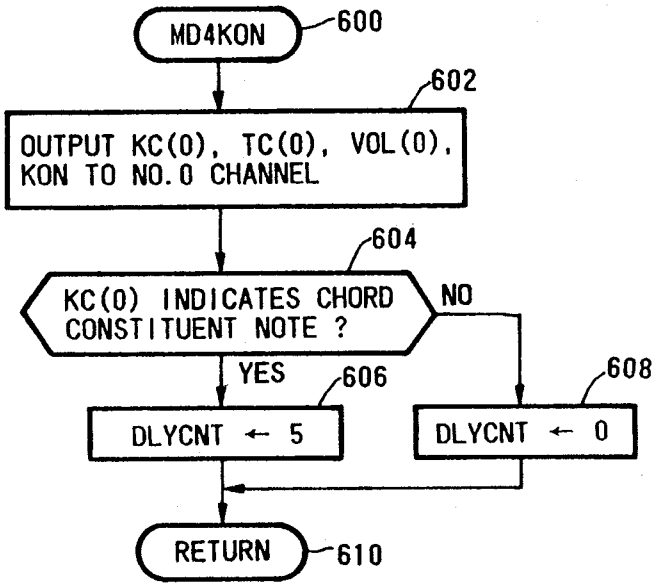

In such state, when the mode corresponding clock routine MD4CLK is read out in step 252 of the clock interrupt program shown in FIG. 4, execution thereof is started in step 620 shown in FIG. 8B. In step 622, it is judged whether or not the delay count data DLYCNT is smaller than "5". At this time, the delay count data DLYCNT has been set at "5" in the foregoing step 606 shown in FIG. 8A. Therefore, the judgement of step 622 turns to "NO" so that the processing directly proceeds to step 638 wherein the execution of the routine MD4CLK is terminated. Thereafter, even if the mode corresponding clock routine MD4CLK is executed again, the processing always passed from step 622 to step 638, hence, no substantial musical control is made in this routine MD4CLK. In short, as long as the performed melody tone is the chord constituent note, the performed melody tone corresponding to the musical tone signal generated from No.0 channel is continuously generated.

In contrast, when the performed melody tone is not the chord constituent note, the judgement of step 604 turns to "NO" so that the processing branches to step 608. In step 608, the delay count data DLYCNT is set at "0", and then execution of the mode corresponding key-on routine MD4KON is completed in step 610.

In the above state, when the mode corresponding clock routine MD4CLK is read out in step 252 of the foregoing clock interrupt program, execution thereof is started in step 620 shown in FIG. 8B. At this time, the delay count data DLYCNT is smaller than "5" so that the judgement of step 622 turns to "YES". Then, the processing proceeds to step 624 wherein the delay count data DLYCNT is added with "1" so that DLYCNT is set at "1". Since DLYCNT is at "1", judgements of steps 626, 628 both turn to "NO" so that execution of the mode corresponding clock routine MD4CLK is terminated in step 638.

Figure 8C:
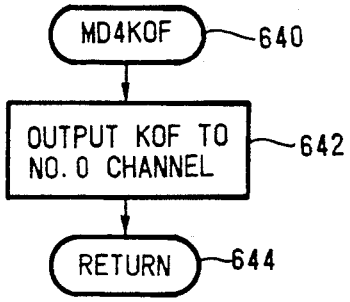
Figure 8D:
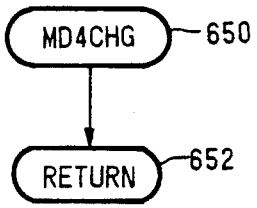
Figure 8E:
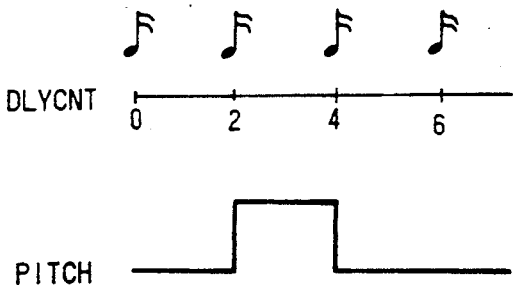
FIG. 8E shows a tone-generation pattern of additional tones in 4th solo style play mode.

As a result, as shown in FIG. 8E, the melody tone signal which is formed in No.0 channel is maintained as it were, so that the speakers 45*a*–45*c* continue to generate such melody tone.

Then, when the mode corresponding clock routine MD4CLK is executed again, the judgement of step 622 turns to "YES" so that the processing proceeds to step 624 wherein the delay count data DLYCNT is incremented to "2". Thus, the judgement of step 626 turns to "YES" so that the processing proceeds to step 630. In step 630, No.0 key code KC(0) is escaped as temporary stored key code TKC. In next step 632, the CPU 62 selects certain lowest chord constituent note which is firstly selected among the chord constituent notes when scanning the notes in pitch-ascending direction from the pitch of the performed melody key. Then, the key code indicative of the selected chord constituent note is set as No.0 key code KC(0). In addition, No.0 tone volume data VOL(0) is decreased by 10 dB. In such selection of the chord constituent note, as similar to the process of step 604 shown in FIG. 8A, desirable one of all chord constituent notes is extracted, wherein its pitch is larger than but the closest to the pitch corresponding to No.0 key code KC(0). Thereafter, the processing proceeds to step 636 wherein No.0 key code KC(0) and No.0 tone volume data VOL(0) are supplied to No.0 channel of the melody tone signal generating circuit 43. Then, execution of the mode corresponding clock routine MD4CLK is completed in step 638.

As a result, as shown in FIG. 8E, the pitch of the performed melody tone which is generated from No.0 channel is raised from its original pitch to higher pitch which is identical to that of the first chord constituent note. In addition, the tone volume of the melody tone signal is decreased by 10 dB. Then, the melody tone whose pitch and tone volume are varied as described above is to be generated from the speakers 45*a*–45*c*.

Next, when the mode corresponding clock routine MD4CLK is executed, the judgement of step 622 turns to "YES" so that the delay count data DLYCNT is increased to "3" in step 624. Therefore, the judgements of steps 626, 628 both turn to "NO". Thus, execution of the mode corresponding clock routine MD4CLK is terminated in step 638 without carrying out any musical tone control. As a result, as shown in FIG. 8E, the speakers 45*a*–45*c* continue to generate the melody tone whose pitch and tone volume are varied as described above.

Thereafter, when the next execution of the mode corresponding clock routine MD4CLK is made, the judgement of step 622 turns to "YES" so that the delay count data DLYCNT is increased to "4" in step 624. Therefore, the judgement of step 626 turns to "NO", but the judgement of step 628 turns to "YES", so that the processing proceeds to step 634 wherein the escaped key code TKC is reset as No.0 key code KC(0) and No.0 tone volume data VOL(0) is further decreased by 10 dB. In next step 636, such new No.0 key code KC(0) and No.0 tone volume data VOL(0) are supplied to No.0 channel.

As a result, as shown in FIG. 8E, the pitch of the performed melody tone signal which is generated from No.0 channel is returned from the higher pitch of the chord constituent note to its original pitch of the performed melody key. In addition, its tone volume is decreased by further 10 dB. Then, the speaker 45*a*–45*c* generate the melody tone whose pitch and tone volume are varied as described above.

Further, after certain time is passed, the mode corresponding clock routine MD4CLK is executed again. At this time, the delay count data DLYCNT reaches "5". Thereafter, the judgements of steps 626, 628 both turn to "NO", and then the judgement of step 622 also turns to "NO". Thus, as shown in FIG. 8E, the preceding melody tone is continuously generated but its tone volume is decreased by 20 dB from its original tone volume.

Next, in response to the key-release event occurred when the depressed melody key is released, the mode corresponding key-off routine MD4KOF is read out in step 234 of the key-operation event routine shown in FIG. 3. The execution of this routine MD4KOF is started in step 640 shown in FIG. 8C. In step 642, the key-off signal KOF is supplied to No.0 channel of the melody tone signal generating circuit 43. Then, execution of this routine MD4KOF is completed. As a result, generation of the melody tone signal is terminated, so that the speakers 45*a*–45*c* stop generating its corresponding melody tone.

When the mode corresponding chord change routine MD4CHG is read out in step 218 of the key-operation event routine, execution thereof is started in step 650 shown in FIG. 8D. However, execution of this routine MD4CHG is terminated in next step 652. Therefore, in this routine MD4CHG, no substantial processing is carried out.

As described above, in the fourth solo style play mode, the performed melody tone is generated in the tone color of jagd. When the time corresponding to sixteenth note is passed after the key-depression event timing of the melody key, the pitch of the melody tone is raised up to that of the first chord constituent note having higher pitch thereof. Then, after the time corresponding to sixteenth note is passed, the raised pitch of the melody tone is lower to its original pitch. In addition, the tone volume control interlocked with the above-mentioned pitch control is carried out on the melody tone. Therefore, by merely carrying out the normal monophonic melody performance, it is possible to obtain the African folk music performed with punch, which makes the music more impressive. Only while the melody tone is not the chord constituent note, the pitch and tone volume are controlled to be varied. On the other hand, while the melody tone is the chord constituent note, such pitch and tone volume controls are canceled. This avoids the performed music to become persistent.

Incidentally, in the present embodiment, the pitch of the melody tone is raised up to that of the lowest chord constituent note which is higher than the performed melody key. Instead, it is possible to raise the pitch of the melody tone to that of another chord constituent note.

In addition, the present embodiment varies the pitch and tone volume of the melody tone by every sixteenth note timing. However, this timing can be changed corresponding to another note length. Further, the duration of the pitch and tone volume control can be also varied. For example, this duration can be varied in connection with the manual operation or rhythm tempo.

(e) Fifth Solo Style Play Mode

In the fifth solo style play mode (MD=5), when the performed melody pitch is jumped to another pitch by the predetermined degrees or more, glissando is effected on the performed melody tone. Based on the condition wherein certain tone is emerged in the predetermined frequency, the melody pitch is varied during the predetermined period after its key-depression event if the performed melody tone is the chord constituent note. For example, when "chanson" is designated as the rhythm kind, this mode is designated. At this time, the automatic rhythm is set in the operating state (RUN=−1), and the accompaniment flag ABC is set at "1". In this mode, only No.0 channel is used for the depressed keys in the keyboard 10, and its corresponding No.0 tone color data TC(0) is set at the value indicative of the tone color of accordion.

Figure 9A:
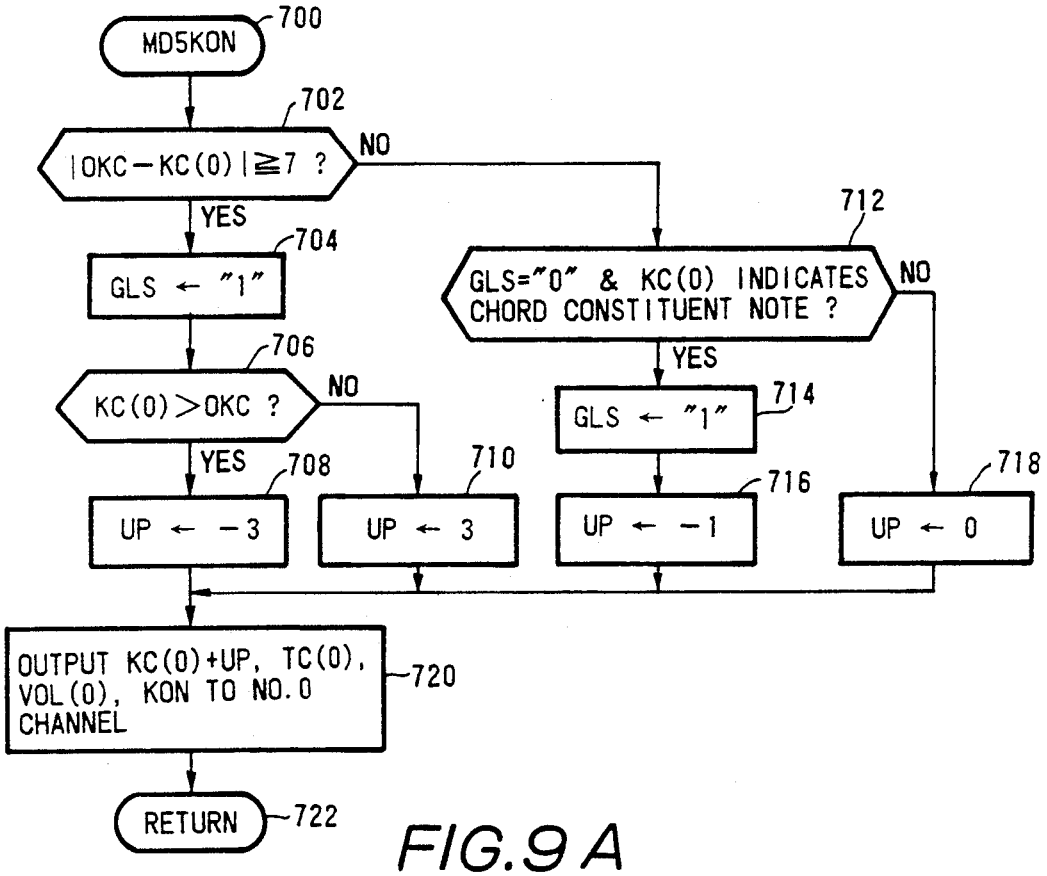
FIGS. 9A–9D are flowcharts showing sub-programs used in 5th solo style play mode.

In response to the key-depression event occurred on the melody key, the mode corresponding key-on routine MD5KON is read out in step 230 of the key-operation event routine. Then, execution of this routine MD5KON is started in step 700 shown in FIG. 9A. At this time, the difference between the old key code OKC indicative of the preceding melody pitch and No.0 key code KC(0) indicative of the current melody pitch is computed. In step 702, it is judged whether or not absolute value OKC-KC(0) indicative of such difference is equal to or lower than "7" (i.e., seven semitones). When the variation of 5 whole-degrees or more is occurred between the preceding and current melody pitches, this absolute value |OKC-KC(0)| becomes "7" or more. In this case, the judgement of step 702 turns to "YES", so that the processing proceeds to step 704 wherein a glissando flag GLS is set at "1". This glissando flag GLS at "1" level indicates that the glissando and pitch variation control have been already effected on the melody tones within one bar to be performed, while GLS at "0" level indicates that the glissando and pitch variation control have not been effected on such melody tones yet. This glissando flag GLS is used for the pitch variation control to be executed in steps 712–716 which will be described later. In step 706, it is judged whether or not No.0 key code KC is larger than the old key code OKC.

Now, when the melody pitch is to be raised up, the judgement of step 706 turns to "YES" because KC(0)>OKC is detected. Then, the processing proceeds to step 708 wherein increment data UP is set at "−3". In next step 720, the increment data UP is added to No.0 key code KC(0) so that KC(0)+UP (i.e., KC(0)−3) is obtained. Then, the added key code KC(0)−3, No.0 tone color data TC(0), No.0 tone volume data VOL(0) and key-on signal KON are supplied to No.0 channel of the melody tone signal generating circuit 43. Thereafter, execution of the routine MD5KON is completed in step 722. Thus, in response to the receipt of the key-on signal KON, No.0 channel starts to generate the musical tone signal, which is then equally outputted to the output lines L, C, R. In this case, the pitch of the musical tone signal to be generated is controlled by the above-mentioned key code KC(0)−3 so that it is set three semitones lower than that of the performed melody key. In addition, the tone color is controlled by No.0 tone color data TC(0) so that it is set as the tone color of accordion. Further, the tone volume is controlled by No.0 tone volume data VOL(0) so that it is set corresponding to the key touch (indicated by the touch data TCH) of the performed melody key. Thereafter, the musical tone signal equally fed to the output lines L, C, R of the melody tone signal generating circuit 43 is supplied to the speakers 45*a*–45*c* via the output circuit 44. Thus, as shown in FIG. 9E, the speakers 45*a*–45*c* generate the musical tone whose pitch is three semitones lower than that of the performed melody key but tone color is set as the tone color of accordion.

Figure 9C:
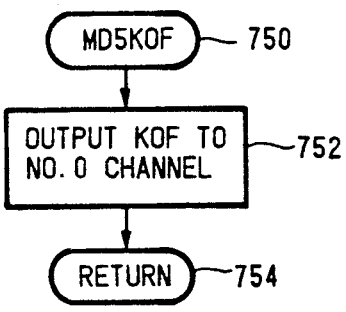
Figure 9D:
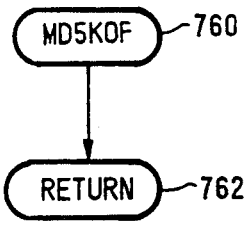
Figure 9B:
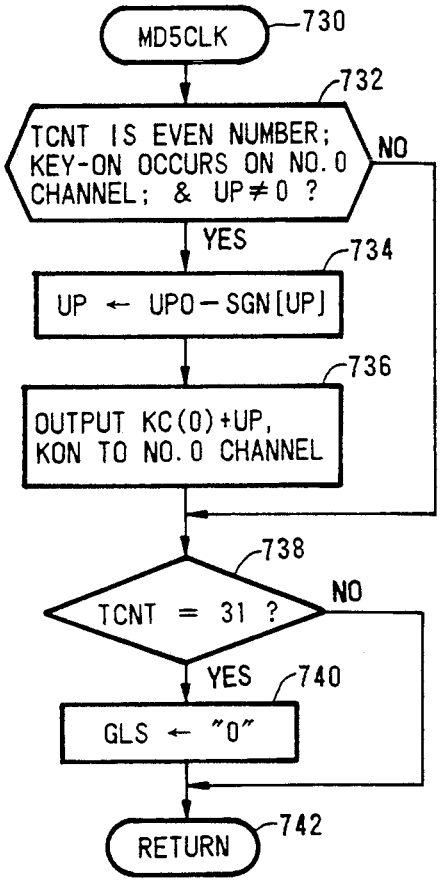

In this state, when the mode corresponding clock routine MD5CLK is read out in step 252 of the clock interrupt program shown in 4, execution thereof is started from step 730 shown in FIG. 9B. In step 732, it is judged whether or not the tempo count data TCNT has the even value, melody key is depressed so that No.0 channel generates its musical tone signal, and the increment data UP is not at "0". This judgement is carried out based on the key switch state data stored in the switch data storing portion within the working memory 63. At this time, the increment data UP is at "−3", and the melody key is in the depressing state. Therefore, if the tempo count data TCNT has the even value, the judgement of step 732 turns to "YES", and consequently its succeeding processes of steps 734, 736 are to be executed. In step 734, by carrying out the calculation of "UP=UP−SGN[UP]", the increment data UP is renewed to "−2". The result of the above-mentioned function "SGN[X]" is set at "+1" when variable X is positive, while it is set at "−1" when X is negative. In step 736, the key code KC(0)+UP (i.e., KC(0)−2) and key-on signal KON are supplied to No.0 channel of the melody tone signal generating circuit 43. Thus, as described before, the melody tone signal generating circuit 43 newly forms the melody tone signal, whose tone color and tone volume are controlled by No.0 tone color data TC(0) and No.0 tone volume data VOL(0) which have been precedingly generated. Therefore, as shown in FIG. 9E, the speakers 45*a*–45*c* generate the musical tone whose pitch is two semitones lower than that of the performed melody key but tone color is set as the tone color of accordion.

Meanwhile, when the judgement of step 732 is "NO" since the tempo count data TCNT has the odd value, the processing branches to step 738 directly. In this case, the tone-generation control based on the above-mentioned process of step 736 is not executed, so that the preceding musical tone is continuously generated. Herein, the mode corresponding clock routine is executed by every thirty-second note timing. In addition, only while the tempo count data TCNT has the even value, the processes of steps 734, 736 are executed. Thus, the key code KC supplied to No.0 channel is varied as "−1", "0", etc. by every sixteenth note timing. When the increment data UP reaches "0", the judgement of step 732 turns to "NO" so that the processes of steps 734, 736 are not executed. Thereafter, during the key-depression event of the melody key, the pitch of the melody tone to be generated is maintained at its own pitch.

Figure 9E:
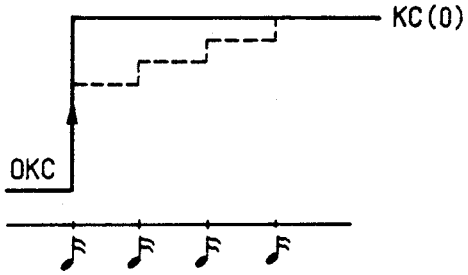
FIGS. 9E–9G show tone-generation patterns of additional tones in 5th solo style play mode.

In the case where the performed melody pitch rises up from the preceding melody pitch by 5 whole-degrees or more, as shown in FIG. 9E, the pitch thereof is lowered by three semitones at its key-depression timing. This lowered pitch is raised up by semitone by every sixteenth note timing. Thereafter, as long as the melody key is continuously depressed, the pitch thereof will be maintained at its original pitch. As a result, the glissando is effected on the melody tone in pitch-ascending direction in the fifth solo style play mode.

Figure 9F:
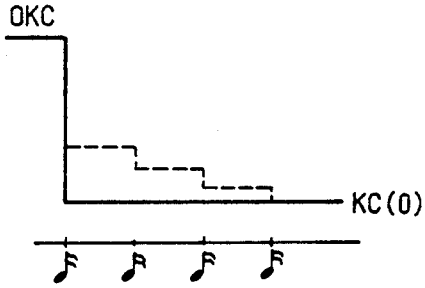

On the other hand, when the melody pitch is lowered by 5 whole-degrees or more from its preceding pitch, the judgement of step 702 turns to "YES". Then, the judgement of step 706 turns to "NO" so that the processing branches to step 710 wherein the increment data UP is set at "+3". In this case, due to the process of step 720 which is executed at the melody-key-depression event, the output key code KC is set as KC(0)+3. In addition, in the mode corresponding clock routine MD5CLK which is executed by every sixteenth note timing, the result of function SGN[UP] is equal to "+1". Therefore, under the processes of steps 734, 736, the output key code KC is decremented by "1" by every sixteenth note timing, and finally it reaches at the value corresponding to the performed melody pitch. As a result, in the case where the performed melody pitch is lowered by 5 whole-degrees or more from its preceding pitch, as shown in FIG. 9F, the performed melody pitch is raised by three semitones at the melody-key-depression event. Then, this melody pitch is lowered by semitone by every sixteenth note timing. Finally, as long as the melody key is continuously depressed, the melody pitch will be maintained at its original pitch. As a result, the glissando is effected on the melody tone in pitch-descending direction.

In the above-mentioned state, when the depressed melody key is released, the mode corresponding key-off routine MD5KOF is read out in step 234 of the key-operation event routine. The execution of this routine MD5KOF is started in step 750 shown in FIG. 9C. In next step 752, the key-off signal KOF is supplied to No.0 channel of the melody tone signal generating circuit 43. Then, in step 754, execution of the routine MD5KOF is completed. As a result, generation of the melody tone signal is terminated, so that the speaker 45a–45c stop generating the corresponding melody tone.

Next, description will be given with respect to the case where the current melody pitch does not ascend or descend by 5 degrees or more from the preceding pitch. In this case, in the mode corresponding key-on routine MD5KON shown in FIG. 9A which is executed in response to the melody-key-depression event, the judgement of step 702 turns to "NO" so that the processing branches to step 712. In step 712, it is judged whether or not the glissando flag GLS is at "0" and the tone indicated by No.0 key code KC(0) is the chord constituent note.

Figure 9G:
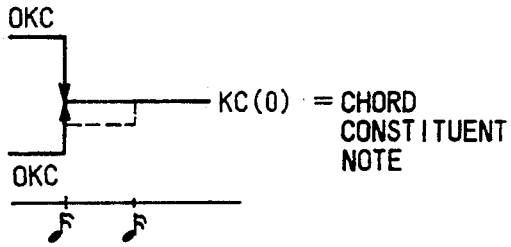

When the judgement of step 712 turns to "YES", the glissando flag GLS is set at "1" in step 714, and then the increment data UP is set at "−1". Then, after the foregoing process of step 720 is executed, execution of this mode corresponding key-on routine MD5KON is completed. At this time, the increment data UP is set at "−1", and generation of the melody tone signal is controlled by the foregoing processes of steps 720, 732–736 (of the mode corresponding clock routine MD5CLK shown in FIG. 9B). Therefore, as shown in FIG. 9G, the melody pitch is lower by one semitone at the melody-key-depression timing. Then, after the sixteenth note period is passed, the lowered melody pitch is returned to its original pitch. Thereafter, as long as the melody key is continuously depressed, the melody pitch will be maintained at its original pitch.

Meanwhile, if the glissando flag GLS is not at "0" or the performed melody tone is not the chord constituent note, the foregoing judgement of step 712 turns to "NO" so that the processing branches to step 718 wherein the increment data UP is set at "0". In this case, the output key code KC is set equal to KC(0) indicative of the performed melody pitch under the process of step 720. In the mode corresponding clock routine MD5CLK shown in FIG. 9B, the judgement of step 732 always turns to "NO", so that the tone-generation control is not carried out under the processes of steps 734, 736. Thus, the melody tone is generated in its original pitch corresponding to the depressed melody key. Regardless of whether or not the above-mentioned pitch variation control is carried out, when the melody key is released, generation of the melody tone is stopped under execution of the mode corresponding key-off routine MD5KOF shown in FIG. 9C.

As described above, the glissando flag GLS is used for the judgement whether or not the pitch variation control is carried out. In the case where the glissando control and pitch variation control is carried out on the melody tone, the glissando flag GLS is set at "1" in the processes of steps 704, 714. Then, under the processes of steps 738, 740 in the mode corresponding clock routine MD5CLK which is executed by every sixteenth note timing, the glissando flag GLS is cleared to "0" at the bar end timing when the tempo count data TCNT reaches "31". While the glissando flag GLS is at "1", the pitch variation control is not carried out. Therefore, in one bar to be performed wherein the glissando control and pitch variation control have not been carried out, only when the performed melody tone is the chord constituent note, the pitch variation control should be carried out.

When the mode corresponding chord change routine MD5CHG is read out in step 218 of the key-operation event routine, execution thereof is started in step 760 shown in FIG. 9D. However, execution of this routine MD5CHG is terminated in next step 762. Therefore, no substantial processing is carried out in this routine MD5CHG.

In the fifth solo style play mode as described heretofore, the melody tone is generated in the tone color of accordion. In addition, when the current melody pitch jumps by 5 whole-degrees or more from the preceding pitch in pitch-ascending or pitch-descending direction, the glissando corresponding to the pitch-ascending or pitch-descending direction is effected on the melody tone so that the preceding pitch is smoothly varied to the current pitch. Thus, by merely carrying out the simple melody performance, it is possible to obtain the varied performance such as chanson. Meanwhile, in the case where the melody tone is the chord constituent note, the melody pitch is controlled up or down by semitone so that the front-percussive-sound can be applied to the performance, by which it is possible to obtain the performance full of variety such as chanson. Moreover, such pitch control is not carried out in one bar wherein the glissando or another pitch control has been effected. This avoids the performed music to be persistent.

In the fifth solo style play mode, the glissando is started to be effected from the lower or higher pitch which is three semitones lower or higher than the original melody pitch. However, it is possible to change such number of semitones in glissando-pitch-variation to "4" or "5". In any case, the glissando can be started to be effected from the lower of higher pitch which is lower or higher than the original melody pitch by certain integral number of semitones.

In addition, the fifth solo style play mode effects the glissando control or pitch variation control by every sixteenth note timing. However, this timing can be changed corresponding to another note length. Further, duration of pitch variation control can also be set variable. For example, such pitch variation control can be carried out in response to the manual operation or rhythm tempo.

(f) Sixth Solo Style Play Mode

The sixth solo style play mode is the mode (MD=6) wherein when the melody key is continuously depressed by the predetermined note length period or more, the accompaniment tones according to the predetermined pattern are added to the melody tone. This mode is designated when "swing piano" is designated as the rhythm kind. Then, the accompaniment flag ABC is set at "1", while the automatic rhythm is simultaneously set in the standby state (RUN=−1). In this mode, No. 0–No. 3 channels are used to generate the melody tone and additional tones corresponding to the depressed melody key. In addition, the tone color data TC(0)–TC(3) are set at the values indicating the tone color of piano. The pattern data storing portion 95 in the solo style play control data table 90 stores the pattern data corresponding to notes shown in FIG. 10E, wherein the pattern data are designated by the mode data MD(=6). This pattern data storing portion 95 stores key-on event data indicative of the timing of starting the generation of accompaniment tone; key-off event data indicative of the timing of terminating the generation of accompaniment tone; and no-operation data indicating that no operation (or processing) is required at respective addresses designated by the tempo count data TCNT (0–31).

Figure 10A:
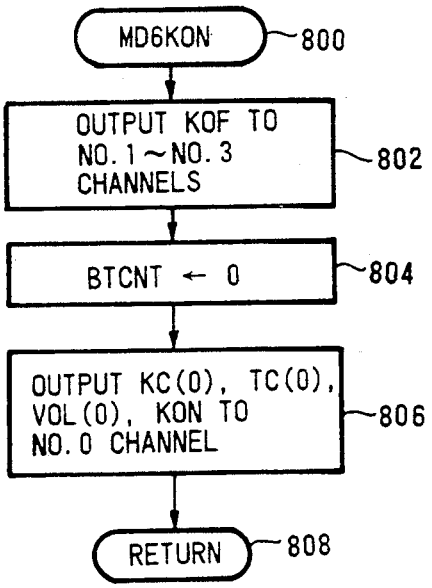
FIGS. 10A–10D are flowcharts showing sub-programs used in 6th solo style play mode.

In response to the melody-key-depression occurred in the keyboard 10, the mode corresponding key-on routine MD6KON is read out in step 230 of the key-operation event routine. The execution of this routine MD6KON is started in step 800 shown in FIG. 10A. In step 802, the key-off signal KOF is supplied to No.-1-No.3 channels of the melody tone signal generating circuit 43. As a result, No. 1-No.3 channels stop generating the musical tone signals at this timing even if they are generating the musical tone signals. Therefore, all of No.1-No.3 channels are initialized. In next step 804, beat count data BTCNT is initialized to "0". Then, in step 806, No. 0 key code KC(0), tone color data TC(0), tone volume data VOL(0) and key-on signal KON are supplied to No.0 channel. Thereafter, execution of this mode corresponding key-on routine MD6KON is completed in step 808.

In response to the receipt of the key-on signal KON, No.0 channel starts to generate the musical tone signal, which is then equally fed to the output lines L, C, R. In this case, the pitch of the musical tone signal is controlled by No.0 key code KC(0) so that it is set identical to the performed melody pitch; the tone color is controlled by No.0 tone color data TC(0) so that it is set identical to the tone color of piano; and tone volume is controlled by No.0 tone volume data VOL(0) so that it is set corresponding to the key touch (i.e., touch data TCH) of the performed melody key. The musical tone signal fed to the output lines L, C, R of the melody tone signal generating circuit 43 is supplied to the speakers 45*a*–45*c* via the output circuit 44. Thus, the speakers 45*a*–45*c* generate the performed melody tone in the tone color of piano.

Figure 10C:
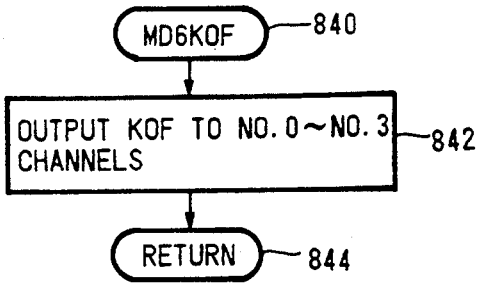
Figure 10D:
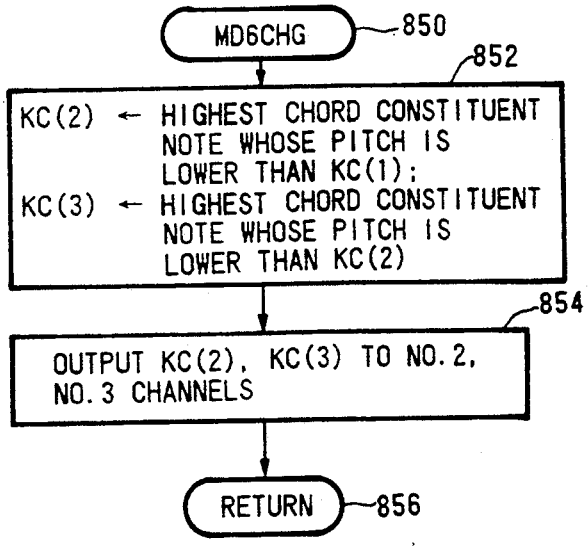
Figure 10E:
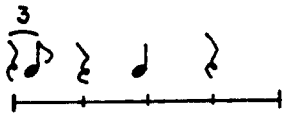
FIG. 10E shows a tone-generation pattern of additional tones in 6th solo style play mode.
Figure 10B:
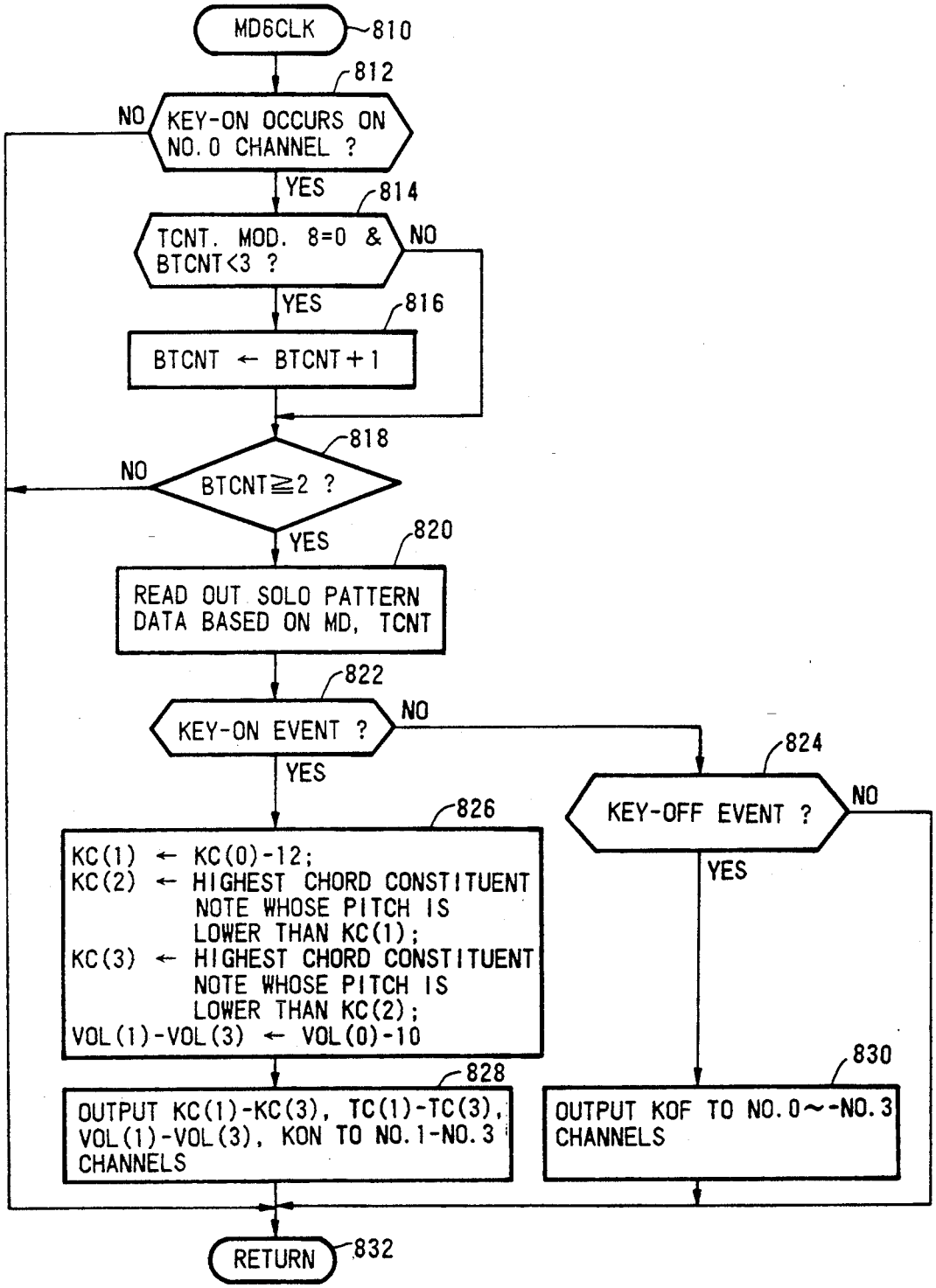

In the above-mentioned state, when the mode corresponding clock routine MD6CLK is read out in step 252 of the clock interrupt program shown in FIG. 4, the execution thereof is started in step 810 shown in FIG. 10B. In next step 812, it is judged whether or not No.0 channel generates the musical tone signal corresponding to the key-on event, in other words, it is judged whether or not the melody key is depressed. This judgement is carried out based on the key switch state data stored in the switch data storing portion in the working memory 63. When the melody key is depressed, the judgement of step 812 turns to "YES" so that the processing proceeds to step 814. In step 814, it is judged whether or not the remainder obtained by dividing the tempo count data TCNT by "8" equals to "0" (i.e., TCNT.MOD.8=0) and it is also judged whether or not the beat count data BTCNT is lower than "3". If so, the judgement of step 814 turns to "YES" so that the processing proceeds to step 816 wherein the beat count data BTCNT is incremented by "1". On the other hand, if at least one of two conditions in step 814 is not established, the judgement of step 814 turns to "NO" so that the beat count data BTCNT is maintained as it were by omitting the process of step 816. As a result, under the processes of steps 814, 816, the beat count data BTCNT is incremented as "0", "1", "2", "3" by every beat timing (i.e., every fourth note timing). Herein, BTCNT is set at "0" at the melody-key-on event by the process of step 804, and the maximum value thereof is "3".

After executing the above-mentioned processes of steps 814, 816, the processing proceeds to step 818 wherein it is judged whether or not the beat count data BTCNT becomes equal to or larger than "2". When the beat count data BTCNT is lower than "2" because one beat period is not passed after the melody-key-on timing, the judgement of step 818 turns to "NO" so that the processing directly branches to step 832, wherein execution of the mode corresponding clock routine MD6CLK is terminated.

Thereafter, in response to the melody-key-off event, the mode corresponding key-off routine MD6KOF is read out in step 234 of the key-operation event routine. Thus, the key-off processing is to be executed on the melody tone corresponding to the released melody key. More specifically, execution of the mode corresponding key-off routine MD6KOF is started in step 840 shown in FIG. 10C. In next step 842, the key-off signal KOF is supplied to No.0-No.3 channels. Then, in step 844, execution of the mode corresponding key-off routine MD6KOF is completed. As a result, generation of the performed melody tone signal is terminated. Thus, the speakers 45*a*–45*c* stop generating the musical tone corresponding to such performed melody tone signal. For this reason, if the key-depression period of the depressed melody key is less than one beat period so that the beat count data BTCNT does not reach "2", the melody tone corresponding to the depressed melody key is only generated in the tone color of piano.

In contrast, when the key-depression period of the depressed melody key continues for one beat period or more, the judgement of step 812 turns to "YES" so that the foregoing processes of steps 814, 816 will be carried out. Then, when the beat count data BTCNT reaches "2", the judgement of step 818 turns to "YES" so that its succeeding processes of steps 820 etc. are to be executed. In step 820, the CPU 62 refers to the pattern data storing portion 95 within the solo style play control data table 90 to thereby read out the pattern data, which is designated by the mode data MD(=6) and whose timing is designated by the tempo count data TCNT. Thereafter, step 822 judges whether or not the read pattern data concerns the key-on event data, and then step 824 judges whether or not the read pattern data concerns the key-off event data.

If the read pattern data concerns the key-on event data, the judgement of step 822 turns to "YES" so that the processing proceeds to step 826. In step 826, No.1 key code KC(1) indicative of the pitch of No.1 additional tone is set at "KC(0)−12" indicative of the pitch which is one octave lower than the pitch of the performed melody key. In addition, No.2 key code KC(2) is set at the key code indicative of the first chord constituent note (i.e., highest chord constituent note) which is firstly found when scanning the key codes from No.1 key code KC(1) in pitch-descending order. Then, No.3 key code KC(3) is set at the key code indicative of the chord constituent note next to the above-mentioned first chord constituent note but whose pitch is lower than that of the first chord constituent note. In order to set No.2-No.3 key codes KC(2)-KC(3), the CPU 62 refers to the chord constituent note table 81 based on the type data TYPE, and then based on the root data ROOT, the reference result is converted into the chord constituent notes. Thereafter, among these chord constituent notes, the above-mentioned two chord constituent notes are extracted for No.2-No.3 key codes KC(2)-KC(3). In addition, No.1-No.3 tone volume data VOL(1)-VOL(3) respectively indicating the tone volumes of No.1-No.3 additional tones are set identical to "VOL(0)−10" indicative of the tone volume which is 10 dB lower than the tone volume VOL(0) of the melody tone.

After executing the above-mentioned process of step 826, the processing proceeds to step 828 wherein No.-1-No.3 key codes KC(1)-KC(3), tone color data TC(1)-TC(3), tone volume data VOL(1)-VOL(3) and key-on signals KON are respectively supplied to No.-1-No.3 channels of the melody tone signal generating circuit 43. In next step 832, execution of the mode corresponding clock routine MD6CLK is completed. As a result, in response to the receipt of the key-on signals, No.1-No.3 channels start to generate No.1-No.3 additional tone signals corresponding to the data KC(1)-KC(3), TC(1)-TC(3), VOL(1)-VOL(3), which are then fed to the speakers 45*a*-45*c* via the output circuit 44. Thus, the speakers 45*a*-45*c* generate No.-1-No.3 additional tones in the tone color of piano and the same tone volume which is 10 dB lower than the tone volume of the performed melody tone. In this case, No.1 additional tone has the pitch which is one octave lower than the melody pitch, while No.2, No.3 additional tones respectively correspond to two chord constituent notes whose pitches are just below the melody pitch.

Meanwhile, if the pattern data read out by the process of step 820 is the key-off event data, the judgement of step 822 turns to "NO" but the judgement of step 824 turns to "YES" so that the processing proceeds to step 830 wherein the key-off signal KOF is supplied to No.-1-No.3 channels. Thereafter, execution of the mode corresponding clock routine MD6CLK is completed in step 832. Thus, No.1-No.3 channels stop generating No.1-No.3 additional tone signals respectively, by which the speakers 45*a*-45*c* stop generating the corresponding No.1-No.3 additional tones. Further, in the case where the read pattern data indicates the no-operation data described before, both of the judgements of steps 822, 824 turn to "NO" so that execution of the routine MD6CLK is terminated without carrying out the tone-generation control processing.

As a result, in the case where the melody key is continuously depressed for one beat period or more, No.-1-No.3 additional tones are generated in the pattern as shown in FIG. 10E. Incidentally, the read-out timing of the pattern data in step 820 depends on the tempo count data TCNT. Therefore, generation of No.1-No.3 additional tones is started at the timing depending on the tempo count data TCNT.

During the generation of No.1-No.3 additional tones, when the melody key is released, generation of the musical tone signals in No.0-No.3 channels is terminated in step 842 of the mode corresponding key-off routine MD6KOF shown in FIG. 10C as described before. In this case, in addition to the termination of generation of the melody tone, generation of No.0-No.3 additional tones is also terminated.

Further, in response to the chord-key-depression event, the mode corresponding chord change routine MD6CHG is read out in step 218 of the key-operation event routine. The execution of this routine MD6CHG is started in step 850 shown in FIG. 10D. Then, after executing processes of steps 852, 854, execution of the routine MD6CHG is completed in step 856. In this case, the process similar to that of foregoing step 826 is executed in step 852. More specifically, No.2, No.3 key codes KC(2), KC(3) are renewed in according to the change of the chord to be performed in step 852. In next step 854, the renewed No.2, No.3 key codes KC(2), KC(3) are supplied to No.2, No.3 channels of the melody tone signal generating circuit 43. Thus, during the generation of No.1-No.3 additional tone signals, No.2, No.3 channels changes the pitches of No.2, No.3 additional tone signals in response to No.2, No.3 key codes KC(2), KC(3). Therefore, No.1-No.3 additional tones generated from the speakers 45*a*-45*c* are varied in response to the change of the chord to be performed.

As described heretofore, in the sixth solo style play mode, when the melody key is continuously depressed for one beat period or more, plural additional tones to be generated in the predetermined pattern are added to the performed melody tone. Therefore, even if the melody performance is monotonous, it is possible to obtain the performed music full of variety as a whole. These additional tones are generated in the tone color of piano and the tone volume which is slightly lower than that of the performed melody tone. By selecting desirable tone-generation pattern for the additional tones, it is possible to perform the music which may be sounded like a jazz piano play, for example.

In the sixth solo style play mode of the present embodiment, the number of additional tones is set at "3". However, it is possible to change such number. In addition, it is possible to provide plural tone-generation patterns for the additional tones, one of which is to be selected. Or, it is also possible to provide the different tone-generation pattern for each additional tone.

(g) Seventh Solo Style Play Mode

The seventh solo style play mode (MD=7) is set when the melody tone is the chord constituent note, wherein the pitch variation control is carried out on the melody tone by the predetermined period after the melody-key-on timing in accordance with the predetermined condition concerning the frequency of the chord constituent notes to be emerged. In addition, when the melody key is depressed by the predetermined note period or more, the accompaniment tones according to the predetermined pattern are added to the melody tone. This mode is designated when "rhythm and blues" is designated as the rhythm kind. In the concrete, this mode is simultaneously set when the automatic rhythm is set in the standby state (RUN= −1) and the accompaniment flag ABC is at "1". In this mode, No.0-No.3 channels are used to generate the additional tones and melody tone corresponding to the depressed key. The tone color data TC(0) concerning No.0 channel is set identical to the tone color of flute, while other tone color data TC(1)-TC(3) are all set identical to the tone color of brass instrument. Meanwhile, the pattern data storing portion 95 within the solo style play control data table 90 stores the pattern data corresponding to notes shown in FIG. 11F. The pattern data is designated by the mode data MD(=7). As described before, the pattern data storing portion 95 stores the key-on event data, key-off event data and no-operation data at respective addresses designated by the tempo count data TCNT(0-31).

Figure 11B:
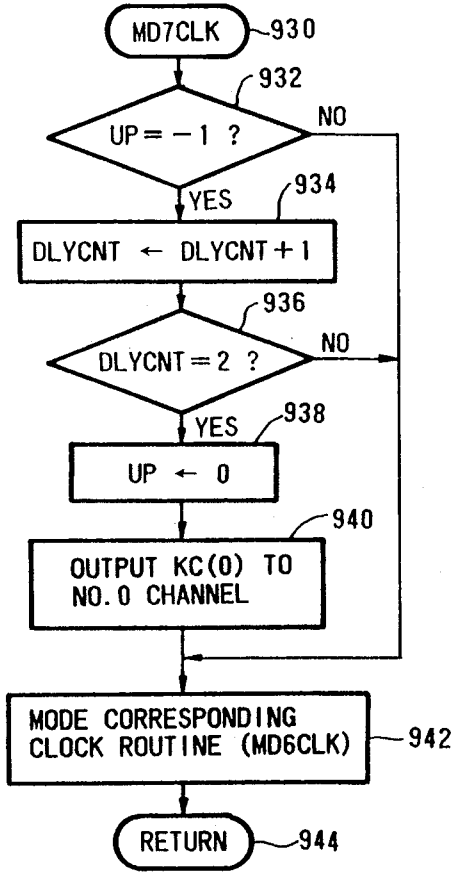
FIGS. 11A–11D are flowcharts showing sub-programs used in 7th solo style play mode.
Figure 11A:
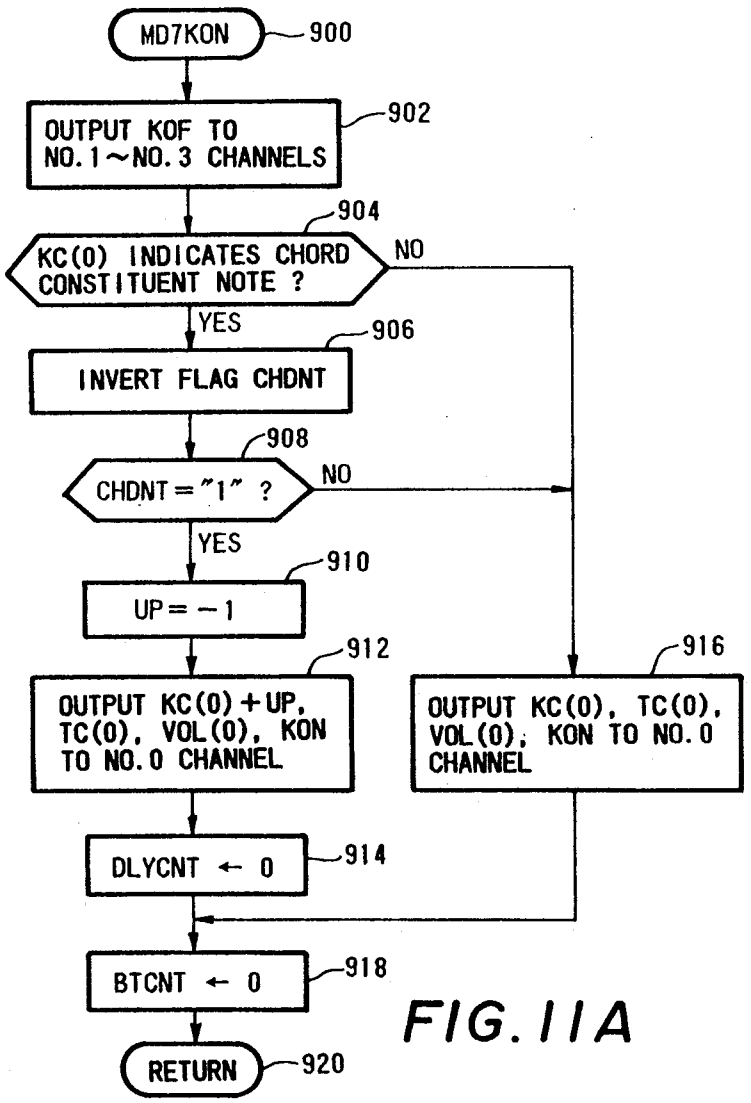

In response to the melody-key-on event occurred in the keyboard 10, the mode corresponding key-on routine MD7KON is read out in step 230 of the key-operation event routine, and then the execution thereof is started in step 900 shown in FIG. 11A. In next step 902, the key-off signal KOF is supplied to No.1-No.3 channels of the melody tone signal generating circuit 43. As a result, even if No.1-No.3 channels are generating the musical tone signals, generation of these musical tone signals is terminated by this key-off signal KOF. Thus, all of No.1-No.3 channels are initialized.

Next, in step 904, it is judged whether or not the pitch indicated by No.0 key code KC(0), i.e., the melody pitch corresponds to the chord constituent note. Herein, as described before, the CPU 62 refers to the chord constituent note table 81 based on the type data TYPE, and then the reference result is converted based on the root data ROOT such that the chord constituent notes are sequentially computed. Then, the above-mentioned judgement is made by comparing No.0 key code KC(0) with the computed chord constituent note.

Now, if the performed melody tone is not the chord constituent note, the judgement of step 904 turns to "NO" so that the processing branches to step 916 wherein No.0 key code KC(0), No.0 tone color data TC(0), No.0 tone volume data VOL(0) and key-on signal KON are supplied to No.0 channel. In accordance with the receipt of the key-on signal, No.0 channel starts to form the musical tone signal, which is then equally fed to the output lines L, C, R. In this case, the pitch of the musical tone signal is controlled by No.0 key code KC(0) so that it is set identical to the performed melody pitch; the tone color is controlled by No.0 tone color data TC(0) so that it is set identical to the tone color of flute; and the tone volume is controlled by No.0 tone volume data VOL(0) so that it is set corresponding to the key touch (i.e., touch data TCH) of the performed melody key. The musical tone signal fed to the output lines L, C, R is supplied to the speakers 45*a*–45*c* via the output circuit 44. Thus, the speakers 45*a*–45*c* generate the melody tone in the tone color of flute.

After executing the above-mentioned process of step 916, the processing proceeds to step 918 wherein the beat count data BTCNT is initialized to "0". Then, execution of the mode corresponding key-on routine MD7KON is completed in next step 920.

In this state, when the mode corresponding clock routine MD7CLK is read out in step 252 of the clock interrupt program, the execution thereof is started in step 930 shown in FIG. 11B. In next step 932, it is judged whether or not the increment data UP is at "−1". Herein, the increment data UP will be set at "−1" in step 910 of the mode corresponding key-on routine MD7KON (which will be described later), but this increment data UP is normally set at "0". Therefore, the judgement of step 932 turns to "NO" at this time, so that the processing branches to step 942 without executing the processes concerning the melody tone. Then, in step 944, execution of the mode corresponding clock routine MD7CLK is terminated. Incidentally, the process of step 942 (concerning No.1–No.3 additional tones) will be described later.

Figure 11C:
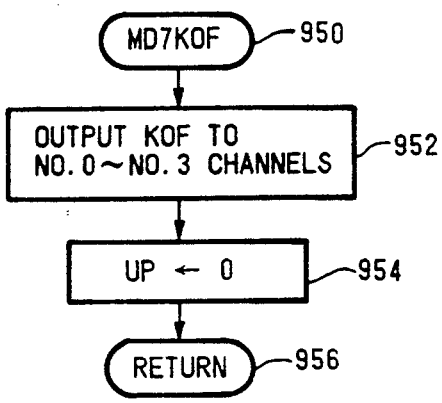

When the depressed melody key is released, the mode corresponding key-off routine MD7KOF is read out in step 234 of the key-operation event routine, and then the execution thereof is started in step 950 shown in FIG. 11C. In next step 952, the key-off signal KOF is supplied to No.0–No.3 channels. Thus, generation of the melody tone signal is terminated, and consequently the speakers 45*a*–45*c* stop generating the corresponding melody tone. After executing this process of step 952, the increment data UP is initialized to "0" in step 954. In next step 956, execution of the mode corresponding key-off routine MD7KOF is completed.

As a result, in the case where the melody tone is not the chord constituent note, the performed melody tone is generated in accordance with the performed melody key.

On the other hand, in the case where the melody tone is the chord constituent note, the judgement of step 904 turns to "YES" so that the processing proceeds to step 906 wherein chord tone flag CHDNT is inverted. More specifically, this chord tone flag CHDNT is inverted from "1" to "0", or CHDNT is inverted from "0" to "1". If this inversion results that the chord tone flag CHDNT is at "0", the judgement of step 908 turns to "NO" so that the processing branches to the foregoing step 916. In step 916, the process corresponding to the case where the performed melody tone is not the chord constituent note is to be executed. As a result, even if the performed melody tone is the chord constituent note, when the chord tone flag CHDNT is at "0", the melody tone is generated in accordance with the performance made on the melody key.

Figure 11D:
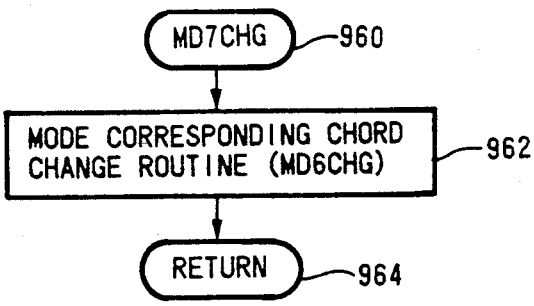
Figure 11E:
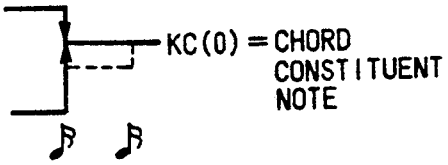
FIGS. 11E, 11F show tone-generation patterns of additional tones in 7th solo style play mode.

Meanwhile, in the case where the performed melody tone is the chord constituent note and the chord tone flag CHDNT is set at "1" due to the inversion of step 906, the judgement of step 908 turns to "YES" so that the processing proceeds to step 910 wherein the increment data UP is set at "−1". In next step 912, the key code KC(0)+UP (i.e., KC(0)−1), No.0 tone color data TC(0), tone volume data VOL(0) and key-on signal KON are supplied to No.0 channel of the melody tone signal generating circuit 43. Thus, No.0 channel forms the melody tone signal, which is then fed to the speakers 45*a*–45*c* via the output circuit 44. The speaker 45*a*–45*c* generates the melody tone corresponding to the generated melody tone signal. Herein, as shown in FIG. 11E, the pitch of the melody tone is shifted by the degree corresponding to the increment data UP from its original pitch of the depressed melody key. In the concrete, the performed melody pitch is one semitone pitch lower than the pitch of the depressed melody key.

After executing the above-mentioned process of step 912, the processing proceeds to step 914 wherein the delay count data DLYCNT is initialized to "0". In next step 918, the beat count data BTCNT is set at "0" as described before. Then, execution of the mode corresponding key-on routine MD7KON is completed in step 920.

In this case, during the execution of the mode corresponding clock routine MD7CLK, the judgement of step 932 turns to "YES" because the increment data UP is at "−1". Then, processes of steps 934, 936 will be executed. In step 934, the delay count data DLYCNT is incremented by "1". In step 936, it is judged whether or not the delay count data DLYCNT reaches "2". Until the delay count data DLYCNT reaches "2", the judgement of step 936 is "NO" so that the processing branches to step 942. Thus, until then, the melody tone whose pitch is one semitone pitch lower than its original pitch is continuously generated.

Then, when sixteenth note period or more is passed after the melody-key-depression timing, the delay count data DLYCNT is incremented again in step 934. Thereafter, when the delay count data DLYCNT reaches "2", the judgement of step 936 turns to "YES" so that the processing proceeds to step 938 wherein the increment data UP is set at "0". In next step 940, No.0 key code KC(0) indicative of the performed melody pitch is supplied to No.0 channel. In this case, only the pitch of the melody tone signal generated from No.0 channel is changed to its original pitch corresponding to the depressed melody key. Thus, as shown in FIG. 11E, the melody tone is generated in its original pitch. Since the increment data UP is set at "0" in step 938, the melody tone having its original pitch is continuously generated as described before. Thereafter, when the melody key is released, under execution of the mode corresponding key-off routine MD7KOF, generation of the performed melody tone is terminated.

Figure 11F:
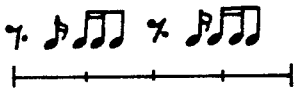

In step 918 of the mode corresponding key-on routine MD7KON shown in FIG. 11A, the beat count data BTCNT is initialized to "0" at the melody-key-depression timing. In step 942 of the mode corresponding clock routine MD7CLK shown in FIG. 11B, the mode corresponding clock routine MD6CLK according to the sixth solo style play mode is to be executed. In the mode corresponding chord change routine MD7CHG shown in FIG. 11D, the mode corresponding chord change routine MD6CHG according to the sixth solo style play mode is to be executed. Therefore, as similar to the foregoing sixth solo style play mode, when the melody key is continuously depressed by one beat period or more, No.1–No.3 additional tones are additionally generated with the melody tone in accordance with the predetermined pattern in this seventh solo style play mode. This predetermined pattern corresponding to the notes as shown in FIG. 11F.

As described heretofore, the difference against the sixth solo style play mode is that when the performed melody tone is the chord constituent note, the pitch thereof is varied by every two inversions made on the chord note flag CHDNT in the seventh solo style play mode. For this reason, it is possible to obtain the performed music full of variety and also accompanied with punch but without persistence.

In the seventh solo style play mode, the duration of the pitch variation control corresponds to sixteenth note period or so. However, it is possible to change this duration to be corresponding to another note period. Or, it is possible to change this duration based on the manual operation, tempo etc. of the automatic rhythm.

As similar to the foregoing sixth solo style play mode, it is possible to change the number of the additional tones to be generated in the seventh solo style play mode, other than "3". In addition, it is possible to provide plural kinds of tone-generation patterns for the additional tones, so that each additional tone can correspond with different tone-generation pattern.

(h) Eighth Solo Style Play Mode

In the normal condition of the eighth solo style play mode (MD=8), No.1 additional tone is added to the performed melody tone, wherein the pitch thereof is different from the melody pitch by one or some octaves. But, when the melody key is continuously depressed by the predetermined note period or more, No.1–No.3 additional tones are added to the melody tone as its accompaniment tones. This mode is designated when "Rock'n Roll 1" is designated as the rhythm kind. Herein, the accompaniment flag ABC is set at "1", and the automatic rhythm is simultaneously set in the standby state (RUN=−1). In this mode, No.0–No.3 channels are used to generate the performed melody tone and its additional tones. Further, tone color data TC(0)–TC(3) are set at the same value indicating the tone color of piano.

Figure 12A:
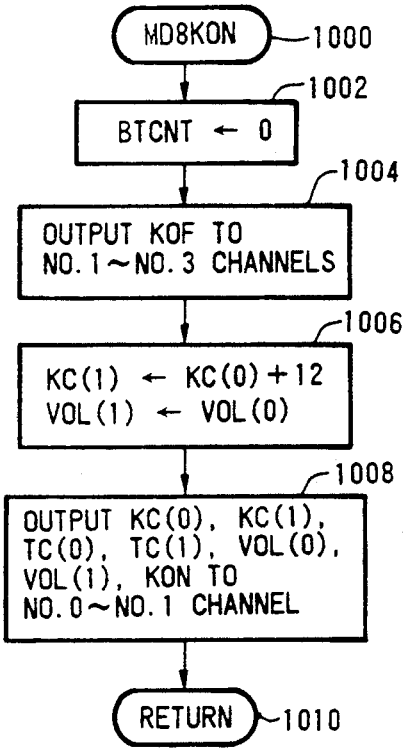

In response to the melody-key-depression event occurred on the keyboard 10, the mode corresponding key-on routine MD8KON is read out in step 230 of the key-operation event routine, and then the execution thereof is started in step 1000 shown in FIG. 12A. In next step 1002, the beat count data BTCNT is initialized to "0". In step 1004, the key-off signal KOF is supplied to No.1–No.3 channels of the melody tone signal generating circuit 43. As a result, generation of the musical tone signals in No.1–No.3 channels is terminated in response to this key-off signal. Thus, all of No.1–No.3 channels are initialized. Next, in step 1006, No.1 key code KC(1) is rewritten by the key code KC(0)+12 whose pitch is one octave higher than that of key code KC(0). In addition, No.1 tone volume data VOL(1) is set identical to No.0 tone volume data VOL(0). Thereafter, in step 1008, No.0–No.1 key codes KC(0)–KC(1), tone color data TC(0)–TC(1), tone volume data VOL(0)–VOL(1) and key-on signals KON are respectively supplied to No.0–No.1 channels. Then, in next step 1010, execution of the mode corresponding key-on routine MD8KON is completed.

In response to the key-on signals, No.0–No.1 channels start to form respective musical tone signals, which are then fed to the output lines L, C, R at the same rate. In this case, the pitches of the musical tone signals are controlled by No.0–No.1 key codes KC(0)–KC(1) so that they are respectively set at the performed melody pitch and higher pitch which is one octave higher than the performed melody pitch. In addition, the tone colors are controlled by No.0–No.1 tone color data TC(0)–TC(1) so that they are set identical to the same tone color of piano; and the tone volumes are controlled by No.0–No.1 tone volume data VOL(0)–VOL(1) so that they are set corresponding to the key touch (i.e., touch data TCH) of the depressed melody key. The musical tone signals fed to the output lines L, C, R are supplied to the speakers 45*a*–45*c* via the output circuit 44. Thus, the speakers 45*a*–45*c* generate the performed melody tone and No.1 additional tone in the tone color of piano, wherein the pitch of No.1 additional tone is one octave higher than the performed melody pitch.

Figure 12B:
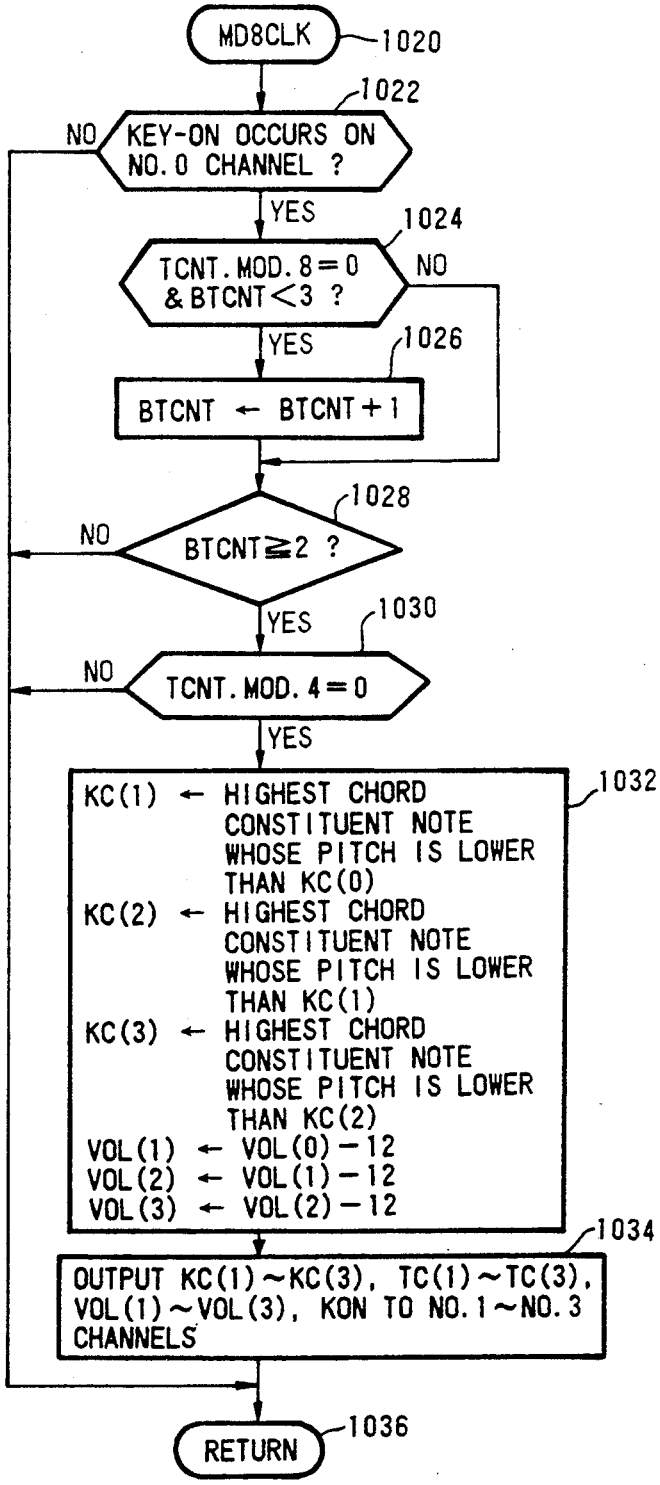

In such state, when the mode corresponding clock routine MD8CLK is read out in step 252 of the clock interrupt program, the execution thereof is started in step 1020 shown in FIG. 12B. In next step 1022, as similar to the foregoing process of step 812 of the mode corresponding clock routine MD6CLK, it is judged whether or not No.0 channel generates the musical tone signal corresponding to the depressed key. In other words, it is judged whether or not the melody key is depressed. If so, the judgement of step 1022 turns to "YES" so that processes of its succeeding steps 1024, 1026 are to be executed, as similar to the foregoing processes of steps 814, 816 of MD6CLK. More specifically, under the processes of steps 1024, 1026, the beat count data BTCNT is incremented from "0" to "3" by every beat timing (i.e., every fourth note timing), after BTCNT is initialized to "0" at the melody-key-depression timing.

Next, in step 1028, it is judged whether or not the incremented beat count data BTCNT reaches "2". If one beat period or more is not passed after the melody-key-depression timing so that the beat count data BTCNT does not reach "2", the judgement of step 1028 is "NO". Then, the processing branches to step 1036 directly, wherein execution of the mode corresponding clock routine MD8CLK is terminated.

When the depressed melody key is released, the mode corresponding key-off routine MD8KOF is read out in step 234 of the key-operation event routine, and consequently the key-release processing is carried out on the melody tone and No.1 additional tone. More specifically, execution of the mode corresponding key-off routine MD8KOF is started in step 1040. In next step 1042, the key-off signal KOF is supplied to No.0–No.3 channels. Then, in step 1044, execution of the mode corresponding key-off routine MD8KOF is completed. As a result, generation of the performed melody tone signal and No.1 additional tone signal is terminated, so that the speakers 45*a*–45*c* stop generating the melody tone and No.1 additional tone. Therefore, if the melody-key-depression period is less than one beat period so that the beat count data BTCNT does not reach "2", the performed melody tone and No.1 additional tone are generated in the same tone color of piano, wherein the pitch of No.1 additional tone is one octave higher than the melody pitch.

On the other hand, when the melody-key-depression period continues for one beat period or more, the judgement of step 1022 shown in FIG. 12B turns to "YES" so that the processing proceeds to step 1024. Then, when the beat count data BTCNT reaches "2" under the processes of steps 1024, 1026, the judgement of step 1028 turns to "YES" so that its succeeding processes of steps 1030 etc. are to be executed. Herein, the remainder obtained by dividing the tempo count data TCNT by "4" (i.e., TCNT.MOD.4) is calculated. In step 1030, it is judged whether or not the calculated remainder is equal to "0". This judgement is made in order to judge whether or not the timing indicated by TCNT is the eighth note timing. If not, the judgement of step 1030 turns to "NO" so that execution of the mode corresponding clock routine MD8CLK is terminated in step 1036 without executing any processes for controlling the generation of No.1–No.3 additional tones.

On the other hand, when the timing indicated by TCNT corresponds to the eighth note timing (i.e., TCNT.MOD.4=0), the judgement of step 1030 turns to "YES" so that the processing proceeds to step 1032. In step 1032, No.1–No.3 key codes KC(1)–KC(3) indicative of the pitches of No.1–No.3 additional tones are set equal to the key codes respectively indicating the pitches of first, second and third chord constituent notes, all of which are lower than the melody pitch. The pitches of first, second and third constituent notes are disposed in pitch-descending order. Roughly similar to the foregoing process of step 826 of the mode corresponding clock routine MD6CLK, the above-mentioned No.1–No.3 key codes KC(1)–KC(3) are extracted by referring to the chord constituent table 81, and carrying out the data processing based on the type data TYPE and root data ROOT indicating the performed chord. In addition, step 1032 also sets No.1 tone volume data VOL(1) at VOL(0)–12; VOL(2) at VOL(-1)–12; and VOL(3) at VOL(2)–12 respectively.

After executing the above-mentioned process of step 1032, the processing proceeds to step 1034 wherein No.1–No.3 key codes KC(1)–KC(3), tone color TC(1)–TC(3), tone volume data VOL(1)–VOL(3) and key-on signals KON are respectively supplied to No.-1–No.3 channels. Thereafter, execution of the mode corresponding clock routine MD8CLK is completed in step 1036. As a result, No.1–No.3 channels start to form No.1–No.3 additional tone signals when receiving the key-on signals. Then, No.1–No.3 additional tone signals corresponding to the data KC(1)–KC(3), TC(1)–TC(3), VOL(1)–VOL(3) are fed to the speakers 45*a*–45*c* via the output circuit 44. Thus, the speakers 45*a*–45*c* simultaneously generate No.1–No.3 additional tones corresponding to three chord constituent notes whose pitches are lower than the melody pitch. These additional tones are generated in the same tone color of piano, but in the same tone volume which is 12 dB lower than the tone volume of the performed melody tone.

As long as the melody key is depressed, the processes of steps 1032, 1034 are executed by every eighth note timing. Therefore, No.1–No.3 additional tones are sounded like the backing of the performed melody tone by every eighth note timing.

When the melody key is released during generation of No.1–No.3 additional tones, generation of the musical tones in No.0–No.3 channels is terminated in step 1042 of the mode corresponding key-off routine MD8KOF shown in FIG. 12C. In this case, generation of all of the melody tone, No.1–No.3 additional tones is terminated in response to the melody-key-release event.

Further, in response to the chord-key-depression event occurred on the keyboard 10, the mode corresponding chord change routine MD8CHG is read out in step 218 of the key-operation event routine, and then the execution thereof is started in step 1050 shown in FIG. 12D. Then, processes of steps 1052, 1054 will be executed. Thereafter, in step 1056, execution of this routine MD8CHG is completed. More specifically, in step 1052, as similar to the foregoing step 1032, No.-1–No.3 key codes KC(1)–KC(3) are renewed. In step 1054, such renewed key codes KC(1)–KC(3) are supplied to No.1–No.3 channels of the melody tone signal generating circuit 43. Thus, during the generation of No.1–No.3 additional tone signals in No.1–No.3 channels, the pitches of No.1–No.3 additional tone signals are changed in response to No.1–No.3 key codes KC(1)–KC(3) respectively. Thus, the pitches of No.-1–No.3 additional tones generated from the speakers 45*a*–45*c* are changed in response to the chord change.

As described heretofore, under the normal condition of the eighth solo style play mode, the melody tone is added with No.1 additional tone whose pitch is one octave higher than the melody pitch. If the melody key is continuously depressed for one beat period or more, No.1 additional tone is replaced by plural chord constituent notes, whose pitches are lower than the melody pitch, but which are sequentially added to the melody tone by every eighth note timing. Thus, even if the melody performance is monotonous, it is possible to obtain the performed music full of variety as a whole. Such additional tone is generated in the tone color of piano and the tone volume which is slightly lower than that of the melody tone. Therefore, it is possible to obtain the music to be sounded like Rock'n Roll, for example.

In the present eighth solo style play mode, the number of the additional tones (i.e., chord constituent notes) which are generated by every eighth note timing is set at "3", and the melody tone is added with only one additional tone whose pitch is different from the melody pitch by one or more octaves. However, it is possible to change such number of additional tones.

(i) Ninth Solo Style Play Mode

The ninth solo style play mode (MD=9) is the mode wherein when the melody performance is carried out in accordance with the predetermined pattern, the glissando tone according to such predetermined pattern is added to the performed melody tone as the additional tone. This mode is designated when "Rock'n Roll 2" (which is different from the foregoing "Rock'n Roll 1" described in the eighth solo style play mode) is designated as the rhythm kind. Herein, the automatic rhythm is simultaneously set in the standby state. In this mode, No.0–No.6 channels are used to generate the additional tones and melody tone corresponding to the depressed key. In addition, No.0–No.6 tone color data TC(0)–TC(6) are all set at the value indicating the tone color of piano.

In response to the melody-key-depression event occurred on the keyboard 10, the mode corresponding key-on routine MD9KON is read out in step 230 of the key-operation event routine, and then the execution thereof is started in step 1100 shown in FIG. 13A. In next step 1102, it is judged whether or not glissando mode data GLSMD is at "0". The glissando mode data GLSMD at "0" level indicates that the glissando is not effected on the melody tone; GLSMD at "1" level indicates that the glissando is effected on the melody tones concerning white keys; GLSMD at "2" level indicates that the glissando is effected on the melody tones concerning black keys; and GLSMD at "3" level indicates that the glissando is effected on the melody tones concerning both of white and black keys. Herein, natural sounds are generated by performing the white keys, while un-natural sounds (such as sharp or flat sounds) are generated by performing the black keys in the keyboard 10. If this glissando mode data GLSMD is at "0", the judgement of step 1102 turns to "YES" so that the processing branches to step 1108. On the other hand, if the glissando mode data GLSMD is at "1", "2" or "3", the judgement of 1102 is "NO" so that the processing proceeds to step 1104 wherein the glissando mode data GLSMD is initialized to "0". Then, in step 1106, the key-off signal KOF is supplied to No.1–No.6 channels of the melody tone signal generating circuit 43. As a result, generation of the musical tone signals in No.1–No.6 channels is terminated in response to the key-off signal. This processing initializes No.1–No.6 channels. Due to such initialization, in the case where the melody key is newly depressed, generation of the glissando tone is stopped even if the glissando is effected on these channels, which will be described later in detail.

Next, the processing proceeds to step 1108 wherein No.0 key code KC(0), tone color data TC(0), tone volume data VOL(0) and key-on signal KON are supplied to No.0 channel. Thus, in response to the receipt of the key-on signal KON, No.0 channel starts to form the musical tone signal, which is then equally fed to the output lines L, C, R. In this case, the pitch of the musical tone signal is controlled by No.0 key code KC(0) so that it is set identical to the performed melody pitch; the tone color is controlled by No.0 tone color data TC(0) so that it is set identical to the tone color of piano; and the tone volume is controlled by No.0 tone volume data VOL(0) so that it is set corresponding to the key touch (i.e., touch data TCH) of the depressed melody key. The musical tone signal fed to the output lines L, C, R is supplied to the speakers 45*a*–45*c* via the output circuit 44. Thus, the speakers 45*a*–45*c* generate the performed melody tone in the tone color of piano.

Next, in step 1108, No.0 key code KC(0), tone color data TC(0), tone volume data VOL(0) and key-on signal KON are supplied to No.0 channel of the melody tone signal generating circuit 43. Thus, in response to the receipt of the key-on signal KON, No.0 channel starts to form the musical tone signal, which is then equally fed to the output lines L, C, R. In this case, the pitch of the musical tone signal is controlled by No.0 key code KC(0) so that it is set identical to the performed melody pitch; the tone color is controlled by No.0 tone color data TC(0) so that it is set identical to the tone color of piano; and the tone volume is controlled by No.0 tone volume data VOL(0) so that it is set corresponding to the key touch (i.e., touch data TCH) of the depressed melody key. The musical tone signal fed to the output lines L, C, R of the melody tone signal generating circuit 43 is supplied to the speakers 45*a*–45*c* via the output circuit 44. Therefore, the speakers 45*a*–45*c* generate the performed melody tone in the tone color of piano.

After executing the above-mentioned process of step 1108, the processing proceeds to step 1110 wherein third glissando check data GLSCHK3 is renewed by second glissando check data GLSCHK2, second glissando check data GLSCHK2 is renewed by first glissando check data GLSCHK1 and first glissando check data GLSCHK1 is renewed by No.0 key code KC(0). In next step 1112, execution of the mode corresponding key-on routine MD9KON is completed. Herein, first glissando check data GLSCHK1 indicates the current pitch of the currently depressed key, second glissando check data GLSCHK2 indicates the preceding pitch and third glissando check GLSCHK3 indicates the previous pitch.

Meanwhile, when the depressed melody key is released, the mode corresponding key-off routine MD9KOF is read out in step 234 of the key-operation event routine, so that the key-release processing is carried out on the performed melody tone as described before. More specifically, execution of the mode corresponding key-off routine MD9KOF is started in step 1120 shown in FIG. 13B. In next step 1122, the key-off signal KOF is supplied to No.0 channel of the melody tone signal generating circuit 43. Then, in step 1124, execution of this routine MD9KOF is completed. As a result, generation of the musical tone signal is terminated, and consequently the speakers 45*a*–45*c* stop generating the musical tone corresponding to the performed melody key. Thus, the melody tone is generated in the tone color of piano and in accordance with the performance made on the melody key.

Figure 13D:
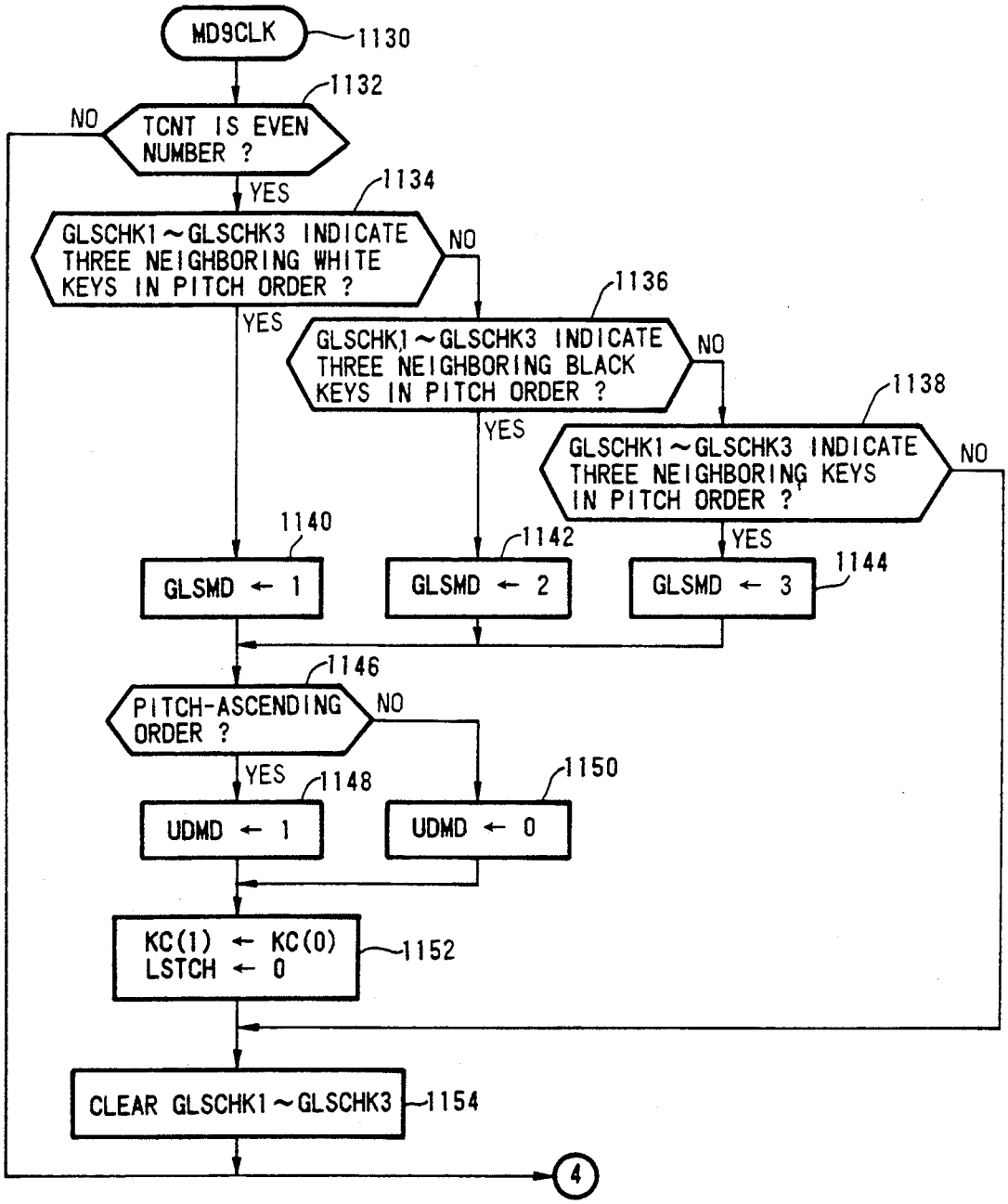

In such state, when the mode corresponding clock routine MD9CLK is read out in step 252 of the clock interrupt program, the execution thereof is started in step 1130 shown in FIG. 13D. In next step 1132, it is judged whether or not the tempo count data TCNT indicates the even number. If so, the judgement of step 1132 turns to "YES" so that its succeeding processes of steps 1134–1154 will be executed. Such processes is called melody performance pattern detecting routine. On the other hand, if the tempo count data TCNT does not indicate the even number, the judgement of step 1132 turns to "NO" so that the processing branches to step 1156 shown in FIG. 13E. Incidentally, execution of the mode corresponding clock routine MD9CLK is carried out by every thirty-second note timing. Therefore, the above-mentioned melody performance pattern detecting routine is executed by every sixteenth note timing.

In the melody performance pattern detecting routine, judgement processes of steps 1134–1138 are to be executed based on first to third glissando check data GLSCHK1–GLSCHK3. More specifically, step 1134 judges whether or not neighboring three white keys are continuously performed in pitch order; step 1136 judges whether or not neighboring three black keys are continuously performed in pitch order; and step 1138 judges whether or not neighboring three keys (including white and black keys) are continuously performed in pitch order. If the judgements of steps 1134, 1136, 1138 turn to "YES", the processing proceeds to steps 1140, 1142, 1144 wherein the glissando mode data GLSMD is set at "1", "2", "3" respectively. If all judgements of steps 1134–1138 turn to "NO", the processing branches to step 1154.

After executing the above-mentioned processes of steps 1134–1144, the processing proceeds to step 1146 wherein it is judged that the pitch order of performing the melody tones is either pitch-ascending order or pitch-descending order. In case of the pitch-ascending order, the judgement of step 1146 turns to "YES" so that the processing proceeds to step 1148 wherein an up-mode flag UPMD is set at "1". In case of the pitch-descending order, the judgement of step 1146 turns to "NO" so that the processing branches to step 1150 wherein the up-mode flag UPMD is set at "0".

After executing the above-mentioned processes of steps 1148, 1150, the processing proceeds to step 1152 wherein No.1 key code KC(1) is set identical to No.0 key code KC(0) and the last channel data LSTCH is initialized to "0". Herein, the last channel data LSTCH indicates the number of channel from which the preceding glissando tone is to be generated. During the generation of the glissando tone, this last channel data LSTCH varies from "1" to "6". After setting the glissando mode data GLSMD in steps 1140–1144, first to third glissando check data GLSCHK1–GLSCHK3 are cleared in step 1154. Thereafter, the processing proceeds to a glissando tone forming routine consisting of steps 1156–1192 shown in FIG. 13E. As described before, in the case where all judgements of steps 1134–1138 turn to "NO", the processing branches to step 1154 directly. In this case, under the process of step 1154, first to third glissando check data GLSCHK1–GLSCHK3 are cleared. In other words, these data GLSCHK1–GLSCHK3 are cleared by every sixteenth note timing at which the judgements processes of steps 1134–1138 are executed. In short, the setting of the glissando mode data GLSMD is carried out only when three keys are depressed within sixteenth note period.

Next, description will be given with respect to the glissando tone forming routine with respect to each of six cases (i)–(vi) which will be described below. First, under the processes of steps 1156–1166, the glissando pattern is determined based on the set glissando mode data GLSMD and up-mode flag UPMD. Then, under the processes of steps 1168–1178, the pitch of the glissando tone is determined.

(i) First case where both of the glissando mode data GLSMD and up-mode flag UPMD are at "1":
The judgements of steps 1156, 1162 both turn to "YES" so that the processing proceeds to step 1168 wherein based on the key code KC(LSTCH) designated by the last channel data LSTCH, the specific key code is computed. Herein, this key code corresponds to the white key neighboring the key corresponding to the key code KC(LSTCH), but its pitch is higher than that of KC(LSTCH). Then, the computed key code is stored as the temporary stored key code TKC.

(ii) Second case where the glissando mode data GLSMD is at "1" but the up-mode flag UPMD is at "0":
The judgement of step 1156 turns to "YES" but the judgement of step 1162 turns to "NO" so that the processing branches to step 1170 wherein the CPU 62 computes the key code whose pitch corresponds to the white key neighboring the key corresponding to the key code KC(LSTCH), but its pitch is lower than that of KC(LSTCH). Then, the computed key code is stored as the temporary stored key code TKC.

(iii) Third case where the glissando mode data GLSMD is at "2" but the up-mode data UPMD is at "1":
The judgements of steps 1158, 1164 both turn to "YES" so that the processing proceeds to step 1172 wherein the CPU 62 computes the key code whose pitch corresponds to the black key neighboring the key corresponding to the key code KC(LSTCH), but its pitch is higher than that of KC(LSTCH). Then, the computed key code is stored as the temporary stored key code TKC.

(iv) Fourth case where the glissando mode data GLSMD is at "2" but the up-mode flag UPMD is at "0":
The judgement of step 1158 turns to "YES" but the judgement of step 1164 turns to "NO" so that the processing branches to step 1174 wherein the CPU 62 computes the key code whose pitch corresponds to the black key neighboring the key corresponding to the key code KC(LSTCH), but its pitch is lower than that of KC(LSTCH). Then, the computed key code is stored as the temporary stored key code TKC.

(v) Fifth case where the glissando mode data GLSMD is at "3" but the up-mode flag UPMD is at "1":
The judgments of steps 1160, 1166 both turn to "YES" so that the processing proceeds to step 1176 wherein the CPU 62 computes the key code whose pitch corresponds to the key neighboring the key corresponding to the key code KC(LSTCH), but its pitch is higher than that of KC(LSTCH). Then, the computed key code is stored as the temporary stored key code TKC.

(vi) Sixth case where the glissando mode data GLSMD is at "3" but the up-mode flag UPMD is at "0":
The judgement of step 1160 turns to "YES" but the judgement of step 1166 turns to "NO" so that the processing branches to step 1178 wherein the CPU 62 computes the key code whose pitch corresponds to the key neighboring the key corresponding to the key code KC(LSTCH), but its pitch is lower than that of KC(LSTCH). Then, the computed key code is stored as the temporary stored key code TKC.

After executing the above-mentioned processes of steps 1168–1178, the processing proceeds to step 1180 wherein it is judged whether or not the value of the temporary stored key code TKC is contained in the range from "24" to "120" (i.e., $24 \leqq TKC \leqq 120$). Herein, these values "24", "120" indicate the key codes existing beyond the key area of the keyboard 10, but these values respectively indicates the key codes corresponding to the lowest and highest glissando tones. In this judgement process of step 1180, when the temporary stored key code TKC is contained in the above-mentioned range, the judgement of step 1180 turns to "YES" so that the processing proceeds to step 1182 wherein the last channel data LSTCH is incremented by "1". Then, if the incremented last channel data LSTCH exceeds "6", judgement of next step 1184 turns to "YES" so that this data LSTCH is initialized to "1" in step 1186. In other cases where the incremented last channel data LSTCH does not exceed "6", the judgement of step 1184 turns to "NO" so that the processing branches to step 1188. Thus, under the above-mentioned processes of steps 1182–1186, the last channel data LSTCH is repeatedly incremented in the range from "1" to "6".

Next, in step 1188, the key code KC(LSTCH), tone color data TC(LSTCH), tone volume data VOL(LSTCH) designated by the last channel data LSTCH are respectively set identical to the temporary stored key code TKC, tone color data TC(0), tone volume data VOL(0). In next step 1190, the set key code KC(LSTCH), set tone color data TC(LSTCH), set tone volume data VOL(LSTCH) and key-on signal KON are supplied to No.LSTCH channel of the melody tone signal generating circuit 43. Thereafter, the processing proceeds to step 1194 wherein execution of the mode corresponding clock routine MD9CLK is completed. Thus, No.LSTCH channel forms the musical tone signal corresponding to the data KC(LSTCH), TC(LSTCH), VOL(LSTCH), and then this musical tone signal is supplied to the speakers 45*a*–14*c* via the output circuit 44. Therefore, the speakers 45*a*–45*c* generate the additional tone designated by the key code KC(LSTCH) in the tone color of piano and the tone volume of the performed melody tone.

Thereafter, when the mode corresponding clock routine MD9CLK is executed again, the CPU 62 computes the key code corresponding to the key neighboring the key corresponding to the key code KC(LSTCH) based on the glissando mode data GLSMD and up-mode flag UPMD under the processes of steps 1156–1178. Then, under the processes of steps 1182–1190, the musical tone signal corresponding to the computed key code is generated in the channel designated by the incremented last channel data LSTCH, and consequently the speakers 45*a*–45*c* generate the corresponding musical tone. This mode corresponding clock routine MD9CLK is executed by every thiry-second note timing, so that the speakers 45*a*–45*c* generate the additional tone whose pitch changes in response to the key neighboring the performed melody key by every thirty-second note timing. Thus, when terminating the generation of the performed melody tone, it is possible to obtain the glissando tone which follow the preceding melody performance pattern. Incidentally, such glissando tone is continuously generated, regardless of the key-depression or key-release event occurring on the melody key.

Figure 13E:
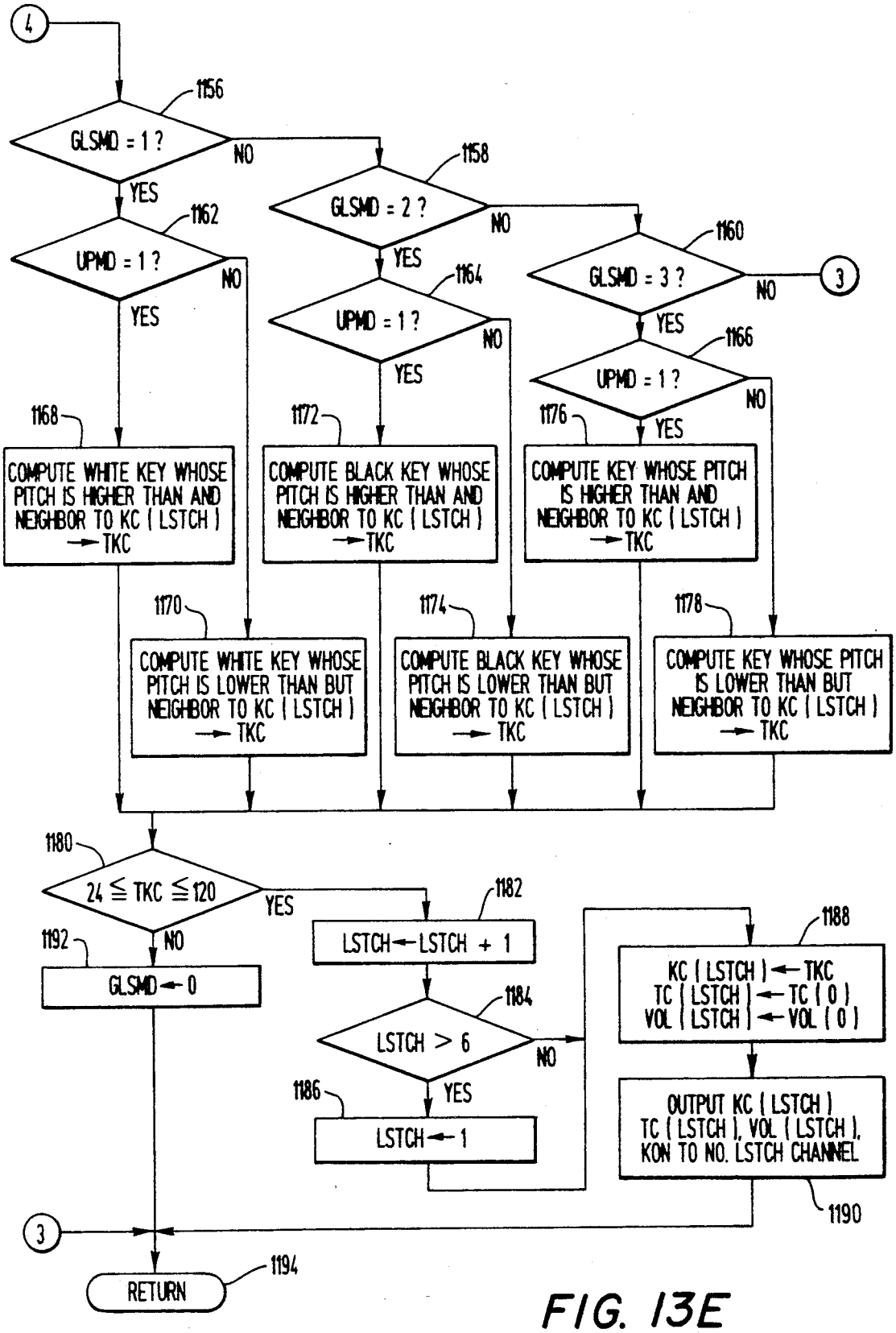

During such glissando performance, when the temporary stored key code TKC is renewed so that TKC becomes lower than "24" or larger than "120", the judgement of step 1180 shown in FIG. 13E turns to "NO" so that the processing branches to step 1192 wherein the glisssando mode data GLSMD is initialized to "0". In next step 1194, execution of the mode corresponding clock routine MD9CLK is completed. Thereafter, all of the judgements of steps 1156–1160 turn to "NO" so that the processing directly proceeds to step 1194, whereby the glissando performance is stopped. In the case where the melody-key-depression pattern does not match with the conditions described in steps 1134–1138, the glissando mode data GLSMD is maintained at "0", by which the glissando performance is canceled.

Meanwhile, when the mode corresponding chord change routine MD9CHG is read out in step 218 of the key-operation event routine, the execution thereof is started in step 1196 shown in FIG. 13C. But, in next step 1198, execution of this routine MD9CHG is terminated. Therefore, no substantial processing is carried out in this routine MD9CHG.

As described heretofore, by continuously depressing three neighboring keys within sixteenth note period, the glissando performance is automatically carried out in response to the key-depression pattern in this ninth solo style play mode. Therefore, even the beginner can enjoy performing the music with glissando with ease. Due to such glissando, people can enjoy the music like Rock'n Roll.

Incidentally, there is sixteenth note period between first timing when the tempo count data TCNT becomes the even number and second timing when TCNT becomes the even number again, under the foregoing process of step 1132 of the mode corresponding clock routine MD9CLK shown in FIG. 13D. Therefore, the ninth solo style play mode detects the melody performance pattern during such sixteenth note period. However, it is possible to detect the key-depression pattern of plural keys which occurs within sixteenth note period, regardless of the above-mentioned first and second timings. Or, it is also possible to change such sixteenth note period to another period corresponding to another note length. In addition, it is possible to change such period in connection with the manual operation or tempo of the automatic rhythm.

In this mode, the time interval between two glissando tones to be generated as the additional tones corresponds to thirty-second note length. However, it is possible to change such time interval to be corresponding to another note length. Or, it is possible to provide several kinds of time intervals, one of which is to be selected.

Further, in this mode, each of the speakers 45*a*–45*c* equally generates the glissando tone as the additional tone. However, by carrying out the pan control on some channels of the melody tone signal generating circuit 43, it is possible to move the phonic image of the glissando tone.

(j) Tenth Solo Style Play Mode

The tenth solo style play mode (MD=10) is the mode wherein when the melody key is continuously depressed for the predetermined note period or more, the performed melody tone and chord constituent notes are sounded one after another like the broken chord. This mode is designated when "Funk" is designated as the rhythm kind. Herein, the accompaniment flag ABC is set at "1" and the automatic rhythm is simultaneously set in the standby state (RUN=−1). In this mode, No.-0–No.4 channels are used to generate the melody tone and additional tones corresponding to the depressed key. In addition, No.0 tone color data TC(0) is set at the value indicating the tone color of soprano saxophone, while No.1–No.4 tone color data TC(1)–TC(4) are set at another value indicating the tone color of trumpet. The pattern data storing portion 95 of the solo style play control data table 90 stores two kinds of pattern data each corresponding to notes within one bar as shown in FIG. 14E by each of No.1–No.4 channels. The pattern data is designated by the mode data MD(=10) and bar data BAR(=0, 1). In addition, the pattern data storing portion 95 stores the key-on event data, key-off event data and no-operation data at respective addresses designated by address data ADRS(=0−31) by each channel.

Figure 14A:
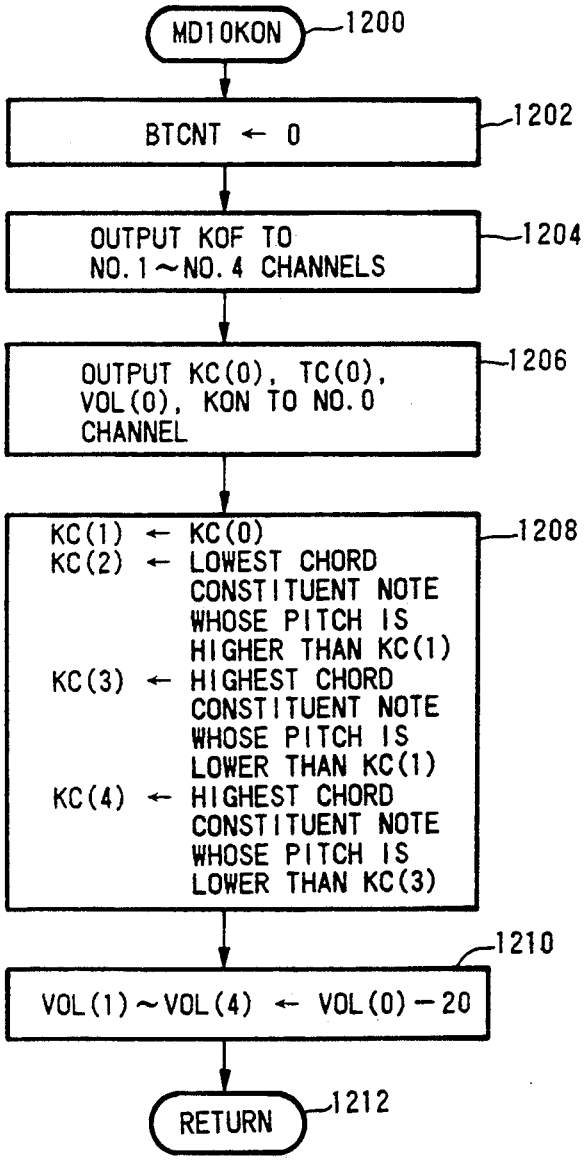
FIGS. 14A–14D are flowcharts showing sub-programs used in 10th solo style play mode.
Figures 14B, 14E:
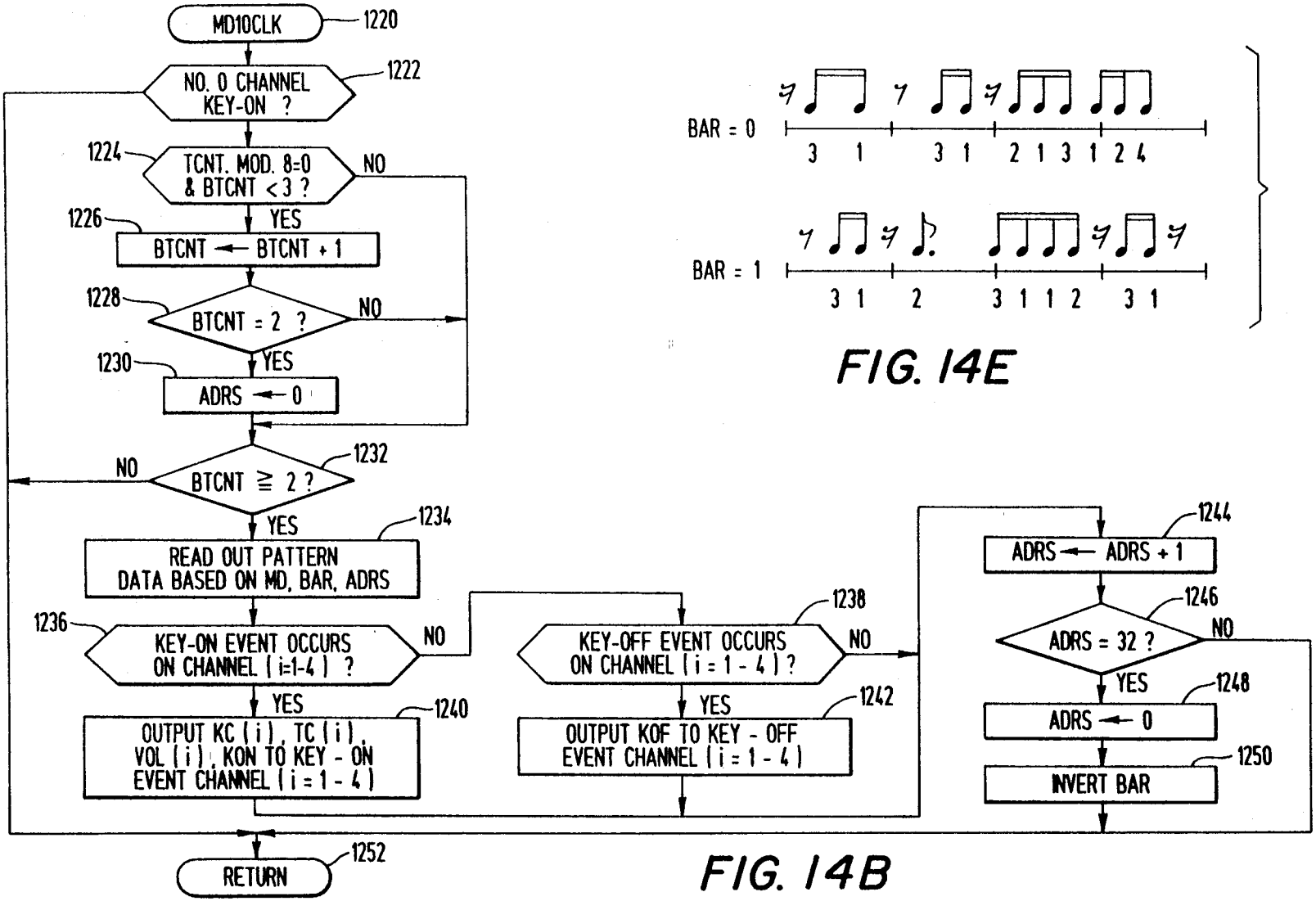
FIG. 14E shows a tone-generation pattern of additional tones in 10th solo style play mode.

In response to the melody-key-depression event occurred on the keyboard 10, the mode corresponding key-on routine MD10KON is read out in step 230 of the key-operation event routine, and the execution thereof is started in step 1200 shown in FIG. 14A. In next step 1202, the beat count data BTCNT is initialized to "0". In step 1204, the key-off signal KOF is supplied to No.-1-No.4 channels of the melody tone signal generating circuit 43. As a result, No.1-No.4 channels terminate generation of the musical tone signals, by which No.-1-No.4 channels are initialized. In step 1206, No.0 key code KC(0), tone color data TC(0), tone volume data VOL(0) and key-on signal KON are supplied to No.0 channel of the melody tone signal generating circuit 43.

In response to the receipt of the key-on signal KON, No.0 channel starts to form the musical tone signal, which is then fed to the output lines L, C, R at the same rate. In this case, the pitch of the musical tone signal is controlled by No.0 key code KC(0) so that it is set identical to the performed melody pitch; the tone color is controlled by No.0 tone color data TC(0) so that it is set identical to the tone color of soprano saxophone; and the tone volume is controlled by No.0 tone volume data VOL(0) so that it is set corresponding to the key touch (i.e., touch data TCH) of the depressed melody key. The musical tone signal fed to the output lines L, C, R of the melody tone signal generating circuit 43 is supplied to the speakers 45*a*-45*c* via the output circuit 44. Thus, the speakers 45*a*-45*c* generate the melody tone in the tone color of soprano saxophone.

After executing the above-mentioned process of step 1206, the processing proceeds to step 1208 wherein No.1 key code KC(1) indicative of the pitch of No.1 additional tone is set identical to No.0 key code KC(0) indicative of the melody pitch; No.2 key code KC(2) indicative of the pitch of No.2 additional tone is set corresponding to the lowest chord constituent note whose pitch is higher than that of No.1 key code KC(1); No.3 key code KC(3) indicative of the pitch of No.3 additional tone is set corresponding to the highest chord constituent note whose pitch is lower than that of No.1 key code KC(1); and No.4 key code KC(4) indicative of the pitch of No.4 additional tone is set corresponding to the highest chord constituent note whose pitch is lower than that of No.3 key code KC(3). At this stage of setting No.2-No.4 key codes KC(2)-KC(4), the CPU 62 refers to the chord constituent note table 81 based on the type data TYPE, and the reference result is converted into the chord constituent notes based on the root data ROOT. Then, searching operation corresponding to the No.1, No.3key codes KC(1), KC(3) is carried out on such chord constituent notes. After executing the process of step 1208, the processing proceeds to step 1210 wherein No.1-No.4 tone volume data VOL(1)-VOL(4) are all set at the tone volume indicated by "VOL(0)-20" which is 20 dB lower than the melody tone volume. Then, execution of the mode corresponding key-on routine MD10KON is completed in step 1212.

In such state, when the mode corresponding clock routine MD10CLK is read out in step 252 of the clock interrupt program, the execution thereof is started in step 1220 shown in FIG. 14B. In next step 1222, as similar to the foregoing step 812 of the mode corresponding clock routine MD6CLK shown in FIG. 10B, it is judged whether or not No.0 channel generates the musical tone signal corresponding to the key-on event. In other words, it is judged whether or not the melody key is depressed. If the melody key is depressed, the judgement of step 1222 turns to "YES" so that processes of steps 1224, 1226 will be executed as similar to the foregoing steps 814, 816 of MD6CLK shown in FIG. 10B. In the concrete, the beat count data BTCNT is incremented by "1" from "0" to "3" by every beat timing (i.e., every fourth note timing), wherein BTCNT has been set at "0" at the melody-key-depression timing under the foregoing process of step 804 shown in FIG. 10A.

After executing the above-mentioned processes of steps 1224, 1226, the processing proceeds to step 1228 wherein it is judged whether or not the incremented beat count data BTCNT reaches "2". In step 1232, it is judged whether or not the incremented beat count data BTCNT is equal to or larger than "2". If one beat period or more is not passed after the melody-key-depression timing so that the beat count data BTCNT is smaller than "2", the judgements of steps 1228, 1232 both turn to "NO". Then, the processing directly branches to step 1252 wherein execution of the mode corresponding clock routine MD10CLK is terminated.

Then, when the depressed melody key is released, the mode corresponding key-off routine MD10KOF is read out in step 234 of the key-operation event routine, and consequently the melody-key-release processing is executed with respect to the released melody key. More specifically, execution of the mode corresponding key-off routine MD10KOF is started in step 1260 shown in FIG. 14C. In next step 1262, the key-off signal KOF is supplied to No.0-No.4 channels. Thereafter, execution of the mode corresponding key-off routine MD10KOF is completed in step 1264. As a result, these channels stop generating the musical tone signals, by which the speakers 45*a*-45*c* stop generating the corresponding musical tones. Thus, when the melody-key-depression period is less than one beat period so that the beat count data BTCNT does not reach "2", only the melody tone corresponding to the depressed melody key is sounded in the tone color of soprano saxophone.

On the other hand, when the melody-key-depression continues for one beat period or more, the judgement of step 1222 turns to "YES". Then, when the beat count data BTCNT reaches "2" under the processes of steps 1224, 1226, the judgement of step 1228 turns to "YES" so that the processing proceeds to step 1230 wherein the address data ADRS is initialized to "0". The judgement of next step 1232 also turns to "YES" so that its succeeding processes of steps 1234 etc. will be executed. More specifically, in step 1234, the CPU 62 refers to the pattern data storing portion 95 to thereby read out the pattern data designated by the mode data MD(=10), bar data BAR(=0, 1) by each of No.1-No.4 channels, wherein the pattern data have the timings designated by the address data ADRS. Thereafter, with respect to each of No.1-No.4 channels, step 1236 judges whether or not the read pattern data corresponds to the key-on event data, and then step 1238 judges whether or not the read pattern data corresponds to the key-off event data.

Now, if the pattern data concerning No.i (where i=1 to 4) channel is the key-on event data, the judgement of step 1236 turns to "YES" so that the processing proceeds to step 1240 wherein No.i key code KC(i), tone color data TC(i), tone volume data VOL(i) and key-on signal KON are supplied to No.i channel of the melody tone signal generating circuit 43. Thereafter, the processing proceeds to step 1244. As a result, in response to the key-on signal KON, No.i channel starts to form No.i additional tone signal, which is then fed to the speakers 45*a*-45*c* via the output circuit 44. This No.i additional tone signal corresponds to the data KC(i), TC(i), VOL(i). Thus, the speakers 45*a*-45*c* generate the corresponding additional tone in the tone color of trumpet and the tone volume which is 20 dB lower than that of the performed melody tone.

If the pattern data concerning No.i channel which is read out under the process of step 1234 is the key-off event data, the judgement of step 1236 turns to "NO" and then the judgement of step 1238 turns to "YES" so that the processing proceeds to step 1242. In step 1242, the key-off signal KOF is supplied to No.i channel. Thereafter, the processing proceeds to step 1244. Thus, No.i channel stops generating No.i additional tone signal, and consequently the speakers 45*a*–45*c* stops generating No.i additional tone. Further, if all pattern data for No.1–No.4 have the no-operation data, the judgements of steps 1236, 1238 both turn to "NO", so that the processing proceeds to step 1244 without executing any tone-generation control processing on the additional tone.

In step 1244, the address data ADRS is incremented by "1". In step 1246, it is judged whether or not the incremented address data ADRS reaches "32". If not, the judgement of step 1246 turns to "NO" so that the processing directly branches to step 1252 wherein execution of the mode corresponding clock routine MD10CLK is terminated. When ADRS reaches "32", the judgement of step 1246 turns to "YES" so that ADRS is initialized to "0" in step 1248. In step 1250, the bar data BAR is inverted from "1" to "0" or from "0" to "1". Thereafter, execution of this routine MD10CLK is completed in step 1252. Under the processes of steps 1244–1250, the address data ADRS is incremented by every thirty-second note timing from "0" to "31". In addition, the bar data BAR is inverted every time one bar period is passed.

As a result, in the case where the melody key is continuously depressed for one beat period or more, No.1–No.4 additional tones are sounded in accordance with two patterns as shown in FIG. 14E, each of which is alternatively sounded like the broken chord. In FIG. 14E, numbers like 3, 1, 3, . . . described in lower columns indicate the channel numbers. Herein, the readout timing of the pattern data in step 1234 corresponds to the address data ADRS. In addition, this address data ADRS is initialized to "0" under the process of step 1230 when it is detected that the melody key is continuously depressed for one beat period or more. Thus, the pattern of generating the additional tones as shown in FIG. 14E should be always started from its head part.

Figure 14C:
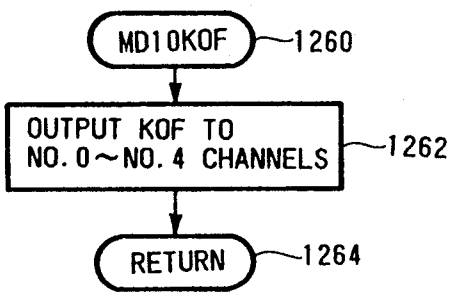

During generation of above-mentioned additional tones, when the melody key is released, generation of all musical tone signals in No.0–No.4 channels is terminated in the foregoing step 1262 of the mode corresponding key-off routine MD10KOF shown in FIG. 14C as described before. In this melody-key-release event, generation of all of the melody tone and additional tones is terminated.

Figure 14D:
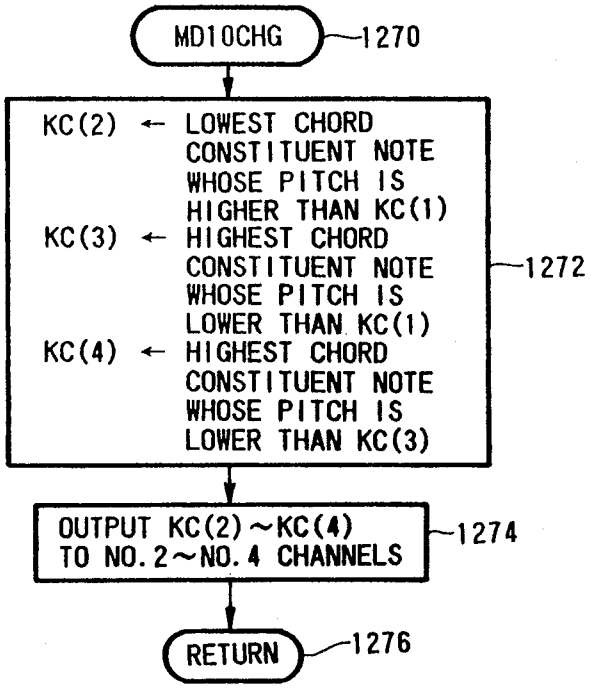

Further, in response to the chord-key-depression event occurred on the keyboard 10, the mode corresponding chord change routine MD10CHG is read out in step 218 of the key-operation event routine, and then the execution thereof is started in step 1270 shown in FIG. 14D. In next step 1272, as similar to the foregoing process of step 1208 shown in FIG. 14A, No.2–No.4 key codes are renewed in response to the chord change. In step 1274, renewed No.2–No.4 key codes KC(2)–KC(4) are respectively supplied to No.2–No.4 channels. Thus, during the generation of No.2–No.4 additional tone signals in No.2–No.4 channels, the pitches thereof are changed in response to the key codes KC(2)–KC(4). Therefore, No.2–No.4 additional tones sounded from the speakers 45*a*–45*c* are changed in response to the chord change.

As described heretofore, when the melody key is continuously depressed for one beat period or more in the tenth solo style play mode, plural additional tones are generated in accordance with the predetermined pattern such that they are added to the melody tone like the broken chord. Therefore, even if the melody performance is monotonous, it is possible to obtain the performed music full of variety as a whole. Such additional tone is generated in the tone color of trumpet and the tone volume which is lower than that of the performed melody tone. By selecting desirable tone-generation patter for the additional tones, it is possible to obtain the music which is sounded like funk-brass play.

Incidentally, in the present tenth solo style play mode, the number of additional tones is set at "4". However, it is possible to change such number of additional tones. In addition, the present tenth mode provides two tone-generation patters for the additional tones, wherein each of two patterns is alternatively used so that the variation can be applied to the additional tones. However, it is possible to provide three or more patterns for the additional tones. Or, it is possible to provide only one pattern for the additional tones, by which its storage capacity can be reduced.

(k) Eleventh Solo Style Play Mode

The eleventh solo style play mode (MD=11) is the mode wherein the performed melody tone is added with plural additional tones having the predetermined degree relation thereto. In addition, when the melody key is continuously depressed for the predetermined note period or more, the tone volumes of the melody tone and additional tone are varied in lapse of time. This mode is designated when "fanfare" is designated as the rhythm kind, for example. Herein, the automatic rhythm is simultaneously set in the standby state (RUN=−1). Further, this mode utilizes No.0–No.3 channels for generating the melody tone and additional tones corresponding to the key-depression event. The tone color data TC(0), TC(1) concerning No.0, No.1 channels are both set at the same value indicating the tone color of trumpet; tone color data TC(2) concerning No.2 channel is set at the value indicating the tone color of horn; and tone color data TC(3) concerning No.3 channel is set at the value indicating the tone color of trombone.

Figures 15A, 15C, 15D, 15E:
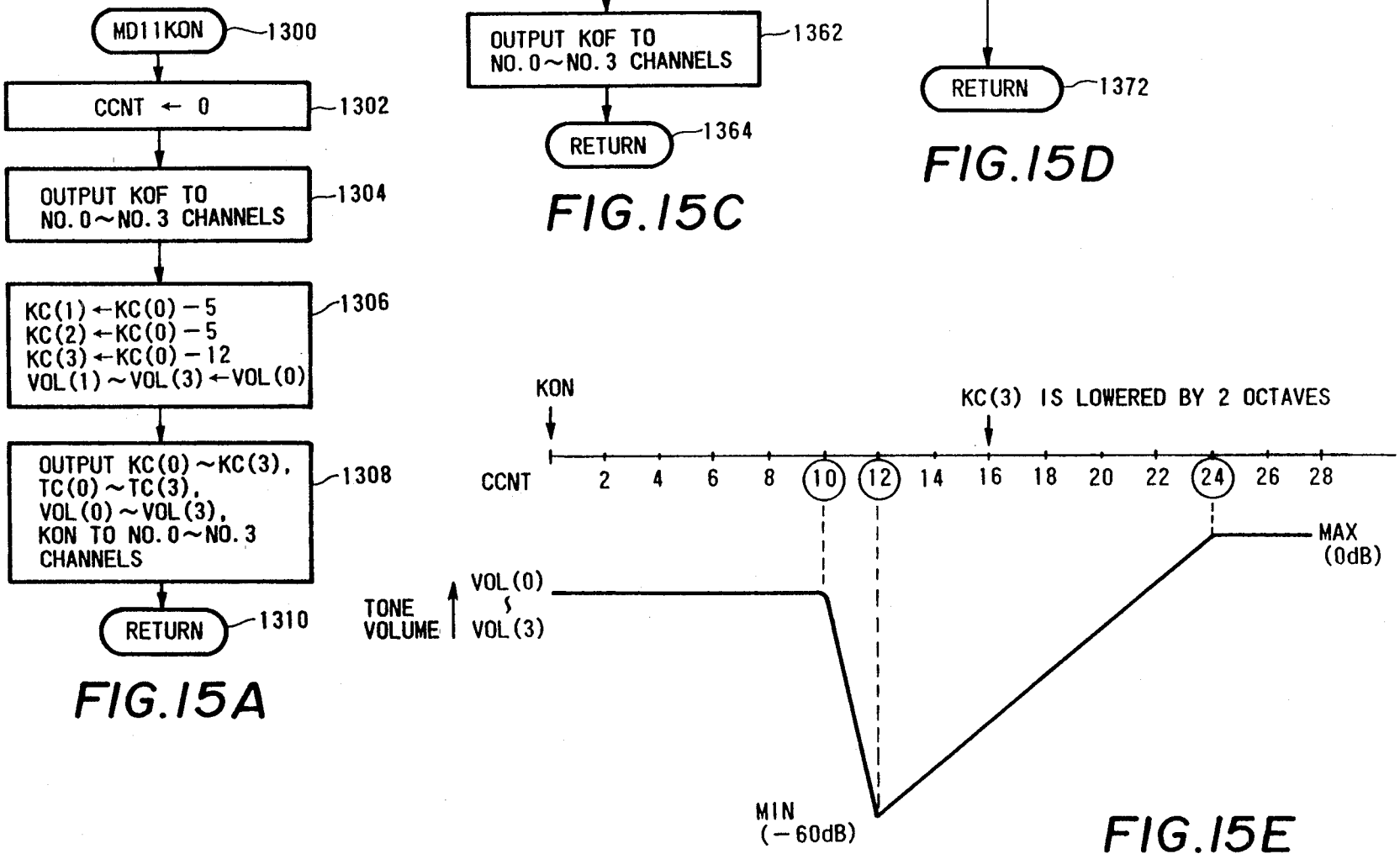
FIGS. 15A–15D are flowcharts showing sub-programs used in 11th solo style play mode.
FIG. 15E shows a tone-generation pattern of additional tones in 11th solo style play mode.

In response to the melody-key-depression event occurred on the keyboard 10, the mode corresponding key-on routine MD11KON is read out in step 230 of the key-operation event routine, and then the execution thereof is started in step 1300 shown in FIG. 15A. In next step 1302, clock count data CCNT is initialized to "0". Herein, this clock count data CCNT counts the tempo clock signal TCLK, hence, it is incremented by every thirty-second note timing. Next, in step 1304, the key-off signal KOF is supplied to No.0–No.3 channels. As a result, No.0–No.3 channels stop generating the musical tone signals. In other words, all of No.0–No.3 channels are initialized.

After executing the above-mentioned process of step 1304, the processing proceeds to step 1306 wherein both of No.1, No.2 key codes KC(1), KC(2) concerning No.1, No.2 additional tones are set identical to the same key code "KC(0)−5" whose pitch is 4 degrees lower than the melody pitch (i.e., KC(0)). In addition, No.3 key code KC(3) concerning No.3 additional tone is set identical to "KC(0)−12" whose pitch is one octave lower than the melody pitch. Further, No.1–No.3 tone volume data VOL(1)–VOL(3) are all set equal to No.0 tone volume data VOL(0) indicative of the tone volume of the melody tone. Then, in step 1308, No.0–No.3 key codes KC(0)–KC(3), TC(0)–TC(3), VOL(0)–VOL(3) and key-on signals are respectively supplied to No.-0–No.3 channels of the melody tone signal generating circuit 43. Thereafter, execution of the mode corresponding key-on routine MD11KON is completed in step 1310.

In response to the receipt of the key-on signals, No.-0–No.3 channels start to form the musical tone signals, which are equally fed to the output lines L, C, R. In this case, the pitches of the musical tone signals are controlled by No.0–No.3 key codes KC(0)–KC(3) so that they are respectively set identical to the performed melody pitch, another pitch which is 4 degrees lower than the melody pitch and still another pitch which is one octave lower than the melody pitch (see step 1306 shown in FIG. 15A). In addition, the tone colors are controlled by No.0–No.3 tone color data TC(0)–TC(3) so that they are respectively set identical to the tone colors of trumpet, horn and trombone; and the tone volumes are controlled by No.0–No.3 tone volume data VOL(0)–VOL(3) so that they are set at the same tone volume corresponding to the key touch (i.e., touch data TCH) of the depressed melody key. The musical tone signals fed to the output lines L, C, R of the melody tone signal generating circuit 43 are supplied to the speakers 45*a*–45*c* via the output circuit 44. Thus, the speakers 45*a*–45*c* generate the melody tone and three additional tones in the tone colors of trumpet, horn and trombone respectively.

Figure 15B:
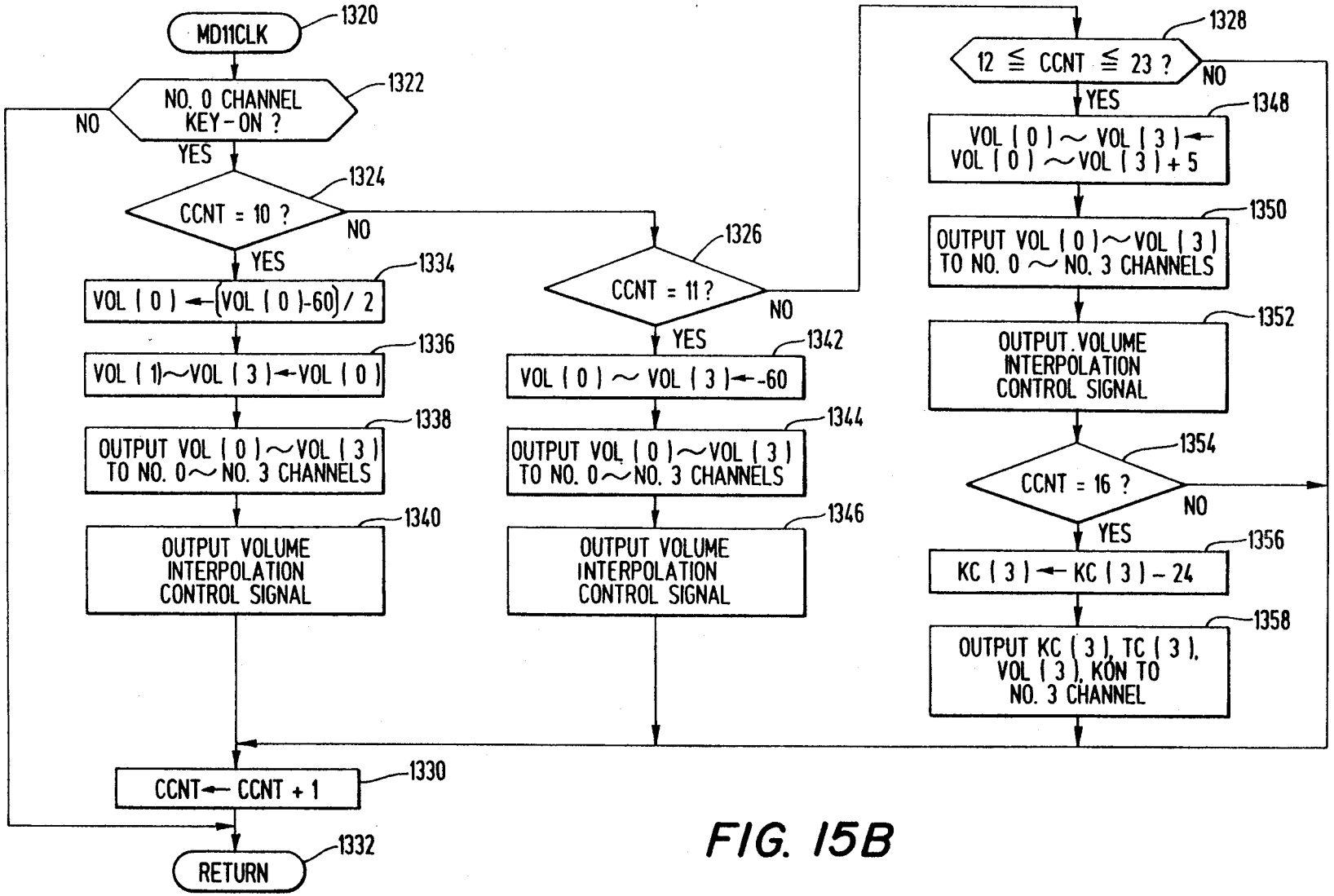

In such state, when the mode corresponding clock routine MD11CLK is read out in step 252 of the clock interrupt program, the execution thereof is started in step 1320 shown in FIG. 15B. In next step 1322, it is judged whether or not No.0 channel generates the musical tone signal corresponding to the key-on event. In other words, it is judged whether or not the melody key is depressed. This judgement is carried out based on the key switch data in the switch data storing portion within the working memory 63. If the melody key is depressed, the judgement of step 1322 turns to "YES". In this case, its succeeding judgement processes of steps 1324–1328 are executed, wherein it is judged whether or not the clock count data CCNT is at "10", "11", "12" to "23". At this time, under the foregoing process of step 1302, this clock count data CCNT is initialized to "0". Therefore, the judgements of steps 1324–1328 all turns to "NO" so that the processing branches to step 1330 directly, wherein the clock count data CCNT is added with "1". Thereafter, execution of the mode corresponding clock routine MD11CLK is terminated in step 1332. Therefore, as long as the melody key is continuously depressed, the clock count data CCNT is incremented by "1" every time this routine MD11CLK is executed.

During the above-mentioned increment of the clock count data CCNT, all of the judgements of steps 1324–1328 turn to "NO" so that no control is made on the musical tone signal, until the incremented CCNT reaches "10". Thus, until then, generation of the melody tone and No.1–No.3 additional tones which is started at the melody-key-depression timing is continued as it is. Therefore, as shown in FIG. 15E, the tone volume is maintained at its original volume which is determined when depressing the melody key.

Then, when ten periods each corresponding to thirty-second note (hereinafter, each period will be referred to as 32-note period) are passed so that the clock count data CCNT reaches "10", the judgement of step 1322 turns to "YES" so that the processing proceeds to step 1324 wherein No.0 tone volume data VOL(0) is set at "[VOL(0)-60]/2". Then, in step 1336, all of No.1–No.3 tone volume data VOL(0)–VOL(3) are set equal to this renewed No.0 tone volume data VOL(0). In next step 1338, renewed No.0–No.3 tone volume data VOL(-0)–VOL(3) are respectively supplied to No.0–No.3 channels. In step 1340, a volume interpolation control signal is supplied to the melody tone signal generating circuit 43. As a result, No.0–No.3 channels interpolate their tone volume data by the rate corresponding to the difference between the preceding tone volume data VOL and new tone volume data (VOL-60)/2. Then, based on the interpolated tone volume data, the tone volume of the musical tone signal is controlled. Thus, the tone volume is continuously but rapidly decreased, so that the musical tones fade away.

Thereafter, when the mode corresponding clock routine MD11CLK is executed again, the clock count data CCNT reaches "11" so that the judgement of step 1326 turns to "YES". Then, the processing proceeds to step 1342 wherein No.0–No.3 tone volume data VOL(-0)–VOL(3) are all renewed to the value corresponding to −60 dB. In step 1344, such renewed No.0–No.3 tone volume data VOL(0)–VOL(3) are respectively supplied to No.0–No.3 channels. In next step 1346, the volume interpolation control signal is supplied to the melody tone signal generating circuit 43. As a result, No.0–No.3 channels interpolates their tone volume data by the rate corresponding to the difference between the preceding tone volume data (VOL−60) and new tone volume data "−60". Based on the interpolated tone volume data, the tone volume of the musical tone signal is controlled. Therefore, the tone volume is continuously but rapidly decreased.

As a result, under the above-mentioned processes of steps 1324, 1326, 1334–1346, the tone volume of the performed melody tone, No.1–No.3 additional tones to be sounded from the speakers 45*a*–45*c* is continuously and rapidly decreased to "−60 dB" (indicated by "MIN" shown in FIG. 15E) between tenth 32-note timings (i.e., CCNT=10) and twelfth 32-note timings (i.e., CCNT=12) after the melody-key-depression timing.

Thereafter, every time the mode corresponding clock routine MD11CLK is executed, the clock count data CCNT is further incremented from "11". Then, as long as the melody key is continuously depressed so that the judgement of step 1322 is "YES", step 1328 judges whether or not the clock count data CCNT is contained in the range of "12"–"23". If 12≦CCNT≦23 is detected, the judgement of step 1328 turns to "YES" so that the processing proceeds to step 1348 wherein No.-0–No.3 tone volume data are increased by 5 dB so that "VOL(0)–VOL(3)+5" are set as new No.0–No.3 tone volume data VOL(0)–VOL(3). In step 1350, such new No.0–No.3 tone volume data VOL(0)–VOL(3) are respectively supplied to NO.0–No.3 channels of the melody tone signal generating circuit 43. In step 1352, the volume interpolation control signal is supplied to the melody tone signal generating circuit 43. As a result, the tone volume data is interpolated by the rate corresponding to the difference between the preceding tone volume data VOL and new tone volume data VOL+5. Then, No.0–No.3 channels control the tone volume of their musical tone signals based on the interpolated tone volume data. Thus, the tone volume is continuously but slowly increased. Under the above-mentioned tone volume variation control, the tone volume of the performed melody tone and additional tones is smoothly increased in accordance with the clock count data CCNT as shown in FIG. 15E.

When the clock data CCNT reaches "24", the judgement of step 1328 turns to "NO", so that the above-mentioned tone volume variation control is not carried out. Therefore, the increase of the tone volume of the performed melody tone and No.1–No.3 additional tones is stopped, so that the tone volume is maintained as it is thereafter. Thus, when 24th 32-note timings (i.e., three beat periods) are passed after the melody-key-depression timing, the tone volume of the performed melody tone and No.1–No.3 additional tones is maintained at about +0 dB.

When the clock count data CCNT reaches "16" after CCNT is incremented to "12", the judgement of step 1354 turns to "YES" so that the processing proceeds to step 1356 wherein No.3 key code KC(3) is decreased by "24" corresponding to two octaves. In step 1358, such renewed No.3 key code KC(3), tone color data TC(3), tone volume data VOL(3) and key-on signal KON are supplied to NO.3 channel of the melody tone signal generating circuit 43. Thus, No.3 channel terminates the generation of No.3 additional tone signal but starts to generate new No.3 additional tone signal according to renewed key code KC(3). However, the tone color and tone volume of new No.3 additional tone signal is maintained at its preceding tone color and preceding tone volume. As a result, when sixteen 32-note periods corresponding to two beat periods are passed, No.3 additional tone having the tone color of trombone is lowered in pitch by two octaves. Thereafter, as long as the melody key is continuously depressed, this new No.3 additional tone is generated in addition to the performed melody tone, No.1, No.2 additional tones which have been continuously generated before.

In such state, when the depressed melody key is released, the mode corresponding key-off routine MD11KOF is read out in step 234 of the key-operation event routine, so that the key-release processing is carried out on the melody tone, No.1–No.3 additional tones. The execution of this mode corresponding key-off routine MD11KOF is started in step 1360 shown in FIG. 15C. In next step 1362, the key-off signal KOF is supplied to No.0–No.3 channels. Then, execution of this routine MD11KOF is completed in step 1364. As a result, generation of the melody tone signal, No.1–No.3 additional tone signals is terminated, and consequently the speakers 45*a*–45*c* stop generating the corresponding musical tones.

Incidentally, when the melody key is released as described above, the judgement of step 1322 shown in FIG. 15B turns to "NO" so that the processing directly branches to step 1332. In this case, therefore, the CPU 62 does not execute the tone volume control processing and CCNT incrementing processing consisting of steps 1324–1358.

Meanwhile, in the case where the melody-key-depression period is so short that the clock count data CCNT does not reach "24", the mode corresponding key-off routine MD11KOF as shown in FIG. 15C is executed. Thus, generation of the performed melody tone, No.1–No.3 additional tones is terminated.

Further, when the mode corresponding chord change routine MD11CHG is read out in step 218 of the key-operation event routine, the execution thereof is started in step 1370 shown in FIG. 15D. But, in next step 1372, execution of this routine MD11CHG is completed. Therefore, in this routine MD11CHG, no substantial processing is executed.

As described heretofore, in the eleventh solo style play mode, the melody tone generated in the tone color of trumpet is added with No.1 additional tone having the tone color of trumpet, No.2 additional tone having the tone color of horn and No.3 additional tone having the tone color of trombone. Herein, both of the pitches of No.1, No.2 additional tones are 4 degrees lower than the melody pitch, but the pitch of No.3 additional tone is one octave lower than the melody pitch. In addition, the tone volume of No.1–No.3 additional tones is decreased in accordance with the characteristic curve shown in FIG. 15E in lapse of time. Then, when two beat periods are passed after the melody-key-depression timing, the pitch of No.3 additional tone is lowered by two octaves. As a result, by merely carrying out the monophonic melody performance in this mode, it is possible to obtain the performed music like fanfare.

In the present eleventh solo style play mode, the number of additional tones is set at "3", and the tone volume is varied in accordance with the characteristic curve shown in FIG. 15E. However, it is possible to change such number of additional tones, and it is also possible to vary such characteristic curve.

(1) Twelfth Solo Style Play Mode

The twelfth solo style play mode (MD=12) is applied to the canon performance wherein the current melody tone which is performed in certain part of the music is added with the previous melody tone which have been previously performed in another part of the music as the additional tone (hereinafter, such previous melody tone will be referred to as ensemble melody tone). In this mode, the interval of such ensemble melody tone is varied in accordance with the relation between the currently performed chord and previously performed chord. In this case, plural chord constituent notes are sounded as the additional tones. This mode is designated when "Big Band" is designated as the rhythm kind, for example. Herein, the accompaniment flag ABC is set at "1", and the automatic rhythm is set in the operating state (RUN=−1). This mode utilizes No.0–No.5 channels to generate the additional tones and melody tone corresponding to the depressed key. No.0 tone color data TC(0) is set identical to the tone color of trumpet; No.1 tone color data TC(1) is set identical to the tone color of clarinet; No.2, No.3 tone color data TC(2), TC(3) are set identical to the same tone color of alto-saxophone; and No.4, No.5 tone color data TC(4), TC(5) are set identical to the same tone color of tenor-saxophone.

The interval data storing portion 96 in the solo style play control data table 90 stores the interval data DEG in the form of table in response to the combination of previous chord type and current chord type. This interval data DEG indicates the interval corresponding to the number of semitones from the root of the performed chord to the melody pitch. This interval data DEG is determined as described below.

(i) In the case where the previous chord type is identical to the current chord type, the interval data DEG is not varied.

(ii) In the case where the interval data DEG belongs to 3-degree-system wherein the previous chord type relates to the chord of major, minor or suspended 4th, DEG corresponding to the current chord of major is converted to "4"; DEG corresponding to the current chord of minor is converted to "3"; and DEG corresponding to the current chord of suspended 4th is converted to "5".

(iii) In the case where the interval data DEG belongs to 5-degree-system wherein the previous chord type relates to the chord of major, minor, diminished chord or augmented chord, DEG corresponding to the current chord of major or minor is converted to "7"; DEG corresponding to the current diminished chord is converted to "6"; and DEG corresponding to the current augmented chord is converted to "8".

(iv) In the case where the interval data DEG belongs to 7-degree-system wherein the previous chord type relates to the chord of major 7th or 7th, DEG corresponding to the current chord of major 7th is converted to "11"; and DEG corresponding to the current chord of 7th is converted to "10".

Incidentally, the interval data DEG can be controlled under consideration of the key setting or key judgement, by which new additional tone is always related to the note on the natural scale. FIG. 16F shows an example of the conversion of interval data DEG which is converted based on previous chord type data TTYPE and current chord type data TYPE. In the concrete, FIG. 16F relates to the chords of major 7th and minor 7th.

In the present twelfth solo style play mode, the variable data storing portion within the working memory 63 provides a melody key storing area MD12PATM for storing the melody-key-on and melody-key-off event data; a melody volume storing area MD12PATV for storing the tone volume data of the performed melody keys; and a chord storing area MD12PATC for storing the chord data indicative of the performed chords. Each of these areas MD12PATM, MD12PATV, MD12PATC have thirty-two addresses (0–31) corresponding to one bar designated by the bar data BAR, tempo count data TCNT in addition to two addresses (0, 1) corresponding to the head position of next bar. The bar data BAR turns to "0" at odd number of bars but it turns to "1" at even number of bars. More specifically, under processes of steps 1486, 1488 of the mode corresponding clock routine shown in FIG. 16D which is executed by every thirty-second note timing, the bar data BAR is inverted at bar end timing (i.e., TCNT=31).

Next, description will be given with respect to the canon performance in the twelfth solo style play mode. In this canon performance, the performance data according to the performance made on the keyboard 10 are recorded at the odd number of bar (BAR=0) and the head position of the even number of bar (i.e., BAR=1.AND.TCNT=0,1). Then, at the even number of bar (BAR=1) and the head position of the odd number of bar (BAR=0.AND.TCNT=0,1), the additional tones based on the stored performance data are reproduced. For this reason, the description of this canon performance is given in two periods: (a) performance recording period; and (b) performance reproducing period.

Figure 16A:
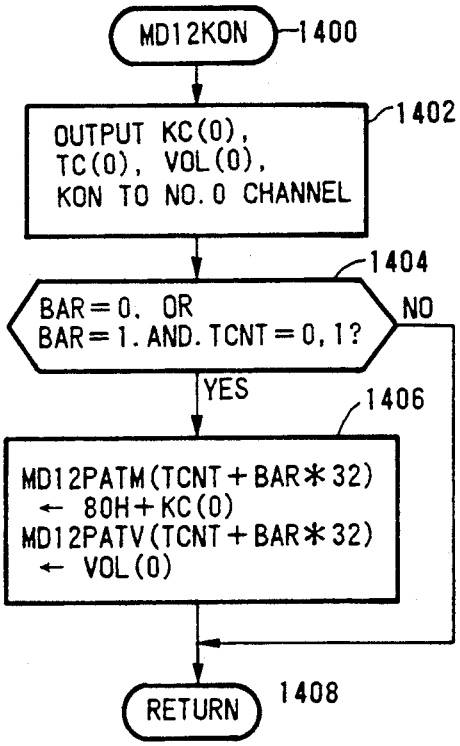
FIGS. 16A–16E are flowcharts showing sub-programs used in 12th solo style play mode.

(a) Performance Recording Period (i.e., BAR=0 or BAR=1.AND.TCNT=0,1):

In response to the melody-key-depression, the mode corresponding key-on routine MD12KON is read out in step 230 of the key-operation event routine, and the execution thereof is started in step 1400 shown in FIG. 16A. In next step 1402, No.0 key code KC(0), tone color data TC(0), tone volume data VOL(0) and key-on signal KON concerning the performed melody tone is supplied to No.0 channel of the melody tone signal generating circuit 43. In response to the receipt of the key-on signal, No.0 channel starts to form the musical tone signal, which is then equally fed to the output lines L, C, R. In this case, the pitch of the musical tone signal is controlled by No.0 key code KC(0) so that it is set identical to the melody pitch; the tone color is controlled by No.0 tone color data TC(0) so that it is set identical to the tone color of trumpet; and the tone volume is controlled by No.0 tone volume data so that it is set corresponding to the key touch (i.e., touch data TCH) of the depressed melody key. The musical tone signal fed to the output lines L, C, R are supplied to the speakers 45*a*–45*c* via the output circuit 44. Thus, the speakers 45*a*–45*c* generate the performed melody tone in the tone color of trumpet.

Next, in step 1404, it is judged whether or not the bar data BAR is at "0", or it is judged whether or not the bar data BAR is at "1" but the tempo count data TCNT is at "0" or "1". In the present performance recording period, such condition is established, so that the judgement of step 1404 turns to "YES". Then, the processing proceeds to step 1406 wherein "$80_H$+KC(0)" is stored as the key-on event data at the address designated by (TCNT+BAR*32) in the melody key storing area MD12PATM and No.0 tone volume data VOL(0) is stored at the address designated by (TCNT+BAR*32) in the melody volume storing area MD12PATV. In next step 1408, execution of the mode corresponding key-on routine MD12KON is completed. Herein, suffix "$_H$" in "$80_H$" indicates hexadecimal notation. Therefore, addition of such data "$80_H$" results that the most significant bit (MSB) will be set at "1" indicating the key-depression.

Figure 16B:
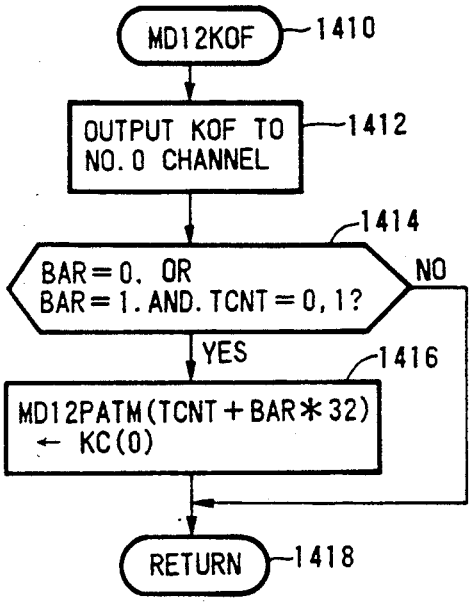
Figure 16F:
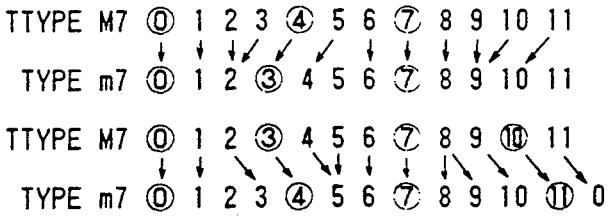
FIG. 16F is a data format of interval conversion carried out in 12th solo style play mode.

In such state, when the depressed melody key is released, the mode corresponding key-off routine MD12KOF is read out in step 234 of the key-operation event routine, and then the execution thereof is started in step 1410 shown in FIG. 16B. In next step 1412, the key-off signal KOF is supplied to No.0 channel in the melody tone signal generating circuit 43. As a result, generation of the melody tone signal is terminated, by which the speakers 45*a*–45*c* stop generating the corresponding musical tone.

After executing the above-mentioned process of step 1412, the processing proceeds to step 1414 whose process is similar to that of the foregoing step 1404 shown in FIG. 16A. Then, the judgement of this step 1414 turns to "YES" so that the processing proceeds to step 1416 wherein No.0 key code KC(0) is stored as the key-off event data at the address designated by (TCNT+BAR*32) in the melody key storing area MD12PATM. In step 1418, execution of the mode corresponding key-off routine MD12KOF is completed. Different from the foregoing step 1406, in step 1416, "$80_H$" is not added to No. key code KC(0), which turns the MSB of the data stored at the address (TCNT+BAR*32) at "0" indicating the key-release.

As described above, under execution of the mode corresponding key-on routine MD12KON and mode corresponding key-off routine MD12KOF, the melody tones are generated in accordance with the performance of the melody keys. In response to the melody performance, the key-operation data and tone volume data are sequentially stored at respective addresses designated by the bar data BAR and tempo count data TCNT within the melody key storing area and melody volume storing area. Incidentally, no data is stored at the timings when no melody-key-operation is made.

Figure 16C:
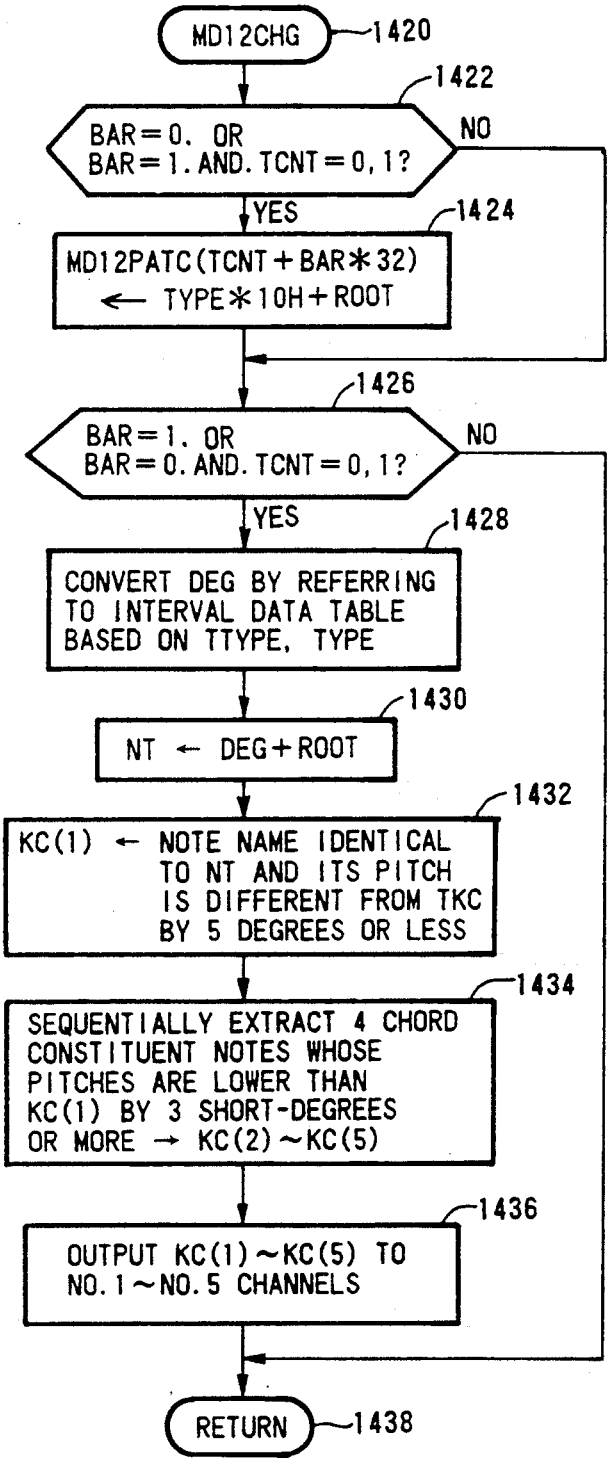

Meanwhile, based on the chord performance, the mode corresponding chord change routine MD12CHG is read out in step 218 of the key-operation event routine, and then the execution thereof is started in step 1420 shown in FIG. 16C. Next step 1422 is similar to the foregoing steps 1404, 1414. Therefore, in the performance recording period, the judgement of step 1422 turns to "YES" so that the processing proceeds to step 1424. In step 1424, performed chord data "TYPE*$10_H$+ROOT" is stored as the chord event data at the address designated by (TCNT+BAR*32) in the chord storing area MD12PATC. Within the performed chord data "TYPE*$10_H$*ROOT", TYPE indicates the performed chord type and ROOT indicates the root of the performed chord, both of which are set in step 212 of the key-operation event routine. In this performed chord data "TYPE*$10_H$+ROOT", upper four bits (i.e., leftmost nybble) indicate the chord type, but lower four bits (i.e., rightmost nybble) indicate the chord root. In the performance recording period, processes of steps 1426–1436 are omitted, so that execution of the mode corresponding chord change routine MD12CHG is terminated in step 1438. Incidentally, no data is stored at the timings when the chord is not performed.

Figure 16D:
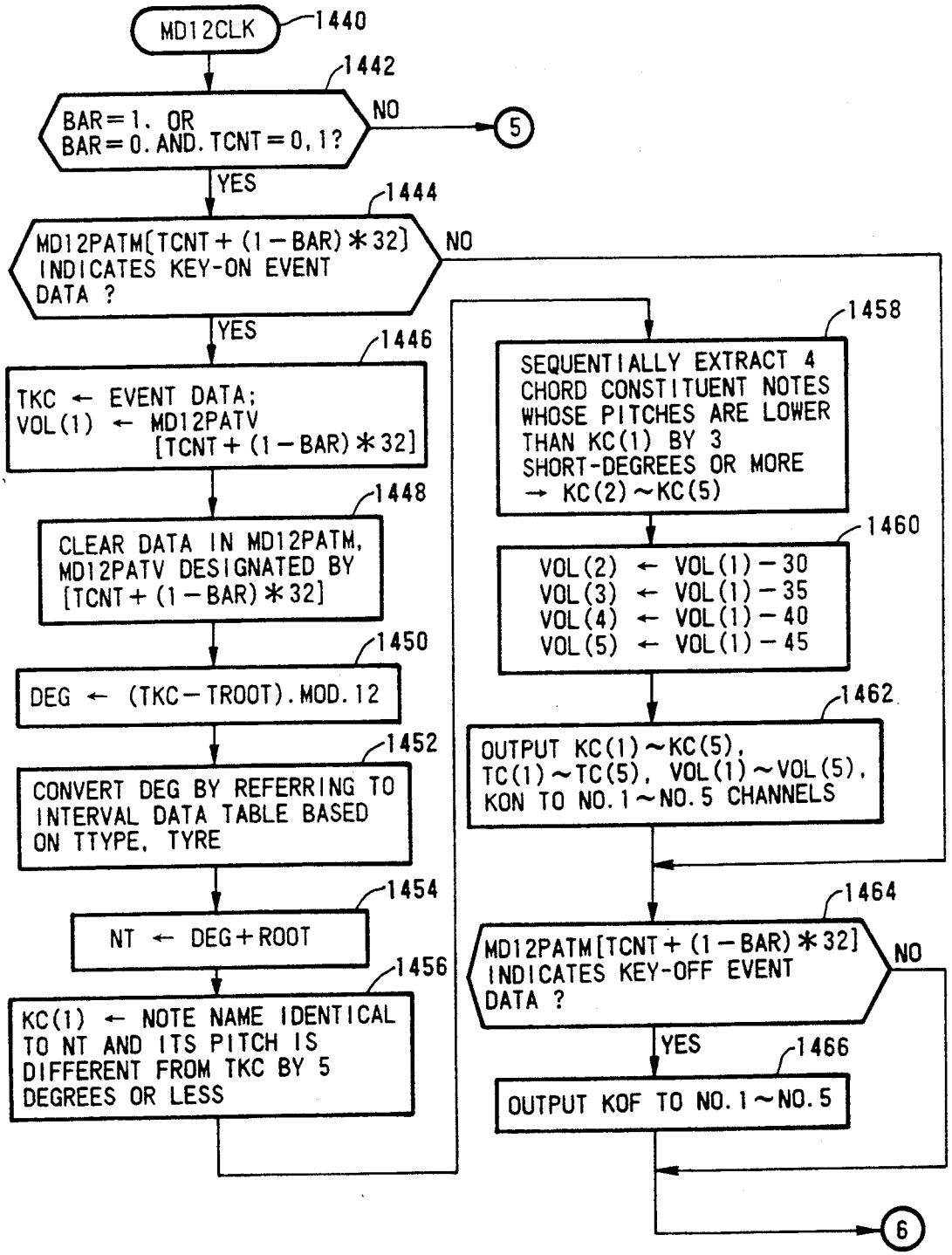

Even in the performance recording period, when the mode corresponding clock routine MD12CLK is read out in step 252 of the clock interrupt program, the execution thereof is started in step 1440 shown in FIG. 16D. However, in this performance recording period, processes of steps 1444–1484 are not executed, but processes of steps 1486–1492 are executed. Then, in step 1494, execution of the mode corresponding clock routine MD12CLK is terminated. Even in the performance recording period, the bar data BAR is inverted by every bar according to the automatic rhythm progression under the foregoing processes of steps 1486, 1488. When the bar data BAR at "0" level indicating the odd number of bar is inverted at "1", the judgement of step 1490 turns to "YES" so that the processing proceeds to step 1492 wherein the key-off signal KOF is supplied to No.1–No.5 channels. As a result, No.1–No.5 channels terminate generation of their musical tone signals, by which No.1–No.5 channels are initialized. Thus, the present system prepares for the performance reproducing period, which will be described below.

(b) Performance Reproducing Period (i.e., BAR=1 or BAR=0.AND.TCNT=0,1):

In this performance reproducing period, the mode corresponding key-on routine MD12KON is read out in response to the melody-key-on event, and then the mode corresponding key-off routine MD12KOF is read out in response to the melody-key-off event. As similar to the performance recording period described before, under the processes of steps 1402, 1412, the melody tones are sounded in accordance with the melody performance of the keyboard 10. In this case, however, the processes of steps 1404, 1406, 1414, 1416 are omitted, so that several kinds of data concerning the melody performance are not stored.

In such state, when the mode corresponding clock routine MD12CLK is read out in step 252 of the clock interrupt program, the execution thereof is started in step 1440 shown in FIG. 16D. In next step 1442, it is judged whether or not the bar data BAR is at "1", or it is judged whether or not the bar data BAR is at "0" and the tempo count data TCNT is at "0" or "1". In the present performance reproducing period, such condition is established so that the judgement of step 1442 turns to "YES". Then, the processing proceeds to step 1444 wherein data MD12PATM[TCNT+(1−BAR)*32] designated by address value [TCNT+(1−BAR)*32] is read from the melody key storing area MD12PATM. In addition, it is judged whether or not the read data MD12PATM[TCNT+(1−BAR)*32] is the key-on event data. Herein, if the bar data BAR equals to "1", value (1-BAR) equals to "0". On the other hand, if BAR equal to "0", (1-BAR) equals to "1". For this reason, in the performance reproducing period, several kinds of data which have been stored in the performance recording period are read out at the timing delayed by one bar.

If the read data MD12PATM[TCNT+(1-BAR)*32] is not the key-on event data, the judgement of step 1444 turns to "NO" so that the processing directly branches to step 1464. On the other hand, if MD12PATM[TCNT+(1-BAR)*32] is the key-on event data, the judgement of step 1444 turns to "YES" so that its succeeding processes of steps 1446–1462 are to be executed.

In step 1446, the read data MD12PATM[TCNT+(1-BAR)*32] is set as the temporary stored key code TKC. In addition, data MD12PATV[TCNT+(1-BAR)*32] designated by address value [TCNT+(1-BAR)*32] is read from the melody volume storing area MD12PATV, and then read data is set as No.1 tone volume data VOL(1). In step 1448, both of two data read from the melody key storing area MD12PATM and melody volume storing area MD12PATV are cleared.

Next, in step 1450, the micro computer 60 computes the remainder obtained by diving (TKC-TROOT) by "12" (i.e., (TCNT-TROOT).MOD.12) is set as the interval data DEG. Herein, the previous root data TROOT is set in step 1474 shown in FIG. 16E which will be described later. In short, TROOT indicates the root of the chord which has been previously performed at the clock timing of the preceding bar, i.e., one bar prior to the currently performed bar. Therefore, the interval data DEG corresponds to the number of semitones indicating the pitch difference between the melody pitch and chord root in the preceding bar. After executing the above-mentioned process of step 1450, the processing proceeds to step 1452 wherein based on the preceding type data TTYPE and current type data TYPE, the micro computer 60 refers to the table within the interval data storing table 96 to thereby convert the interval data DEG. Thus, under such conversion of DEG, the interval data DEG corresponds to the interval between the melody pitch and chord root in the preceding bar, and it also indicates the interval from the root suitable to the currently performed chord. Next, in step 1454, such converted interval data DEG and root data ROOT are added together, so that its addition result is set as note data NT. In step 1456, the micro computer 60 extracts the note having the same note name of NT and whose pitch is different from the temporary stored key code TKC (indicative of the performed melody tone in the preceding bar) by 5 degrees or less. Then, the extracted note is set as No.1 key code KC(1). Thus, No.1 key code KC(1) indicative of the pitch of No.1 additional tone indicates the note name which is in the vicinity of the performed melody tone and suitable for the performed chord.

In step 1458, the micro computer 60 sequentially extracts four chord constituent notes whose pitches are lower than and different from the pitch of No.1 additional tone by 3 short-degrees or more. Then, the extracted chord constituent notes are respectively set as No.2-No.5 key codes KC(2)-KC(5) indicative of the pitches of No.2-No.5 additional tones. In this case, the micro computer 60 refers to the chord constituent note table 81 based on the type data TYPE concerning the currently performed chord, and then the reference result is converted based on the root data such that the chord constituent notes are computed. Then, the computed chord constituent notes are compared to No.1 key code KC(1) to thereby extract the above-mentioned four chord constituent notes. After setting No.2-No.5 key codes KC(2)-KC(5) in step 1458, the processing proceeds to step 1460 wherein No.2-No.5 tone volume data VOL(2), VOL(3), VOL(4), VOL(5) are respectively set at VOL(1)−30, VOL(1)−35, VOL(1)−40, VOL(1)−45. In step 1462, No.1-No.5 key codes KC(1)-KC(5), tone color data TC(1)-TC(5), tone volume data VOL(1)-VOL(5) and key-on signals KON are respectively supplied to No.1-No.5 channels. No.1-No.5 channels generate the musical tone signals corresponding to these data, and these musical tone signals are supplied to the speakers 45*a*-45*c* via the output circuit 44. Thus, the speakers 45*a*-45*c* generate No.1 additional tone corresponding to the melody tone performed in the preceding bar in the tone color of clarinet. In addition, the chord constituent notes of the current chord are sounded as No.2-No.5 additional tones in the tone colors of alto-saxophone and tenor-saxophone respectively.

Thereafter, data MD12PATM[TCNT+(1-BAR)*32] designated by address [TCNT+(1-BAR)*32] is read from the melody key storing area MD12PATM. In step 1464, it is judged whether or not the read data MD12PATM[TCNT+(1-BAR)*32] is the key-off event data. If not, the judgement of step 1464 turns to "NO" so that the processing branches to step 1468 shown in FIG. 16E. On the other hand, if the read data MD12PATM[TCNT+(1-BAR)*32] is the key-off event data, the judgement of step 1464 turns to "YES" so that the processing proceeds to step 1466 wherein the key-off signal KOF is supplied to No.1-No.5 channels. Thus, No.1-No.5 channels terminate generation of their musical tone signals, by which the speakers 45*a*-45*c* stop generating No.1-No.5 additional tones.

Under the above-mentioned processes of steps 1444-1466, the currently performed melody tone is added with No.1 additional tone which corresponds to the melody tone performed in the preceding bar and which is converted in response to the current chord. Further, four chord constituent notes are sounded as No.2-No.5 additional tones. Thus, the performance is reproduced by sounding the currently performed melody tone and No.1-No.5 additional tones.

Next, data MD12PATC[TCNT+(1-BAR)*32] designated by the address [TCNT+(1-BAR)*32] is read from the chord storing area MD12PATC. In step 1468 shown in FIG. 16E, it is judged whether or not the read data MD12PATC[TCNT+(1-BAR)*32] is the chord event data. If not, the judgement of step 1468 turns to "NO" so that the processing branches to step 1486. Then, processes of steps 1486-1492 are to be executed. If the read data MD12PATC[TCNT+(1-BAR)*32] is the chord data, the judgement of step 1468 turns to "YES" so that processes of steps 1470-1484 are to be executed. In this case, after executing the processes of steps 1470-1484, its succeeding processes of steps 1486-1492 will be executed.

In step 1470, the chord event data (i.e., MD12PATC[TCNT+(1-BAR)*32]) is set as temporary stored chord data TCHD. In step 1472, this data is cleared in the chord storing area MD12PATC. In step 1474, upper four bits (i.e., leftmost nybble) of the temporary stored chord data TCHD is set as the old root data TROOT, while lower four bits (i.e., rightmost nybble) thereof is set as the old type data TTYPE. Thereafter, processes of steps 1476-1482 similar to the foregoing processes of steps 1452-1458 are executed. In short, No.1-No.5 key codes KC(1)-KC(5) are varied in response to the change of the chord performed in the preceding bar. In step 1484, such varied No.1-No.5 key codes KC(1)-KC(5) are respectively supplied to No.1-No.5 channels.

As a result, in response to the varied key codes KC(1)-KC(5), No.1-No.5 channels vary the pitches of No.1-No.5 additional tone signals. Therefore, the pitches of No.1-No.5 additional tones generated from the speakers 45*a*-45*c* are varied in response to the chord change occurred in the preceding bar.

In such state, when the chord change is made, the mode corresponding chord change routine MD12CHG is read out in step 218 of the key-operation event routine, and then the execution thereof is started in step 1420 shown in FIG. 16C. During execution of this routine MD12CHG in the performance reproducing period, the judgement of step 1426 turns to "YES" (i.e., BAR=1 or BAR=0.AND.TCNT=0,1) as similar to the foregoing step 1442 shown in FIG. 16D, by which processes of steps 1428-1436 will be executed. Thereafter, execution of the mode corresponding chord change routine MD12CHG is completed in step 1438.

Figure 16E:
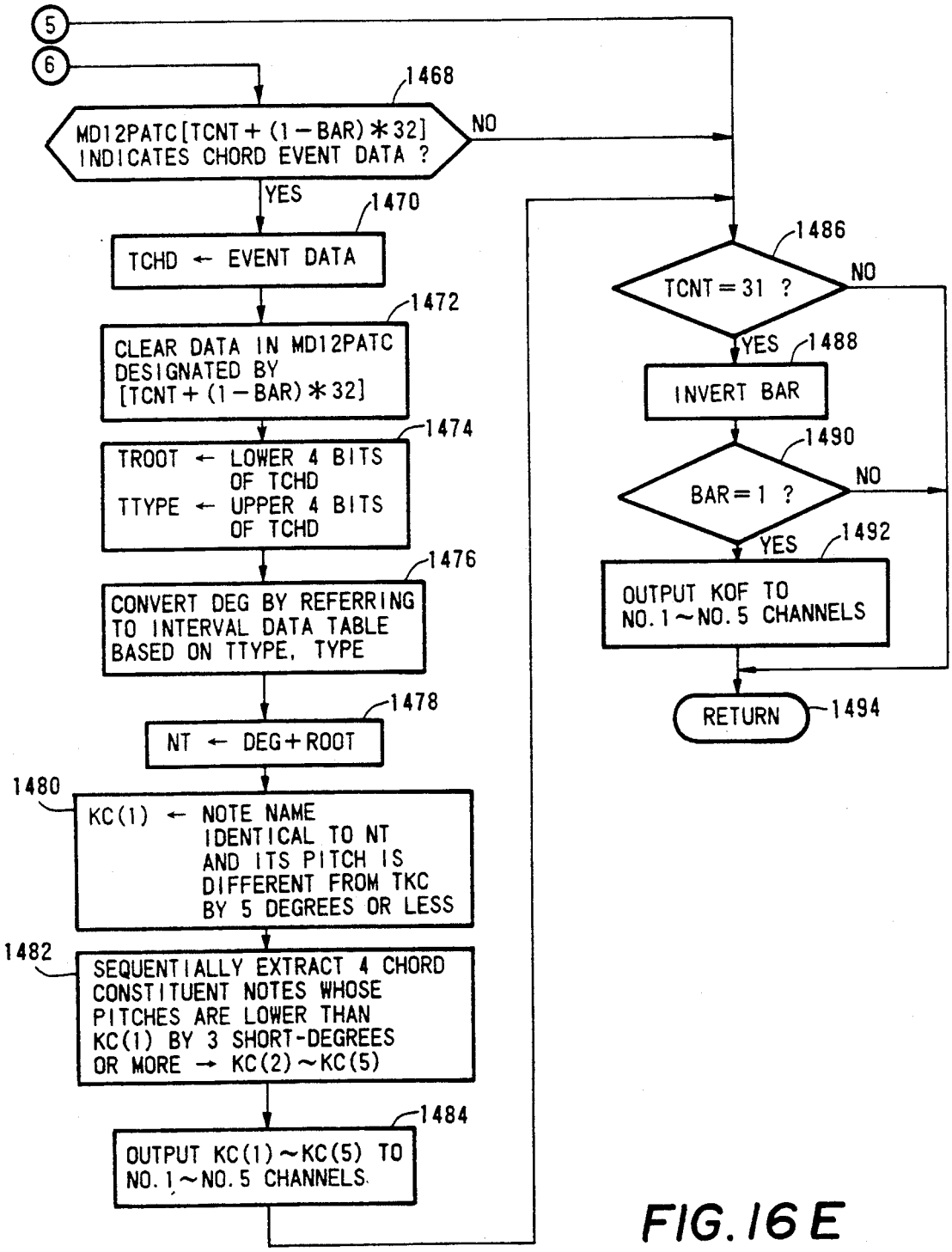

In this case, steps 1428-1436 are similar to foregoing steps 1476-1484 shown in FIG. 16E. As a result, No.1-No.5 additional tones generated from the speakers 45*a*-45*c* are varied in response to the change of the currently performed chord.

As described heretofore, in the twelfth solo style play mode, the current melody tone is added with No.1-No.5 additional tones. Herein, No.1 additional tone corresponds to the melody performance in the preceding bar and this No.1 additional tone is converted in response to the current chord, while No.2-No.5 additional tones correspond to four chord constituent notes of the currently performed chord respectively. Therefore, it is possible to obtain the varied canon performance which is suitable for the musical progression of melody and chords.

Incidentally, the twelfth solo style play mode generates four additional tones (i.e., No.2-No.5 additional tones) in addition to the melody tone and No.1 additional tone. However, it is possible to change such number of additional tones other than No.1 additional tone.

(m) Thirteenth Solo Style Play Mode

In the thirteenth solo style play mode (MD=13), as long as the melody key is continuously depressed, two additional tones whose pitches are different from that of the melody pitch by one or some octaves are alternatively sounded by the predetermined note period. In addition, the melody tones are repeatedly sounded by every note period which is longer than the above-mentioned predetermined predetermined note period. This mode is designated when "Techno-Rock" (i.e., Rock'n Roll using the advanced technology) is designated as the rhythm kind. In this mode, the automatic rhythm is set in the standby state (RUN=−1), and No.0–No.6 channels are used to generate the melody tone and additional tones concerning the depressed key. Herein, No.-0–No.6 tone color data TC(0)–TC(6) are all set at the same value indicating the tone color of harp.

Figure 17D:
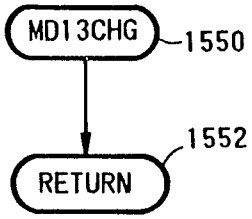
FIGS. 17A–17D are flowcharts showing sub-programs used in 13th solo style play mode.
Figure 17C:
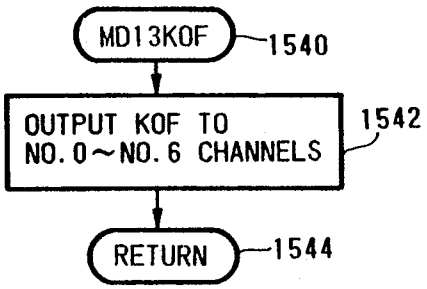
Figure 17A:
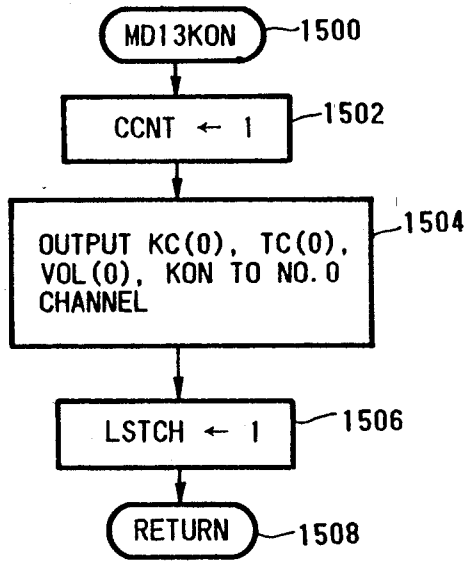

In response to the melody-key-depression occurred on the keyboard 10, the mode corresponding key-on routine MD13KON is read out in step 230, and then the execution thereof is stated in step 1500 shown in FIG. 17A. In next step 1502, the clock count data CCNT is initialized to "1". As described before, this clock count data CCNT counts the tempo clock signal TCLK, so that it is incremented by every thirty-second note timing. Next, in step 1504, No.0 key code KC(0), tone color data TC(0), tone volume data VOL(0) and key-on signal KON are supplied to No.0 channel of the melody tone signal generating circuit 43.

In response to the receipt of the key-on signal, No.0 channel starts to generate the musical tone signal, which is then equally outputted to the output lines L, C, R. In this case, the pitch of this musical tone signal is controlled by No.0 key code KC(0) so that it is set identical to the melody pitch; the tone color is controlled by No.0 tone color data TC(0) so that it is set identical to the tone color of harp; and tone volume is controlled by No.0 tone volume data VOL(0) so that it is set corresponding to the key touch (i.e., touch data TCH) of the depressed key. Such musical tone signal equally fed to the output lines L, C, R is supplied to the speakers 45*a*–45*c* via the output circuit 44. Thus, the speakers 45*a*–45*c* generate the performed melody tone in the tone color of harp.

After executing the above-mentioned process of step 1504, the processing proceeds to step 1506 wherein the last channel data LSTCH is initialized to "1". Then, execution of the mode corresponding key-on routine MD13KON is completed in step 1508. Herein, the last channel data LSTCH sequentially varies from "1" to "6", so that it finally indicates the number of channel in which the musical tone signal is to be formed.

Figure 17B:
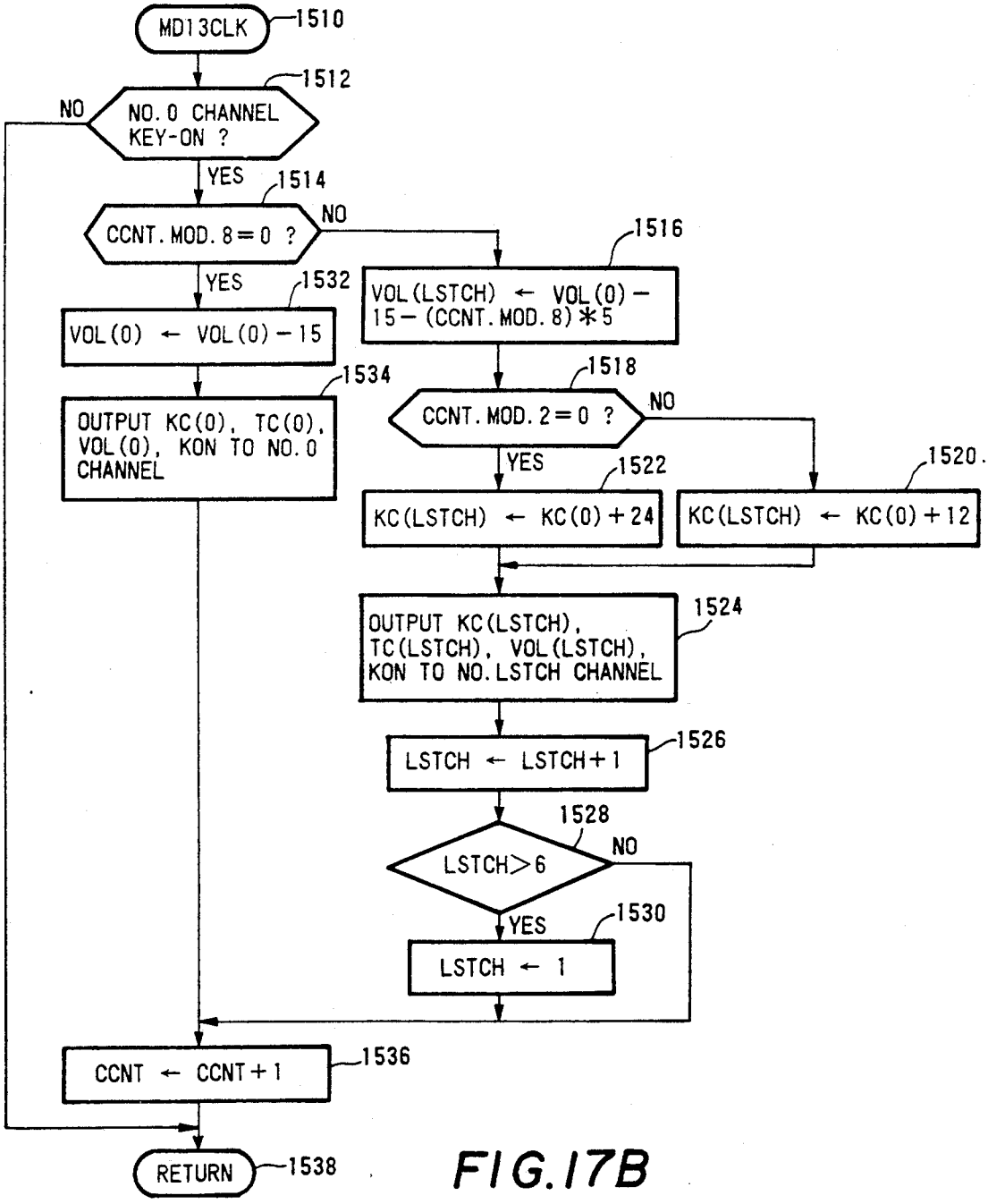

In such state, when the mode corresponding clock routine MD13CLK is read out in step 252, the execution thereof is started in step 1510 shown in FIG. 17B. In next step 1512, it is judged whether or not No.0 channel generates the musical tone signal corresponding to the key-on event. In short, it is judged whether or not the melody key is depressed. If so, the judgement of step 1512 turns to "YES". Herein, the remainder obtained by diving the clock count data CCNT by "8" (i.e., CCNT.MOD.8) is computed. In step 1514, it is judged whether or not the computed remainder is "0".

As described before, the clock count data CCNT is set at "1" in step 1502 shown in FIG. 17A. Therefore, the judgement of step 1514 is "NO". Then, the processing branches to step 1516 wherein No.LSTCH tone volume data VOL(LSTCH) is set by executing the calculation of VOL(LSTCH)=VOL(0)−15-(CCNT.MOD.8)*5. Due to this calculation, every time the clock count data CCNT is incremented from "0" to "7", No.LSTCH tone volume data VOL(LSTCH) is decreased by 5 dB from VOL(0)−15.

Thereafter, the processing proceeds to step 1518 wherein it is judged whether or not "CCNT.MOD.2=0". Since CCNT is set at its initial value "1", the judgement of step 1518 turns to "NO" so that the processing branches to step 1520 wherein No.LSTCH key code KC(LSTCH) is set at the value "KC(0)+12" indicating the pitch which is one octave higher than that of No.0 key code KC(0). Then, in step 1524, No.LSTCH key code KC(LSTCH), tone color data TC(LSTCH), tone volume data VOL(LSTCH) and key-on signal KON are supplied to No.LSTCH channel. As a result, No. LSTCH forms its musical tone signal based on the above-mentioned data supplied thereto. This musical tone signal is fed to the speakers 45*a*–45*c*, from which the musical tone is sounded in the tone color of harp, the pitch which is one octave higher than the melody pitch and the tone volume which is 20 dB lower than that of the melody tone.

In step 1526, the last channel data LSTCH is incremented by "1". Then, due to processes of steps 1528, 1530, when the last channel data LSTCH exceeds "6", it is set at "1". In step 1536, the clock count data CCNT is incremented by "1". Thereafter, execution of the mode corresponding clock routine MD13CLK is completed in step 1538. Due to the above-mentioned processes, the clock count data CCNT is set at "2", so that the last channel data LSTCH is set at "2".

Then, when the thirty-second note period is passed after the execution of MD13CLK, this mode corresponding clock routine MD13CLK is executed again. In this case, as long as the melody key is continuously depressed, the clock count data CCNT remains at "2". Therefore, the judgement of step 1512 turns to "YES", but the judgement of step 1514 turns to "NO". Thus, No.O LSTCH tone volume data VOL(LSTCH) is further decreased by 5 dB in step 1516; and it is judged whether or not "CCNT.MOD.2" equals to "0" in step 1518. Since the clock count data CCNT is at "2", the judgement of step 1518 turns to "YES" so that the processing proceeds to step 1522 wherein No.LSTCH key code KC(LSTCH) is set at the value "KC(0)+24" whose pitch is two octaves lower than No.0 key code KC(0). Thereafter, as described before, generation of the musical tone signal in No.LSTCH channel is controlled in step 1524. Thus, the speakers 45*a*–45*c* starts to sound the musical tone in the tone color of harp, the pitch which is two octaves higher than the melody pitch and the tone volume which is 25 dB lower than that of the melody tone. Herein, the harp tone is attenuated in its tone volume, but its attenuation period is somewhat long. Therefore, during generation of this harp tone, generation of the melody tone and additional tone whose pitch is one octave higher than the melody pitch is continued.

Thereafter, the foregoing processes of steps 1526–1536 are executed. Then, execution of the mode corresponding clock routine MD13CLK is completed in step 1538.

Then, if this routine MD13CLK is executed again, the processes of steps 1516–1536 are executed so that generation of the musical tone is controlled as long as the melody key is continuously depressed. Herein, the last channel data LSTCH is sequentially incremented from "1" to "6", and the clock count data CCNT is also incremented so that its values becomes odd and even numbers alternatively. Therefore, due to the processes of steps 1518–1522, two additional tones are alternatively sounded by every thirty-second note timing, wherein one additional tone has the pitch which is one octave higher than the melody pitch but another additional tone has the pitch which is two octaves higher than the melody pitch. In addition, under the process of step 1516, the tone volume of the musical tone is decreased by 5 dB by every thirty-second note timing. Further, the channel in which such musical tone signal is formed is changed over from No.1 channel to No.6 channel. Thus, the previously generated musical tone fades away, but its reverberation is remained.

During the increment of the clock count data CCNT, when CCNT reaches "8" or its multiple (in other words, when integral number of beats is passed after the melody-key-depression timing), CCNT.MOD.8=0 is established so that the judgement of step 1514 turns to "YES". Then, the processing proceeds to step 1532 wherein No.0 tone volume data VOL(0) is decreased by 15 dB. In step 1534, as similar to the foregoing step 1504, No.0 key code KC(0), tone color data TC(0), tone volume data VOL(0) and key-on signal KON are supplied to No.0 channel so that No.0 channel starts to form the corresponding musical tone signal. Based on this musical tone signal, the speakers 45*a*–45*c* sounds the melody tone in lower tone volume which is 15 dB lower than that of the precedingly generated melody tone. In this case, since one beat period is passed after generation of the preceding melody tone, the attenuation of the preceding melody tone is sufficient so that generation of the preceding melody tone is almost ended. As a result, as long as the melody key is continuously depressed, the tone volume of the generated melody tone is decreased by 15 dB by every beat.

In such state, when the depressed melody key is released, the mode corresponding key-off routine MD13KOF is read out in step 234, so that the key-release processing is carried out on the melody tone and its additional tone. More specifically, execution of this routine MD13KOF is started in step 1540 shown in FIG. 17C. In step 1542, the key-off signal KOF is supplied to No.0–No.6 channels. In step 1544, execution of the mode corresponding key-off routine MD13KOF is completed. As a result, generation of the melody tone signal and additional tone signal is terminated, so that the speakers 45*a*–45*c* stop generating the corresponding musical tones.

When the melody key is released, the judgement of step 1512 shown in FIG. 17B turns to "NO" so that the processing directly branches to step 1538 without executing the processes of steps 1514–1536.

Further, when the mode corresponding chord change routine MD13CHG is read out in step 218, the execution thereof is started in step 1550 shown in FIG. 17D. However, execution of this routine MD13CHG is completed in step 1552 without executing any substantial processes.

As described heretofore, in the thirteenth solo style play mode, one-octave-higher and two-octave-higher additional tones are alternatively sounded in the tone color of harp by every thirty-second note timing, but their tone volumes are decreased by 5 dB by every thirty-second note timing. In addition, the tone volume of the melody tone is decreased by 15 dB by every beat. For these reasons, it is possible to carry out the harp performance by merely carrying out the monophonic and simple performance. Thus, it is possible to obtain the performance sounded like so-called "Techno-Rock".

Incidentally, in the present mode, the additional tone is generated in the tone volume which is decreased by 5 dB by every thirty-second note timing. However, this timing can be changed to other note length timing such as sixteenth note timing. In addition, the decrease of the tone volume can be changed to "3" or "7" dB, for example. Meanwhile, the tone volume of the performed melody tone is decreased by 15 dB by every beat timing. However, it is possible to change such timing to eighth note timing, second note timing, for example. In addition, the decreased of the tone volume can be changed to "10 dB" or "20 dB", for example. Moreover, it is possible to change such timings and decreases of the melody tone and additional tone by the manual operation. Or, it is possible to change such timings and decreases in connection with the tempo of the automatic rhythm.

In addition, it is possible to change over the speaker from which the additional tone is sounded in response to the pan control in the present thirteenth solo style play mode.

(n) Fourteenth Solo Style Play Mode

In the fourteenth solo style play mode (MD=14), as long as the melody key is continuously depressed, the melody tone is added with plural additional tones whose pitches are identical to the melody pitch but whose tone colors are different from the tone color of the melody tone. These additional tones are sequentially sounded by the predetermined delay time in such a manner that their tone volumes are decreased. This mode is designated when "Christmas Rock" (i.e., Rock'n Roll sounded like Christmas songs) is designated as the rhythm kind. Herein, the automatic rhythm is set in the standby state (RUN=−1). In this mode, No.0–No.3 channels are used to generate the melody tone and additional tones concerning the depressed key. No.0–No.3 tone color data TC(0)–TC(3) are respectively set identical to the tone colors of hand-bell, vibraphone, selesta and electronic piano.

Figure 18A:
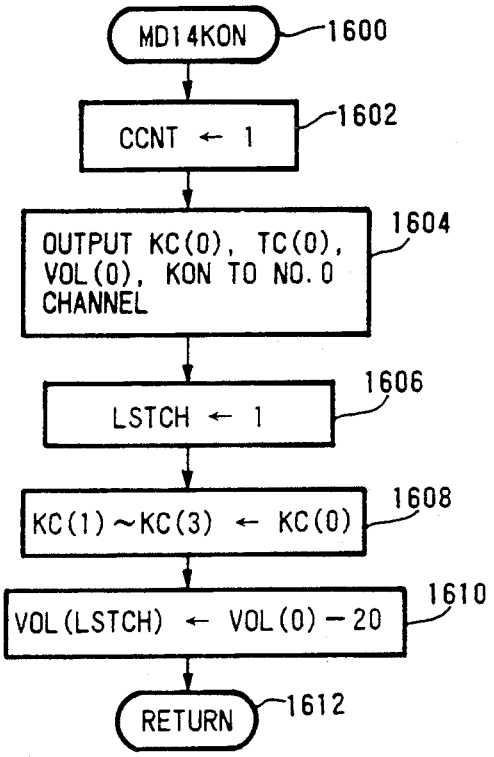

In response to the melody-key-depression of the keyboard 10, the mode corresponding key-on routine MD14KON is read out in step 230, and then the execution thereof is started in step 1600 shown in FIG. 18A. In step 1602, the clock count data CCNT is initialized to "1". As described before, this clock count data CCNT is inverted by every thirty-second note timing (i.e., every clock timing of the tempo clock signal TCLK). In next step 1604, No.0 key code KC(0), tone color data TC(0), tone volume data VOL(0) and key-on signal KON are supplied to No.0 channel.

In response to the receipt of the key-on signal, No.0 channel starts to form the musical tone signal, which is then equally fed to the output lines L, C, R. In this case, the pitch of the generated musical tone signal is controlled by No.0 key code KC(0) so that it is set identical to the melody pitch; the tone color is controlled by No.0 tone color data TC(0) so that it is set identical to the tone color of hand-bell; and the tone volume is controlled by No.0 tone volume data VOL(0) so that it is set corresponding to the key touch (i.e., touch data TCH) of the depressed melody key. Such musical tone signal fed to the output lines L, C, R is supplied to the speakers 45*a*–45*c* via the output circuit 44. Thus, the speakers 45*a*–45*c* sounds the melody tone in the tone color of hand-bell.

After executing the above-mentioned process of step 1604, the processing proceeds to step 1606 wherein the last channel data LSTCH is initialized to "1". In step 1608, all of No.1–No.3 key codes KC(1)–KC(3) are set equal to No.0 key code KC(0). In step 1610, No.LSTCH tone volume data VOL(LSTCH) is set identical to "VOL(0)−20" indicative of the tone volume which is 20 dB lower than No.0 tone volume data VOL(0). In step 1612, execution of the mode corresponding key-on routine MD14KON is completed. Herein, the last channel data LSTCH varies from "1" to "3", and then finally it indicates the number of channel in which the musical tone signal is to be formed.

Figure 18B:
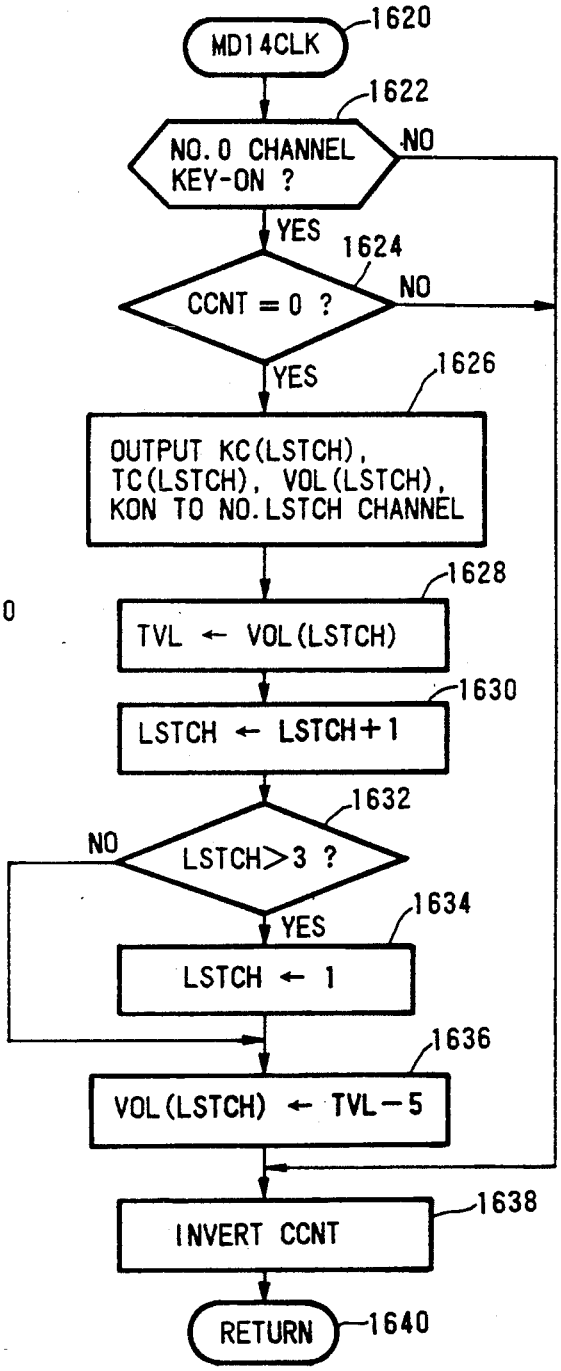

In such state, when the mode corresponding clock routine MD14CLK is read out in step 252, the execution thereof is started in step 1620 shown in FIG. 18B. In step 1622, it is judged whether or not No.0 channel generate the musical tone signal concerning the key-on event. In other words, it is judged whether or not the melody key is continuously depressed. If so, the judgement of step 1622 turns to "YES" so that the processing proceeds to step 1624 wherein it is judged whether or not the clock count data CCNT is at "0".

As described before, this clock count data CCNT has been initialized to "1". Therefore, the judgement of step 1624 turns to "NO" so that the processing directly branches to step 1638 wherein CCNT is inverted from "1" to "0". In next step 1640, execution of the mode corresponding clock routine MD14CLK is terminated.

When thirty-second note period is passed after the above-mentioned execution of the routine MD14CLK, this routine MD14CLK is to be executed again. In this case, as long as the melody key is continuously depressed, the judgement of step 1622 is "YES", hence, it is judged whether or not CCNT equals to "0" in step 1624. At this time, due to the above-mentioned process of step 1638, the clock count data CCNT is set at "0" so that the judgement of step 1624 turns to "YES". Then, the processing proceeds to step 1626 wherein No.LSTCH key code KC(LSTCH) tone color data TC(LSTCH), tone volume data VOL(LSTCH) and key-on signal KON are supplied to No.LSTCH channel. As a result, No.LSTCH channel forms the musical tone signal in response to the data supplied thereto. Based on this musical tone signal, the speakers 45*a*–45*c* sounds the vibraphone tone in the melody pitch but in the tone volume which is 20 dB lower than that of the melody tone.

After executing the process of step 1626, No.LSTCH tone volume data VOL(LSTCH) is stored as temporary stored tone volume data TVL in step 1628. In step 1630, the last channel data LSTCH is incremented by "1". Under processes of steps 1632, 1634, if the incremented last channel data LSTCH exceeds "3", it is returned to "1". In step 1636, No.LSTCH tone volume data VOL(LSTCH) designated by the incremented last channel data LSTCH is set as "TVL−5" indicative of the tone volume which is 5 dB lower than the temporary stored tone volume data TVL. In other words, the current tone volume of the additional tone is lowered by 5 dB from the preceding tone volume. In step 1638, the clock count data CCNT is inverted from "0" to "1". In step 1640, execution of the mode corresponding clock routine MD14CLK is completed.

In the case where the routine MD14CLK is executed again after the preceding execution of MD14CLK has been carried out, the clock count data CCNT is not at "0" so that the judgement of step 1624 turns to "NO". Then, the processing branches to step 1638 without carrying out the tone-generation control on the additional tone, wherein the clock count data CCNT is inverted from "1" to "0". Thereafter, when the routine MD14CLK is executed again after thirty-second note period is further passed, CCNT is at "0" so that the judgement of step 1624 turns to "YES". In this case, under processes of steps 1626–1636, the tone-generation control is carried out on No.LSTCH channel, the last channel data LSTCH is renewed and tone volume data VOL(LSTCH) is renewed.

Under the above-mentioned control, as long as the melody key is continuously depressed, the additional tone is sounded in the melody pitch and the tone volume which is decreased by 5 dB by every sixteenth note timing. Herein, the last channel data LSTCH varies from "1" to "3". In addition, No.1–No.3 channels designated by this last channel data LSTCH have the tone colors of vibraphone, selesta and electronic piano. Thus, the speaker will sound the musical tones in the tone colors of three instruments.

In such state, when the depressed melody key is released, the mode corresponding key-off routine MD14KOF is read out in step 234 so that the key-release processing will be carried out on the melody tone and additional tones. More specifically, execution of the mode corresponding key-off routine MD14KOF is started in step 1650 shown in FIG. 18C; and then the key-off signal KOF is supplied to No.0 channel in step 1652. In next step 1654, execution of the mode corresponding key-off routine MD14KOF is completed. As a result, generation of the melody tone signal is terminated, by which the speakers 45*a*–45*c* stop generating the corresponding musical tone.

If the melody key is released, the judgement of step 1622 shown in FIG. 18B turns to "NO" so that the processing directly branches to step 1638 without carrying out the tone-generation processing on the additional tone. Herein, all of the additional tones are attenuating tones. Therefore, after the melody-key-release event, the speakers stop generating the additional tones sequentially.

Moreover, when the mode corresponding chord change routine MD14CHG is read out in step 218, the execution thereof is started in step 1660 shown in FIG. 18D. However, in next step 1662, execution of the mode corresponding chord change routine MD14CHG is terminated without carrying out any substantial processing.

As described above, three additional tones are added to the melody tone sounded in the tone color of handbell in the present mode. These additional tones have the same melody pitch but their tone volumes are decreased by every sixteenth note timing. In addition, these additional tones have respective tone colors of vibraphone, selesta and electronic piano. Thus, by merely carrying out the monophonic performance on the melody key, it is possible to obtain the performance sounded like Christmas songs.

Incidentally, in the fourteenth solo style play mode, the additional tones are sequentially sounded but their tone volumes are sequentially decreased by 5 dB by every sixteenth note timing. However, it is possible to change such timing to eighth note timing, for example. In addition, it is also possible to change such decrease to "3 dB"or "7 dB", for example. Further, it is possible to set such timing and decrease by the manual operation.

Or, such timing and decrease can be adjusted in connection with the tempo of the automatic rhythm.

Moreover, it is possible to change over the speakers from which the additional tone is sounded by the pan control.

(o) Fifteenth Solo Style Play Mode

In the fifteenth solo style play mode (MD=15), plural chord constituent notes (including the chord root) of the performed chord are added to the melody tone as the additional tones. In addition, in the case where the melody key is depressed at the predetermined timing, the pitch bend effect is applied to the additional tone. This mode is designated when "Majestic March" is designated as the rhythm kind, for example. Herein, the automatic rhythm is set in the standby state (RUN=-1). In this mode, No.0-No.3 channels are used to generate the melody tone and additional tone concerning the depressed key. In addition, No.0 tone color data TC(0) and No.1 tone color data TC(1) are set at the same value indicative of the tone color of violin, while No.2 tone color data TC(2) and No.3 tone color data TC(3) are set at another same value indicative of the tone color of classic guitar.

In response to the melody-key-depression event, the mode corresponding key-on routine MD15KON is read out in step 230, and then the execution thereof is started in step 1700 shown in FIG. 19A. In step 1702, both of the key codes KC(1), KC(2) concerning No.1, No.2 additional tones are set at the same value indicative of the root of the highest chord whose pitch is lower than the melody pitch, and the key code KC(3) concerning No.3 additional tone is set at "KC(0)−12" indicative of the pitch which is one octave lower than the melody pitch. In order to set these key codes KC(1), KC(2), No.0 key code KC(0) is decremented by "1" and then the micro computer 60 finally searches the pitch having the same note name of the root data ROOT. Next, in step 1704, the tone volume data VOL(1)-VOL(3) concerning No.1-No.3 additional tones are all set equal to No.0 tone volume data VOL(0). In step 1706, it is judged whether or not the tempo count data TCNT is at "31", "0", "1" or "2" and the rhythm run flag is set at "1". This judgement of step 1706 is carried out in order to judge whether or not the performed melody key concerns the head note in each bar.

In the case where the performed melody key does not concern the head note in the bar, the judgement of step 1706 turns to "NO" so that the processing directly branches to step 1724 wherein a bend flag BND is set at "0". The bend flag BND at "1" level indicates that the pitch bend is effected on the predetermined additional tone, while BND at "0" level indicates that the pitch bend is not effected on any additional tones. After executing the process of step 1724, the processing proceeds to step 1726 wherein No.0-No.3 key codes KC(0)-KC(3), tone color data TC(0)-TC(3), tone volume data VOL(0)-VOL(3) and key-on signals KON are respectively supplied to No.0-No.3 channels. Then, in step 1728, execution of the mode corresponding key-on routine MD15KON is terminated.

In response to the receipts of the key-on signals, No.0-No.3 channels start to form respective musical tone signals, which are then equally fed to the output lines L, C, R. In this case, the pitch bend value is not supplied just before the key code is supplied to each channel, which will be described later. Therefore, the pitches of the musical tone signals controlled by No.0-No.3 key codes KC(0)-KC(3) only, so that they are respectively set identical to the melody pitch, chord root pitch which is lower than but closest to the melody pitch and the pitch which is one octave lower than the melody pitch. In addition, the tone colors are controlled by No.0-No.3 tone color data TC(0)-TC(3) so that they are set identical to the tone colors of violin and classic guitar; and the tone volumes are controlled by No.0-No.3 tone volume data so that they are set corresponding to the key touch (i.e., touch data TCH) of the depressed melody key. The musical tone signals equally fed to the output lines L, C, R are supplied to the speakers 45*a*-45*c* via the output circuit 44. Hence, the speakers 45*a*-45*c* sound the melody tone and three additional tones in the tone colors of violin and classic guitar.

Figure 19B:
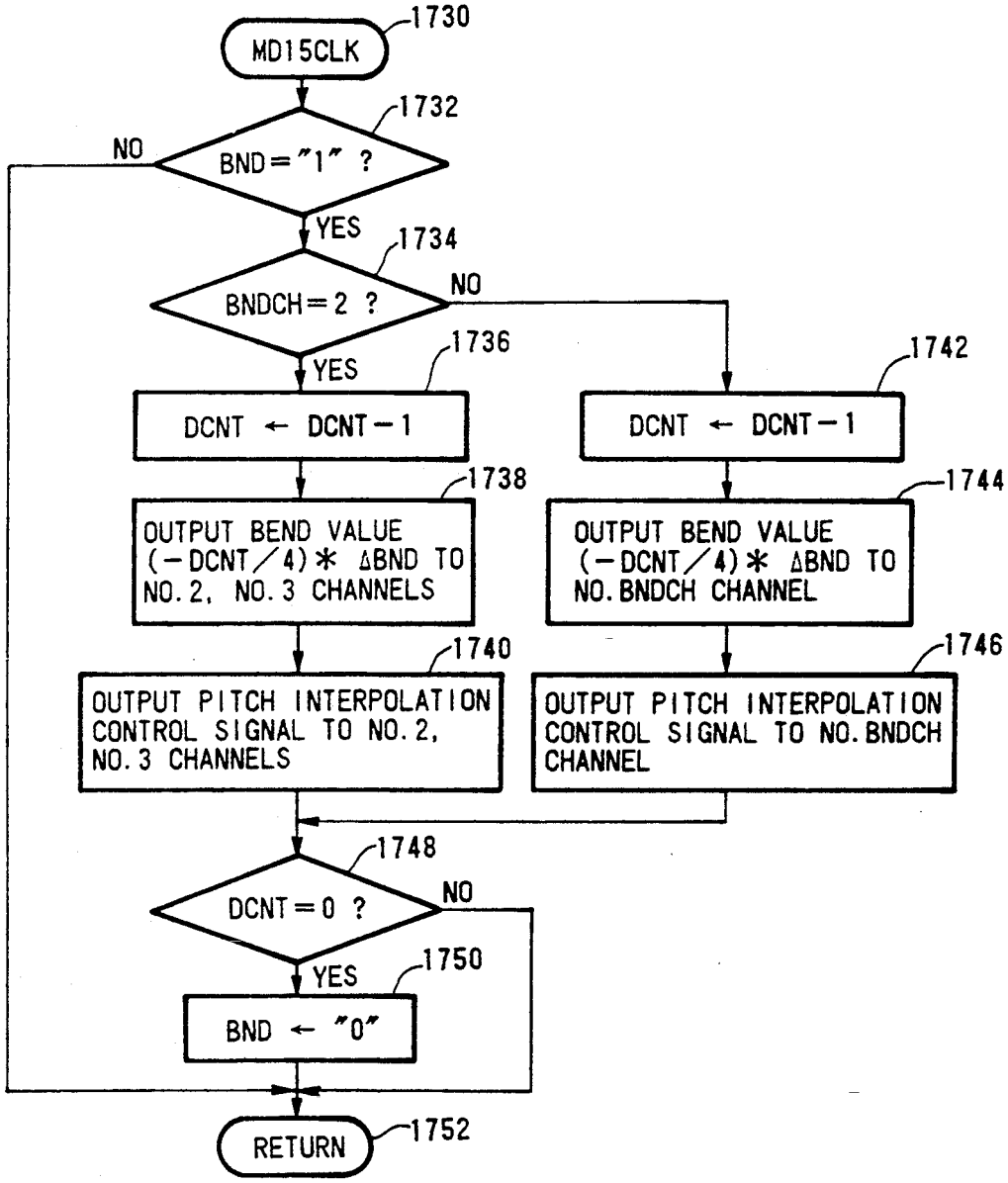

In such state, when the mode corresponding clock routine MD15CLK is read out in step 252, the execution thereof is started in step 1730 shown in FIG. 19B. In step 1732, it is judged whether or not the bend flag BND is at "1". In this case, as described before, the bend flag BND is set at "0". Therefore, the judgement of step 1732 turns to "NO" so that the processing directly branches to step 1752 wherein execution of the mode corresponding clock routine MD15CLK is terminated.

Figure 19C:
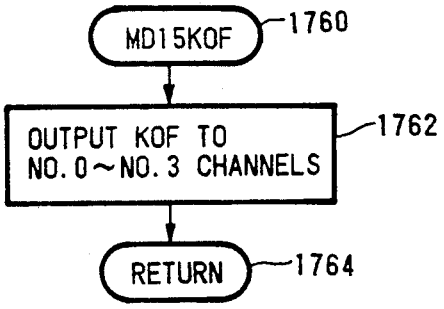

In such state, when the depressed melody key is released, the mode corresponding key-off routine MD15KOF is read out in step 234, whereby the key-release processing is carried out on the melody tone and No.1-No.3 additional tones. More specifically, execution of the mode corresponding key-off routine MD15KOF is started in step 1760 shown in FIG. 19C. In step 1762, the key-off signal KOF is supplied to all of No.0-No.3 channels. Then, in step 1764, execution of the mode corresponding key-off routine MD15KOF is completed. As a result, generation of the melody tone signal and No.1-No.3 additional tone signals is terminated, by which the speakers 45*a*-45*c* stop generating the melody tone and No.1-No.3 additional tones.

Figure 19E:
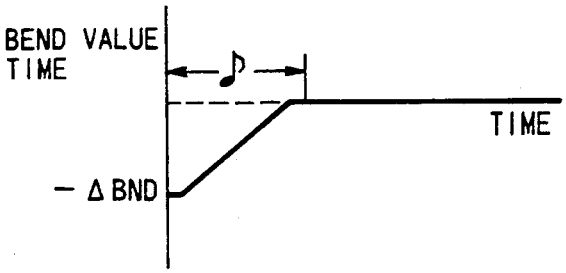
FIG. 19E shows a tone-generation pattern of additional tone in 15th solo style play mode.
Figure 19D:
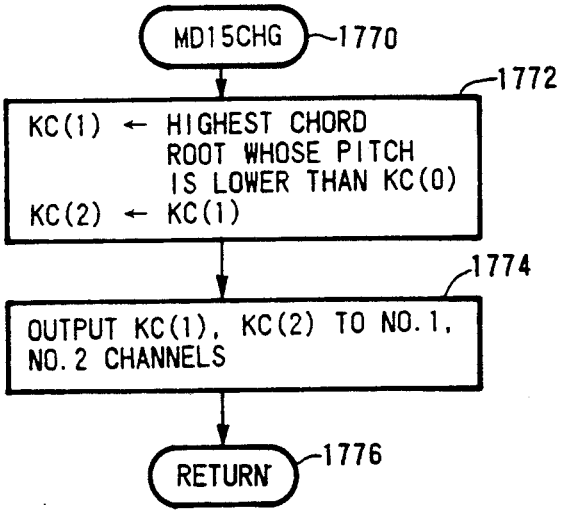

In response to the chord-key-depression event occurred on the keyboard 10, the mode corresponding chord change routine MD15CHG is read out in step 218, and then the execution thereof is started in step 1770 shown in FIG. 19D. In next step 1772, as similar to the foregoing step 1702 shown in FIG. 19A, No.1, No.2 key codes KC(1), KC(2) are changed in response to the chord change. In step 1774, such changed key codes KC(1), KC(2) are respectively supplied to No.1, No.2 channels. Then, in step 1776, execution of the mode corresponding chord change routine MD15CHG is completed. Thus, No.1, No.2 channels change the pitches of No.1, No.2 additional tones in response to the changes in the key codes KC(1), KC(2) supplied thereto. Hence, No.1, No.2 additional tones sounded from the speakers 45*a*-45*c* are changed in response to the chord change.

Next, description will be given with respect to the case where the melody key is depressed at the head timing of bar. In response to the melody-key-depression event, the mode corresponding key-on routine MD15KON is executed. In step 1706, it is judged that the tempo count data TCNT is at "31", "0", "1" or "2" so that the judgement turns to "YES". Then, under succeeding processes of steps 1708-1712, bend channel data BNDCH is repeatedly incremented from "1" to "2". In step 1714, the bend flag BND is set at "1". In step 1716, down count data DCNT is initialized to "4". In step 1718, it is judged whether or not the renewed bend channel data BNDCH is at "2".

If so, the judgement of step 1718 turns to "YES" so that the processing proceeds to step 1720 wherein bend data $-\Delta$ BND is supplied to No.2, No.3 channels as the bend value. On the other hand, if BNDCH is not at "2", the judgement of step 1718 turns to "NO" so that the processing branches to step 1722 wherein the bend data $-\Delta$ BND is supplied to No.BNDCH channel as the bend value. Herein, this bend data $-\Delta$ BND indicates the interval corresponding to semitone pitch.

Thereafter, in step 1726, as described before, No.-0-No.3 key codes KC(0)-KC(3), tone color data TC(0)-TC(3), tone volume data VOL(0)-VOL(3) and key-on signals KON are respectively supplied to No.-0-No.3 channels. Thus, the channel to which the bend data $-\Delta$ BND is not supplied continue to form their melody tone signal or additional tone signal as it is. On the other hand, other channel to which the bend data $-\Delta$ BND is supplied lowers the pitch of the additional tone signal by semitone pitch.

In such state, when the mode corresponding clock routine MD15CLK is executed, the judgement of step 1732 turns to "YES" because the bend flag BND is set at "1". In next step 1734, as similar to the foregoing step 1718 shown in FIG. 19A, it is judged whether or not the bend channel data BNDCH is at "2". If so, the judgement of step 1734 turns to "YES" so that the down count data DCNT is decremented by "1" in step 1736. Then, the processing proceeds to step 1738 wherein bend data $-$DCNT* $\Delta$ BND/4 is supplied to No.2, No.3 channels. In step 1740, the pitch interpolation control signal is supplied to No.2, No.3 channels. If the bend channel data BNDCH is not at "2", the judgement of step 1734 turns to "NO" so that the processing branches to step 1742 wherein the down count data DCNT is decremented by "1". In next step 1744, the bend data $-$DCNT* $\Delta$ BND/4 is supplied to No.BNDCH channel as the bend value. In step 1746, the pitch interpolation control signal is supplied to No.BNDCH channel.

In this case, the channel to which the above-mentioned current bend data $-$DCNT*$\Delta$ BND/4 and pitch interpolation control signal are supplied is functionally similar to the channel to which the preceding bend data $-\Delta$ BND is supplied under the process of step 1720, 1722 shown in FIG. 19A. At this time, the down count data DCNT is at "3", therefore, the difference between the current and preceding bend data is equal to $-\Delta$ BND/4. Thus, the channel supplied with bend data and pitch interpolation control signal linearly interpolates the pitch of the musical tone signal by the rate corresponding to the above-mentioned difference $-\Delta$ BND/4. As a result, the pitch of the additional tone signal will linearly rise up as shown in FIG. 19E.

After completing the pitch control of the musical tone as described above, the processing proceeds to step 1748 wherein it is judged whether or not the down count data DCNT is at "0". Until then, the judgement of step 1748 turns to "NO", so that execution of the mode corresponding clock routine MD15CLK is completed in step 1752. Thereafter, when the thirty-second note period is further passed so that this routine MD15CLK is executed again, the judgement of step 1732 turns to "YES" because BND is at "1". Then, the processes of steps 1734–1746 are executed again, whereby the pitch of the musical tone is linearly raised up.

Every time the mode corresponding clock routine MD15CLK is executed, the down count data DCNT is decremented in step 1736, 1742. As a result, when the decremented down count data DCNT reaches "0", the judgement of step 1748 turns to "YES" so that the bend flag BND is set at "0" in step 1750. After that, the judgement of step 1732 turns to "NO", by which the pitch variation control processing is canceled. Thereafter, as shown in FIG. 19E, the pitch of the musical tone is maintained at constant level. In this case, when it is judged that the down count data DCNT is at "0", the bend data $-$DCNT*$\Delta$ BND/4 which equals to "0" is supplied to the channel concerning the pitch variation control in step 1738, 1744. Thus, the pitch of the musical tone signal formed in this channel is returned to the pitch which has been set in the foregoing step 1702 shown in FIG. 19A.

Every time the melody key is depressed at the head timing of bar, the bend channel data BNDCH varies from "0" to "2" under the processes of steps 1708–1712. Under the processes of steps 1718–1722, 1734–1746, the channel to which the bend effect is applied is changed.

Incidentally, in the case where the pitch bend effect is applied to any additional tone, when the melody key is released or the performed chord is changed, the mode corresponding key-off routine MD15KOF is executed so that generation of the melody tone and additional tone is terminated as described before. In addition, by executing the mode corresponding chord change routine MD15CHG, the additional tone is varied in response to the chord change.

As described heretofore, in the fifteenth solo style play mode, plural additional tones including the tones whose pitches are one octave lower than the performed chord root and performed melody tone are added to the melody tone. Herein, the melody tone is performed in the tone color of violin, while the additional tones are performed in the tone colors of violin and classic guitar. When the melody key is depressed at the head timing of bar, the pitch bend effect is applied to the additional tone. Thus, the monotonous performance can be full of variety. In addition, it is possible to obtain the effect of the ensemble performance which is carried out by relatively small number of players like the Majestic March. Further, the additional tone to which the pitch bend effect is applied is varied, so that it is possible to obtain the performance full of variety.

In the present mode, the number of additional tones is set at "3", and initial pitch bend value is set corresponding to semitone pitch. However, it is possible to change the number of additional tones, and it is also possible to change the pitch bend value. In this mode, the characteristic of the pitch bend is varied linearly. However, this characteristic can be varied exponentially.

Moreover, in this mode, until the first execution of the mode corresponding clock routine MD15CLK is carried out after the melody-key-depression event, the pitch of the additional tone to which the pitch bend effect is to be applied is controlled not to be rising up. Instead, it is possible to raise up the pitch of the additional tone from the melody-key-depression timing.

Modified Examples

Next, description will be given with respect to the modified examples of the present embodiment.

(1) In the present embodiment described heretofore, the whole key area of the keyboard 10 is divided into two key areas in response to the operation of the automatic accompaniment switches, wherein divided lower key area is used for the chord performance. Instead, it is modified the present embodiment such that the whole key area is divided into two fixed key areas in advance, wherein lower key area is used for the chord performance but upper key area is used for the melody performance. In addition, instead of one stage key area of the present keyboard 10, it is possible to provide two stage key areas, one of which is used as the lower key area for the chord performance and the other is used as the upper key area for the melody performance.

(2) In the present embodiment, in response to the combination of plural depressed chord keys used for the chord performance, the microcomputer 60 refers to the chord constituent note table 81 to thereby detect the performed chord. Instead, it is possible to provide chord type designating switches. In this case, only the chord root is designated by depressing the chord key, and the chord type is designated by operating the chord type designating switch. Or, it is possible to use the highest or lowest tone in the performed melody tones as the chord root. In this case, the chord kind is designated in response to the number of depressed keys other than the highest and lowest depressed keys and the kind of depressed key (i.e., white, black key). Or, it is possible to utilize the chord designated by other instruments or automatic performance apparatus as the chord data.

(3) In the solo style play mode of the present embodiment, the melody tones designated by depressing the keys of the keyboard 10 are sounded in latter-come-first-sounded manner. Instead, it is possible to firstly sound the highest tone among the performed melody tones. In the solo style play mode, the melody performance cannot be limited to the monophonic performance. In this case, it is possible to simultaneously sound plural melody tones in response to the performance of the keyboard 10. Herein, even in the solo style play mode, plural channels are used for the melody performance. Or, it is possible to add the additional tone with respect to any one of plural depressed-key tones, such as the highest tone or lastly-depressed-key tone.

(4) In the present embodiment, the tone volume of the melody tone and additional tone is controlled based on the key touch. Instead, it is possible to maintain such tone volume at the constant level, regardless of the key touch. In this case, the touch detecting circuit 10*b* can be omitted.

As described heretofore, this invention may be practiced or embodied in still other ways without departing from the spirit or essential character thereof. Therefore, the preferred embodiment and its modified examples described herein are illustrative and not restrictive, the scope of the invention being indicated by the appended claims and all variations which come within the meaning of the claims are intended to be embraced therein.

What is claimed is:

1. An electronic musical instrument comprising:

(a) melody designating means for designating a melody tone;

(b) rhythm designating means for designating a rhythm;

(c) varying means for varying a generating condition of an additional tone in accordance with a lapse of time from the generation of the melody tone; and (d) adding means for adding the additional tone to said melody tone in accordance with the melody tone, the designated rhythm and said generating condition.

2. An electronic musical instrument according to claim 1 wherein said varying means varies a tone volume of said additional tone.

3. An electronic musical instrument according to claim 1 wherein said varying means varies a tone-generation channel from which said additional tone is to be generated.

4. An electronic musical instrument according to claim 1 wherein said varying means varies a pitch of said additional tone every time a predetermined time is passed.

5. An electronic musical instrument according to claim 4 wherein said varying means varies the pitch of said additional tone such that first and second additional tones both having the same note name but different pitches are alternatively generated.

6. An electronic musical instrument according to claim 1 further providing pattern generating means for generating a tone-generation pattern of said additional tone, whereby after said additional tone controlled by said adding means is continued to be generated during a predetermined period, a new additional tone is generated based on the tone-generation pattern generated by said pattern generating means.

7. An electronic musical instrument comprising:

(a) melody designating means for designating a melody tone;

(b) chord designating means for designating a chord;

(c) rhythm designating means for designating a rhythm which includes a predetermined tone-generation pattern of an additional tone to be added to said melody tone;

(d) detecting means for detecting whether or not a pitch of said melody tone is higher than a predetermined pitch;

(e) varying means for varying a forming pattern of said additional tone based on a detection result of said detecting means; and (f) adding means for adding the additional tone to said melody tone in accordance with the melody tone, the chord, and varied pattern.

8. An electronic musical instrument according to claim 7 wherein said varying means varies a number of additional tones to be generated.

9. An electronic musical instrument according to claim 7 wherein said varying means varies said additional tone to be identical to a chord constituent note within said chord designated by said chord designating means.

10. An electronic musical instrument comprising:

(a) melody designating means for designating a pitch of a melody tone;

(b) chord designating means for designating a chord;

(c) musical tone signal generating means for generating a musical tone signal corresponding to said melody tone and said chord;

(d) rhythm selecting means for selecting a rhythm kind;

(e) rhythm tone control means for controlling a rhythm tone signal to be generated by a predetermined timing in response to the rhythm kind and its rhythm progression selected by said rhythm selecting means;

(f) rhythm tone generating means for generating a rhythm tone corresponding to said rhythm tone signal;

(g) additional tone control means for controlling an additional tone to be added to said melody tone in response to the pitch of said melody tone, the chord and the rhythm progression, said musical tone signal also corresponding to said additional tone;

(h) pattern control means for controlling a forming pattern of said additional tone in response to a selected rhythm kind; and (i) tone color control means for controlling a tone color of said additional tone in response to the selected rhythm kind.

11. An electronic musical instrument comprising:

(a) a keyboard providing plural keys which are to be used for a melody and accompaniment performance;

(b) memory means for storing programs and data which are necessary to carry out the melody and accompaniment performance;

(c) additional tone generating means for automatically generating additional tone in relation to a melody tone designated by performing said keyboard;

(d) musical tone signal generating means providing a plurality of channels each capable of generating a musical tone signal corresponding to said melody tone and/or said additional tone;

(e) control means for controlling said musical tone signal to thereby control musical parameters of said melody tone and said additional tone based on the programs and data stored in said memory means;

(f) channel assigning means for assigning said melody tone and said additional tone to their desirable channels; and (g) changing means for automatically changing said channels from which said additional tones are generated to that a phonic image can be varied by sequentially moving positions at which said additional tones are generated.

12. An electronic musical instrument according to claim 11 wherein said control means varies a number and/or a forming pattern of additional tones to be added to said melody tone.

13. An electronic musical instrument according to claim 11 wherein said additional tone is selected indentical to a chord constituent note within a chord designated by performing said keyboard.

* * * * *